US008769941B2

(12) United States Patent
Svihla et al.

(10) Patent No.: US 8,769,941 B2
(45) Date of Patent: Jul. 8, 2014

(54) SUPPORT SYSTEM FOR AN EXHAUST AFTERTREATMENT SYSTEM FOR A LOCOMOTIVE HAVING A TWO-STROKE LOCOMOTIVE DIESEL ENGINE

(75) Inventors: Gary R. Svihla, Burr Ridge, IL (US); Satyajit Gowda, Willowbrook, IL (US)

(73) Assignee: Electro-Motive Diesel Inc., LeGrange, IL (US)

( * ) Notice: Subject to any disclaimer, the term of this patent is extended or adjusted under 35 U.S.C. 154(b) by 288 days.

(21) Appl. No.: 13/173,790

(22) Filed: Jun. 30, 2011

(65) Prior Publication Data

US 2012/0167558 A1 Jul. 5, 2012

Related U.S. Application Data

(60) Provisional application No. 61/388,443, filed on Sep. 30, 2010.

(51) Int. Cl.
*F01N 1/00* (2006.01)

(52) U.S. Cl.
USPC ..... 60/323; 60/280; 60/299; 60/322; 60/304; 105/62.1; 180/65.51; 180/309

(58) Field of Classification Search
USPC ..... 60/280, 299, 300, 322, 323, 324; 105/62.1; 180/65.51, 309
See application file for complete search history.

(56) References Cited

U.S. PATENT DOCUMENTS

| | | | | |
|---|---|---|---|---|
| 3,291,199 | A * | 12/1966 | Gutzeit | 165/202 |
| 6,371,238 | B1 | 4/2002 | Svihla | |
| 6,893,487 | B2 * | 5/2005 | Alger et al. | 95/273 |
| 8,240,138 | B2 * | 8/2012 | Lu et al. | 60/297 |
| 8,495,869 | B2 * | 7/2013 | Beissler et al. | 60/301 |
| 8,495,960 | B2 * | 7/2013 | Willbrandt et al. | 105/62.1 |
| 2009/0044531 | A1 | 2/2009 | Lu et al. | |
| 2009/0249783 | A1 | 10/2009 | Gokhale et al. | |
| 2009/0277429 | A1 | 11/2009 | Marsh et al. | |

* cited by examiner

*Primary Examiner* — Binh Q Tran
(74) *Attorney, Agent, or Firm* — Miller, Matthias & Hull

(57) ABSTRACT

A support system for an exhaust aftertreatment system for a two-stroke locomotive diesel engine providing a secure mounting of certain components of the exhaust aftertreatment system to the locomotive structure while at the same time allowing for differential thermal expansion (and the resulting physical displacement) of the components. The support system further carries the physical mass of the components of the aftertreatment system while at the same time effectively isolating the aftertreatment system from external loads and forces caused by motions of the locomotive engine and the locomotive frame.

23 Claims, 42 Drawing Sheets

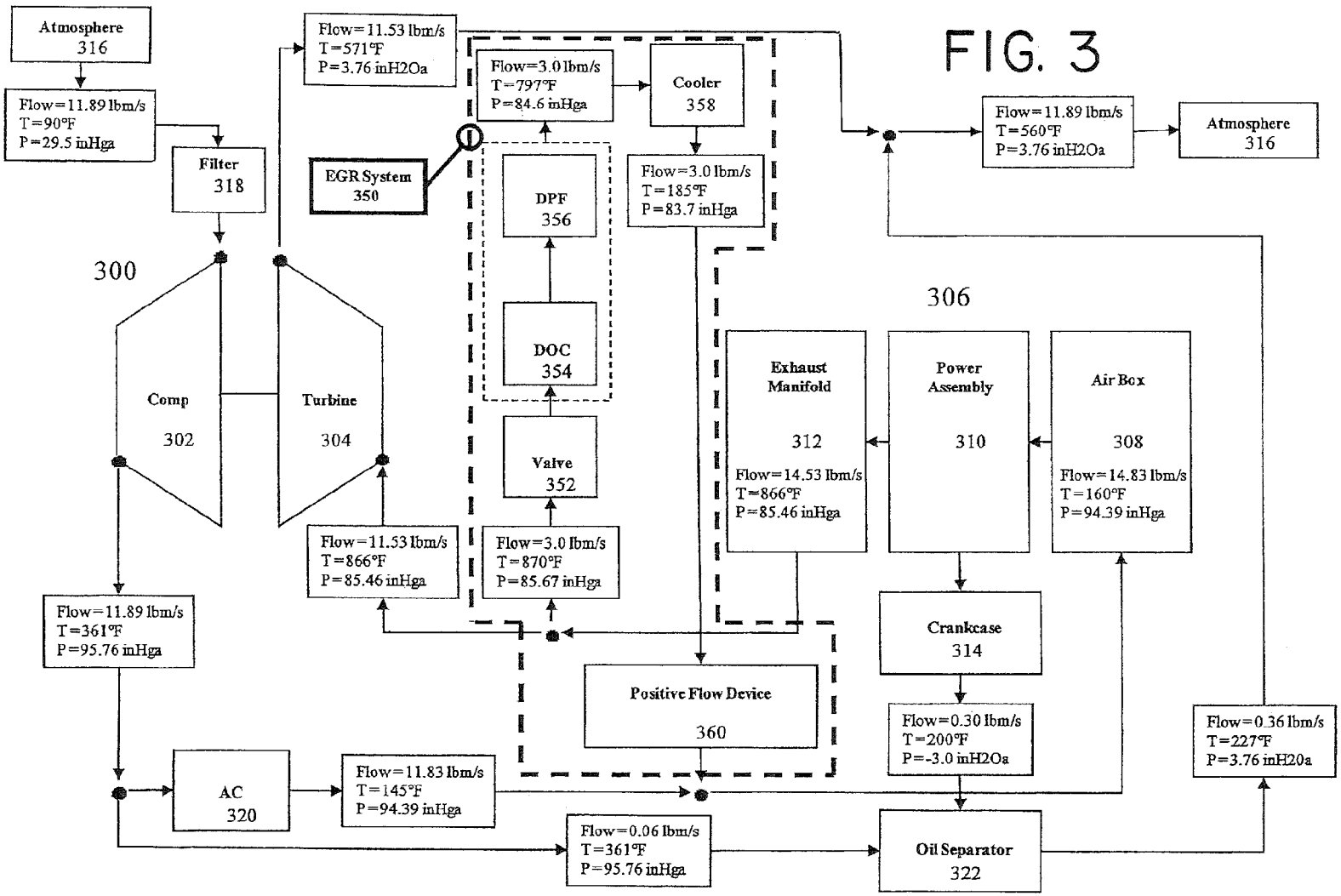
FIG. 3
Atmosphere 316
Flow=11.89 lbm/s T=90°F P=29.5 inHga
Filter 318
Comp 302
300
Turbine 304
Flow=11.53 lbm/s T=571°F P=3.76 inH2Oa
EGR System 350
Flow=3.0 lbm/s T=797°F P=84.6 inHga
Cooler 358
Flow=3.0 lbm/s T=185°F P=83.7 inHga
DPF 356
DOC 354
Valve 352
Flow=3.0 lbm/s T=870°F P=85.67 inHga
Flow=11.53 lbm/s T=866°F P=85.46 inHga
Flow=11.89 lbm/s T=560°F P=3.76 inH2Oa
Atmosphere 316
306
Exhaust Manifold 312
Flow=14.53 lbm/s T=866°F P=85.46 inHga
Power Assembly 310
Air Box 308
Flow=14.83 lbm/s T=160°F P=94.39 inHga
Crankcase 314
Flow=0.30 lbm/s T=200°F P=-3.0 inH2Oa
Flow=0.36 lbm/s T=227°F P=3.76 inH2Oa
Oil Separator 322
Positive Flow Device 360
Flow=0.06 lbm/s T=361°F P=95.76 inHga
Flow=11.83 lbm/s T=145°F P=94.39 inHga
AC 320
Flow=11.89 lbm/s T=361°F P=95.76 inHga

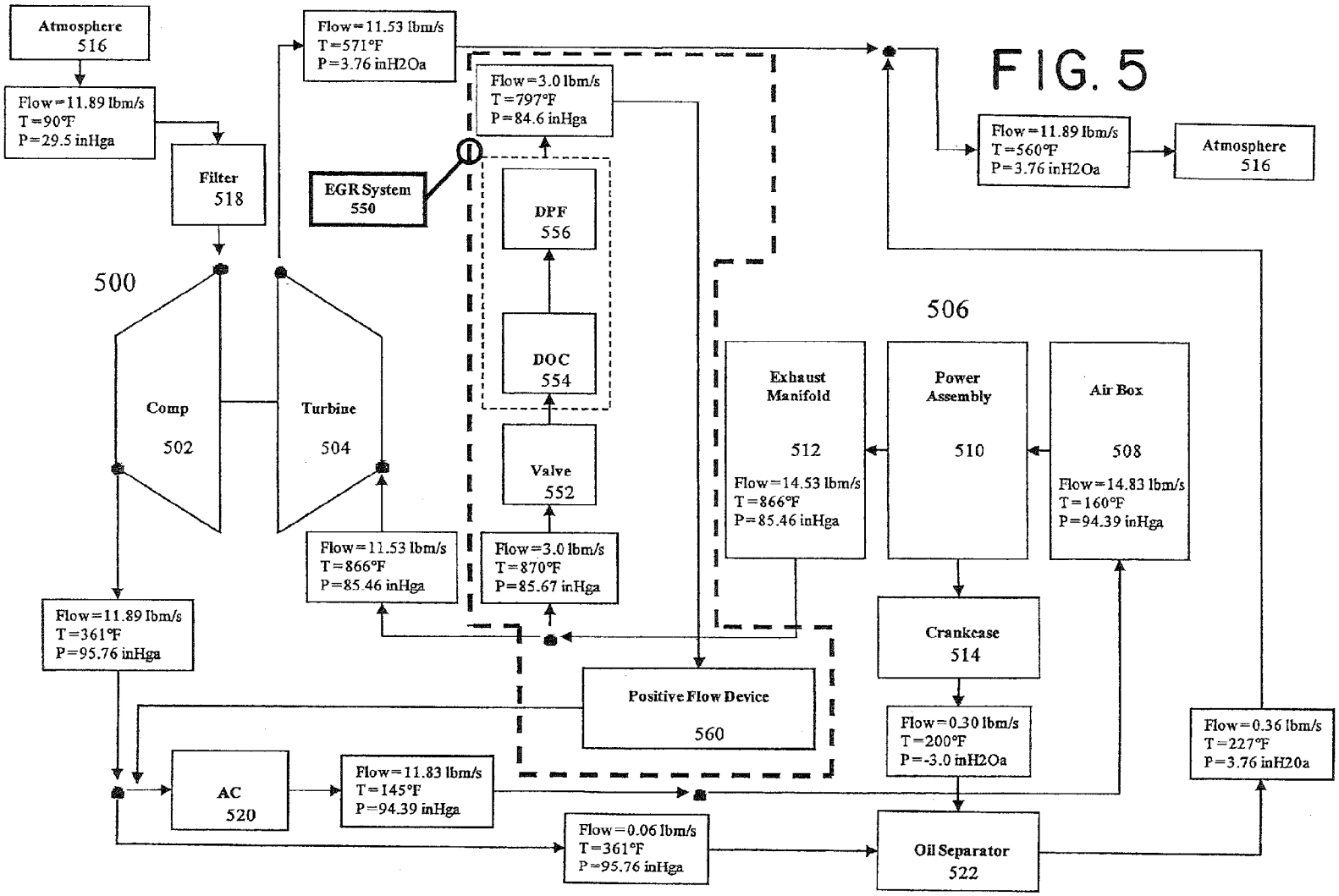
FIG. 5
Atmosphere 516
Flow=11.89 lbm/s T=90°F P=29.5 inHga
Filter 518
Comp 502
500
Turbine 504
Flow=11.53 lbm/s T=571°F P=3.76 inH2Oa
EGR System 550
Flow=3.0 lbm/s T=797°F P=84.6 inHga
DPF 556
DOC 554
Valve 552
Flow=3.0 lbm/s T=870°F P=85.67 inHga
Flow=11.53 lbm/s T=866°F P=85.46 inHga
Flow=11.89 lbm/s T=560°F P=3.76 inH2Oa
Atmosphere 516
506
Power Assembly 510
Exhaust Manifold 512
Flow=14.53 lbm/s T=866°F P=85.46 inHga
Air Box 508
Flow=14.83 lbm/s T=160°F P=94.39 inHga
Crankcase 514
Flow=0.30 lbm/s T=200°F P=-3.0 inH2Oa
Oil Separator 522
Flow=0.36 lbm/s T=227°F P=3.76 inH2Oa
Positive Flow Device 560
Flow=0.06 lbm/s T=361°F P=95.76 inHga
Flow=11.83 lbm/s T=145°F P=94.39 inHga
AC 520
Flow=11.89 lbm/s T=361°F P=95.76 inHga

103

SUPPORT SYSTEM FOR AN EXHAUST AFTERTREATMENT SYSTEM FOR A LOCOMOTIVE HAVING A TWO-STROKE LOCOMOTIVE DIESEL ENGINE

CROSS-REFERENCE TO RELATED APPLICATIONS

This application is a Non-Provisional Patent Application, which claims benefit to U.S. Provisional Application Ser. No. 61/388,443, entitled "Exhaust Aftertreatment System for a Locomotive," filed Sep. 30, 2010, the complete disclosure thereof being incorporated herein by reference.

TECHNICAL FIELD

This application relates to a locomotive diesel engine and, more particularly, to a support system for an exhaust aftertreatment system for a two-stroke locomotive diesel engine.

BACKGROUND OF THE DISCLOSURE

The present application generally relates to a locomotive diesel engine and, more specifically, to a support system for an exhaust aftertreatment system for a two-stroke locomotive diesel engine. The disclosed support system provides an arrangement for mounting certain components of an exhaust aftertreatment system to the locomotive structure. This arrangement allows for differential thermal movement (and resulting physical displacement) of certain exhaust aftertreatment system components caused by engine exhaust gases. The disclosed support system further carries the physical mass of the exhaust aftertreatment system and further isolates such from external loads and forces caused by the locomotive engine and the locomotive body frame during operation.

FIG. 1A illustrates a locomotive 103 including a conventional uniflow two-stroke diesel engine system 101. As shown in FIGS. 1B and 1C, the locomotive diesel engine system 101 of FIG. 1A includes a conventional air system. Referring concurrently to both FIGS. 1B and 1C, the locomotive diesel engine system 101 generally comprises a turbocharger 100 having a compressor 102 and a turbine 104, which provides compressed air to an engine 106 having an airbox 108, power assemblies 110, an exhaust manifold 112, and a crankcase 114. In a typical locomotive diesel engine system 101, the turbocharger 100 increases the power density of the engine 106 by compressing and increasing the amount of air transferred to the engine 106.

More specifically, the turbocharger 100 draws air from the atmosphere 116, which is filtered using a conventional air filter 118. The filtered air is compressed by a compressor 102. The compressor 102 is powered by a turbine 104, as will be discussed in further detail below. A larger portion of the compressed air (or charge air) is transferred to an aftercooler (or otherwise referred to as a heat exchanger, charge air cooler, or intercooler) 120 where the charge air is cooled to a select temperature. Another smaller portion of the compressed air is transferred to a crankcase ventilation oil separator 122, which evacuates the crankcase 114 in the engine; entrains crankcase gas; and filters entrained crankcase oil before releasing the mixture of crankcase gas and compressed air into the atmosphere 116.

The cooled charge air from the aftercooler 120 enters the engine 106 via an airbox 108. The decrease in charge air intake temperature provides a denser intake charge to the engine, which reduces $NO_X$ emissions while improving fuel economy. The airbox 108 is a single enclosure, which distributes the cooled air to a plurality of cylinders. The combustion cycle of a diesel engine includes, what is referred to as, scavenging and mixing processes. During the scavenging and mixing processes, a positive pressure gradient is maintained from the intake port of the airbox 108 to the exhaust manifold 112 such that the cooled charge air from the airbox 108 charges the cylinders and scavenges most of the combusted gas from the previous combustion cycle.

More specifically, during the scavenging process in the power assembly 110, the cooled charge air enters one end of a cylinder controlled by an associated piston and intake ports. The cooled charge air mixes with a small amount of combusted gas remaining from the previous cycle. At the same time, the larger amount of combusted gas exits the other end of the cylinder via four exhaust valves and enters the exhaust manifold 112 as exhaust gas. The control of these scavenging and mixing processes is instrumental in emissions reduction as well as in achieving desired levels of fuel economy.

Exhaust gases from the combustion cycle exit the engine 106 via an exhaust manifold 112. The exhaust gas flow from the engine 106 is used to power the turbine 104 of the turbocharger 100, and thereby power the compressor 102 of the turbocharger 100. After powering the turbine 104, the exhaust gases are released into the atmosphere 116 via an exhaust stack 124 or silencer.

The exhaust gases released into the atmosphere by a locomotive diesel engine include particulates, nitrogen oxides ($NO_X$) and other pollutants. Legislation has been passed to reduce the amount of pollutants that may be released into the atmosphere. Traditional systems have been implemented which reduce these pollutants, but at the expense of fuel efficiency. Accordingly, it is an object of the present disclosure to provide an exhaust aftertreatment system and a support system therefor, which reduces the amount of pollutants (e.g., particulates, nitrogen oxides ($NO_X$) and other pollutants) released by the diesel engine while achieving desired fuel efficiency.

The various embodiments of the disclosed aftertreatment system are able to exceed, what is referred in the industry as, the Environmental Protection Agency's (EPA) Tier II (40 CFR 92), Tier III (40 CFR 1033), and Tier IV (40 CFR 1033) emission requirements, as well as the European Commission (EURO) Tier Mb emission requirements. These various emission requirements are cited by reference herein and made a part of this patent application.

Exhaust aftertreatment systems for traditional fixed industrial applications cannot be generally applied to locomotives. The modern locomotive layout has limited size constraints as it has generally been optimized over years of development. Moreover, locomotives operate in extreme operating conditions. Accordingly, exhaust aftertreatment systems used for traditional, fixed industrial applications cannot simply be applied to locomotives and provide for years of reliable service. The modern locomotive layout is not generally adapted for or designed to accommodate an exhaust aftertreatment system. Therefore, both the exhaust aftertreatment system and its support structure must be creatively packaged in order to provide for an efficient and reliable system. Various embodiments of a support system are shown and described which may allow the exhaust aftertreatment system to operate within a locomotive operating environment and placed within the limited size constraints of the locomotive.

The following description is presented to enable one of ordinary skill in the art to make and use the disclosure and is provided in the context of a patent application and its requirements. Various modifications to the preferred embodiment and the generic principles and features described herein will be readily apparent to those skilled in the art. Thus, the present disclosure is not intended to be limited to the embodiments shown, but is to be accorded the widest scope consistent with the principles and features described herein.

SUMMARY OF THE DISCLOSURE

According to one embodiment of the present disclosure, provided is a support system for mounting the components of an exhaust aftertreatment system. The components of the exhaust aftertreatment system generally include a turbocharger mixing manifold and a plurality of discrete exhaust aftertreatment line assemblies. The support system comprises a primary support structure and a secondary support structure. The primary support structure includes an aftertreatment tray module and a plurality of locomotive body frame panels. The secondary support structure includes a plurality of support link assemblies mounted to the aftertreatment tray module of the primary support structure, and is adapted to carry the exhaust aftertreatment line assemblies. This support system arrangement (a) carries the physical mass load of said exhaust aftertreatment system, (b) isolates said exhaust aftertreatment system from external loads and forces, and (c) allows for the physical displacement of certain components of said exhaust aftertreatment system resulting from thermal expansion.

According to another embodiment of the present disclosure, the exhaust aftertreatment system includes a manifold for receiving exhaust gas from a locomotive engine. A support system is provided which carries the physical mass load of the exhaust manifold via the locomotive body frame. The turbocharger mixing manifold is flexibly coupled to exhaust aftertreatment system to allow for isolated motion therebetween while maintaining the flow of exhaust gas from the engine to the turbocharger mixing manifold.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which:

FIG. 3 is a system diagram of the two-stroke diesel engine system having an EGR system in accordance with an embodiment of the present disclosure.

FIG. 5 is a system diagram of the two-stroke diesel engine system having an EGR system in accordance with another embodiment of the present disclosure.

FIG. 12I is a perspective view of the embodiment of the exhaust aftertreatment system of FIG. 12A including the primary and secondary support structure for the aftertreatment system.

FIG. 12O is a top view of the embodiment of the exhaust aftertreatment system of FIG. 12A.

DETAILED DESCRIPTION OF THE DRAWINGS

Figure 1A:
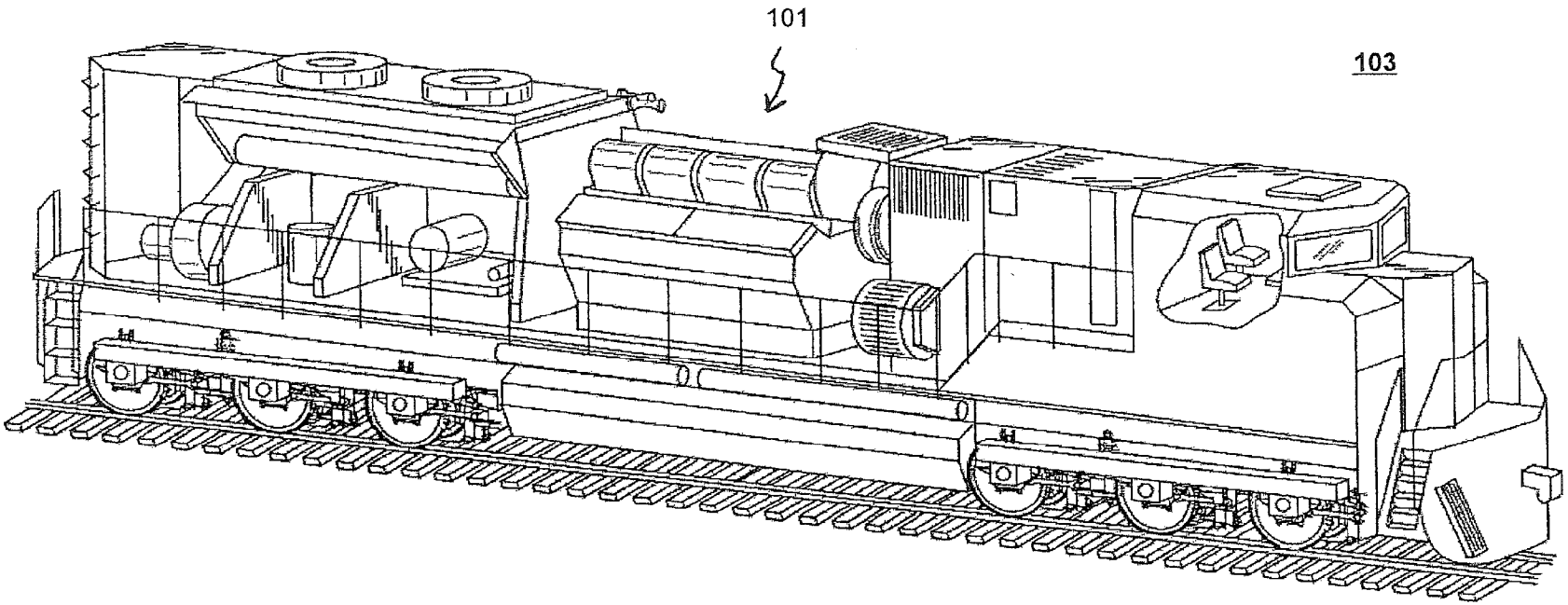
FIG. 1A is a perspective view of a locomotive including a two-stroke diesel engine system.
Figure 1B:
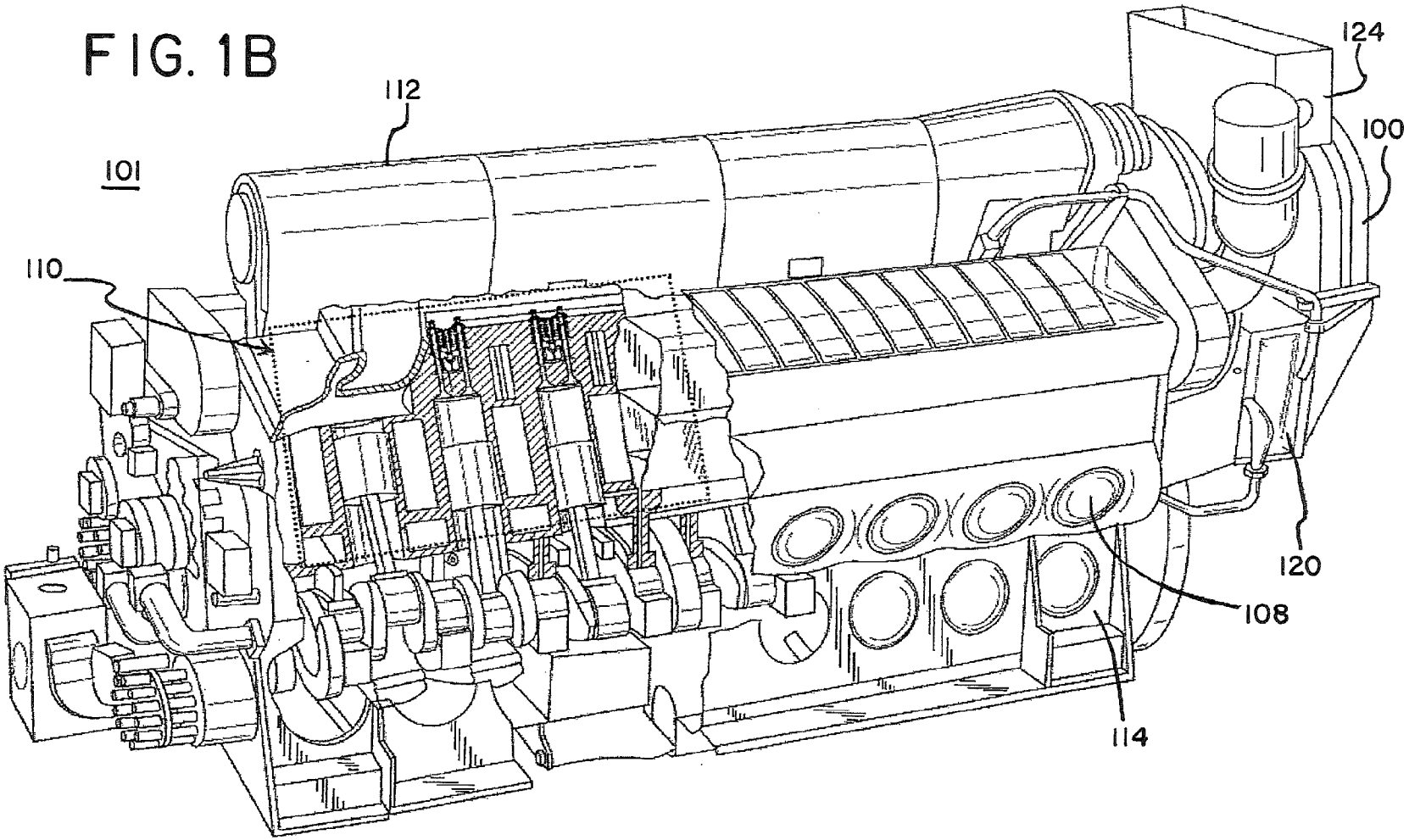
FIG. 1B is a partial cross-sectional perspective view of the two-stroke diesel engine system of FIG. 1A.
Figure 1C:
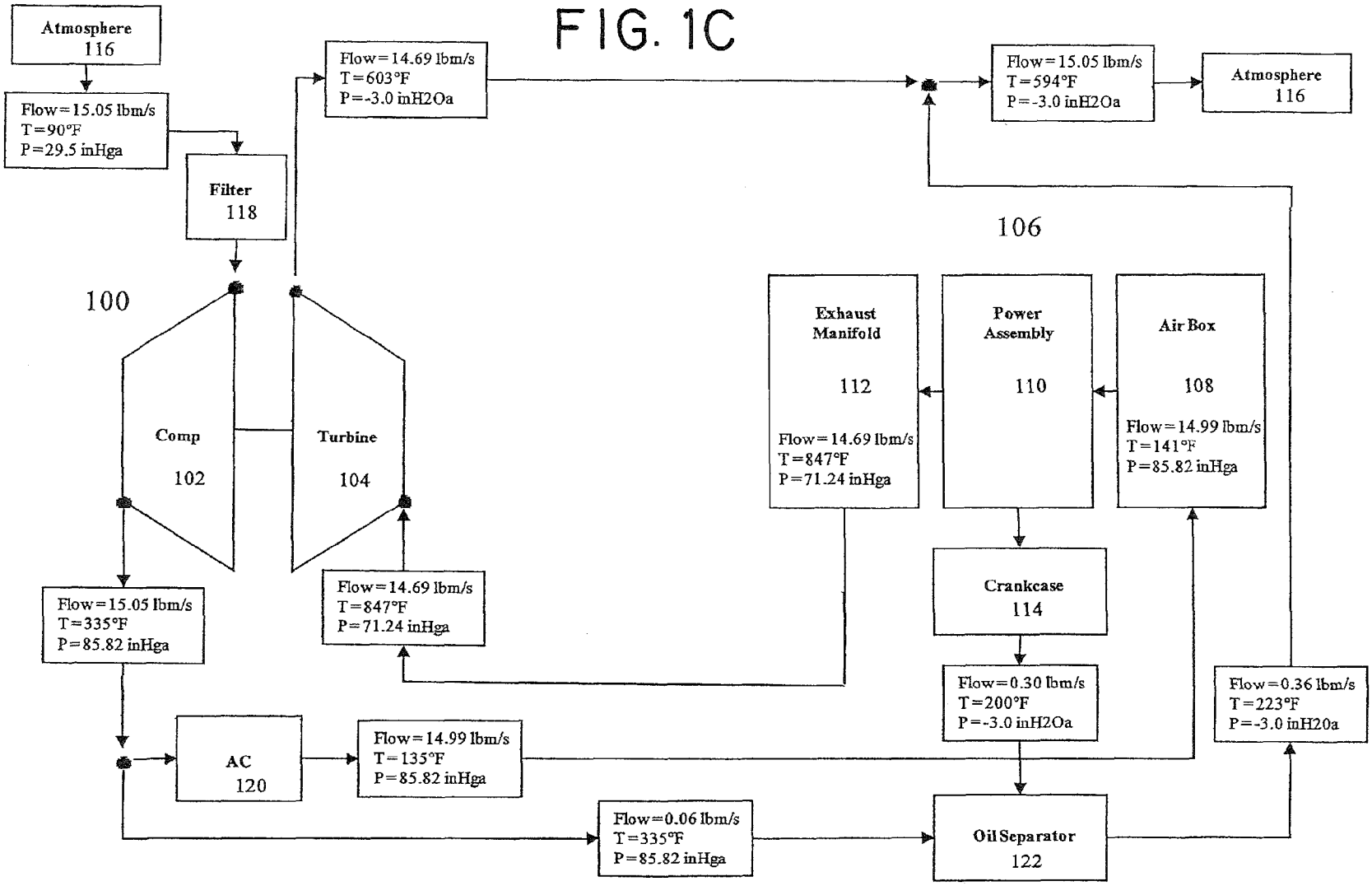
FIG. 1C is a system diagram of the two-stroke diesel engine of FIG. 1B having a conventional air system.

The present disclosure is directed to a support system for an exhaust aftertreatment system for a two-stroke locomotive diesel engine to reduce pollutants, namely particulate matter and $NO_X$ emissions released from the engine. The present exhaust aftertreatment system may be further implemented in conjunction with an exhaust gas recirculation (EGR) system which enhances the unique scavenging and mixing processes of a locomotive uniflow two-stroke diesel engine in order to further reduce $NO_X$ emissions while achieving desired fuel economy.

The present system may further be enhanced by adapting the various engine parameters, the EGR system parameters, and the exhaust aftertreatment system parameters. For example, as discussed above, emissions reduction and achievement of desired fuel efficiency may be accomplished by maintaining or enhancing the scavenging and mixing processes in a uniflow two-stroke diesel engine (e.g., by adjusting the intake port timing, intake port design, exhaust valve design, exhaust valve timing, EGR system design, engine component design and turbocharger design).

The various embodiments of the present disclosure may be applied to locomotive two-stroke diesel engines having various numbers of cylinders (e.g., 8 cylinders, 12 cylinders, 16 cylinders, 18 cylinders, 20 cylinders, etc.). The various embodiments may further be applied to other two-stroke uniflow scavenged diesel engine applications other than for locomotive applications (e.g., marine applications). The various embodiments may also be applied to other types of diesel engines (e.g., four-stroke diesel engines).

The present support system for the exhaust aftertreatment system comprises a primary and a secondary support structure. The primary support structure generally supports the mass load of the exhaust aftertreatment system via the locomotive body frame (and not the locomotive engine). The secondary support structure provides a mounting system between the exhaust aftertreatment system and the primary support structure. The secondary support structure permits translational freedom of the exhaust aftertreatment system required for installation; accommodates operational load forces originating from the locomotive body frame and the engine; and allows for thermal expansion of the exhaust aftertreatment system.

The present support system also provides a rigid connection between the exhaust aftertreatment system and the locomotive body frame, while allowing for differential thermal growth. At the same time, the present support system isolates the exhaust aftertreatment system from external loads and forces of the engine and the locomotive body frame during locomotive operation.

In another embodiment, the secondary support structure includes a support linkage system of a plurality of individual support link assemblies, each capable of carrying significant mechanical loads in the limited space constraints afforded by the locomotive body frame. These assemblies provide for a solid connection, which minimizes wear over time due to relatively high loads and temperatures subjected thereto during locomotive operation.

The present support system further facilitates maintenance and repair of the exhaust aftertreatment system. For example, one embodiment of the support system includes a removable tray module allowing for the convenient removal of components to be serviced or repaired. In another example, the support structure includes support link assemblies which allow individual components of the exhaust aftertreatment system to be removed while adjacent components remain in place.

Figure 2A:
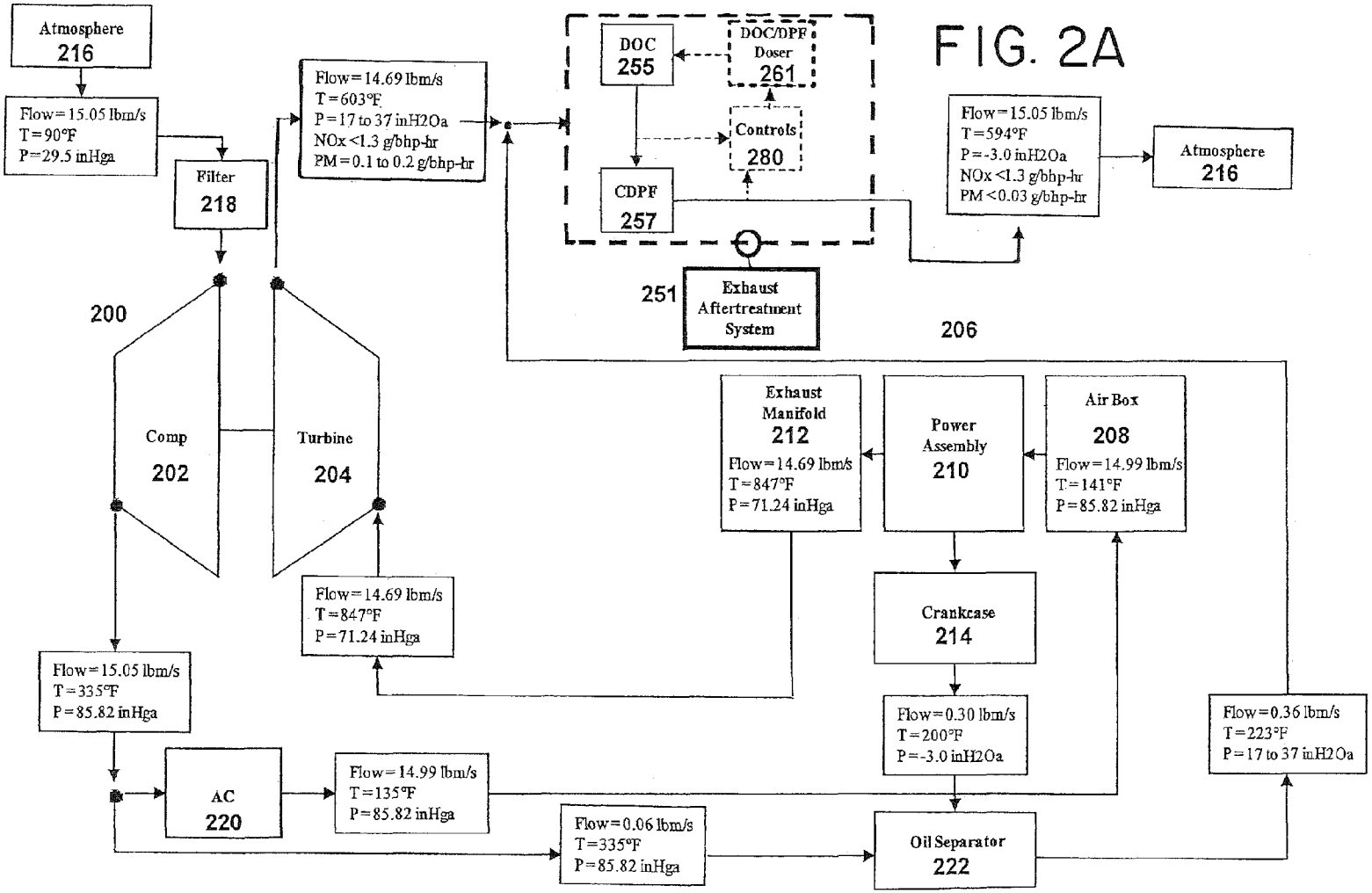
FIG. 2A is a system diagram of a two-stroke diesel engine having an exhaust aftertreatment system.

As shown in FIG. 2A, the present disclosure may include an exhaust aftertreatment system 251 including an emissions reduction system for reducing particulate matter (PM), hydrocarbons and/or carbon monoxide emissions from the exhaust manifold 212 of the engine 206. In this system, the engine 206 may be adapted to have reduced $NO_X$ emissions (e.g., less than 1.3 g/bhp-hr). In order to reduce further emissions from the exhaust, the emissions reduction system of the exhaust aftertreatment system 251 may include a filtration system 255/257 to filter other emissions including particulate matter from the exhaust. More specifically, the exhaust aftertreatment system 251 may include a diesel oxidation catalyst (DOC) 255 and a diesel particulate filter (DPF) 257. The DOC 255 uses an oxidation process to reduce the particulate matter (PM), hydrocarbons and/or carbon monoxide emissions in the exhaust gases. The DPF 257 includes a filter to reduce PM and/or soot from the exhaust gases. The DOC/DPF 255/257 arrangement may be adapted to passively regenerate and oxidize soot. Although a DOC 255 and DPF 257 are shown, other comparable filters may be used.

A filtration control system 280 may be provided, which monitors and maintains the cleanliness of the DOC 255 and DPF 257. In another embodiment, a control system 280 determines and monitors the pressure differential across the DOC/DPF arrangement 255/257 using pressure sensors. As discussed above, the DOC/DPF arrangement 255/257 may be adapted to passively regenerate and oxidize soot within the DPF 257. However, the DPF 257 will accumulate ash and some soot, which must be removed in order to maintain the DPF efficiency. As ash and soot accumulate, the pressure differential across the DOC/DPF arrangement 255/257 increases. Accordingly, the control system 280 monitors and determines whether the DOC/DPF arrangement 255/257 has reached a select pressure differential at which the DPF 257 requires cleaning or replacement. In response thereto, the control system 280 may signal an indication that the DPF 257 requires cleaning or replacement.

Alternatively, a control system 280 is shown to be coupled to a DOC/DPF doser 261 (e.g., a hydrocarbon injector), which adds fuel onto the catalyst for the DOC/DPF arrangement 255/257 for active regeneration of the filter. The fuel reacts with oxygen in the presence of the catalyst, which increases the temperature of the exhaust gas to promote oxidation of soot on the filter. In yet another embodiment, the control system 280 may be coupled to a heating device 293, which may be in the form of an optional burner or other heating element for controlling the temperature of the exhaust gas to control oxidation of soot on the filter.

Figure 2B:
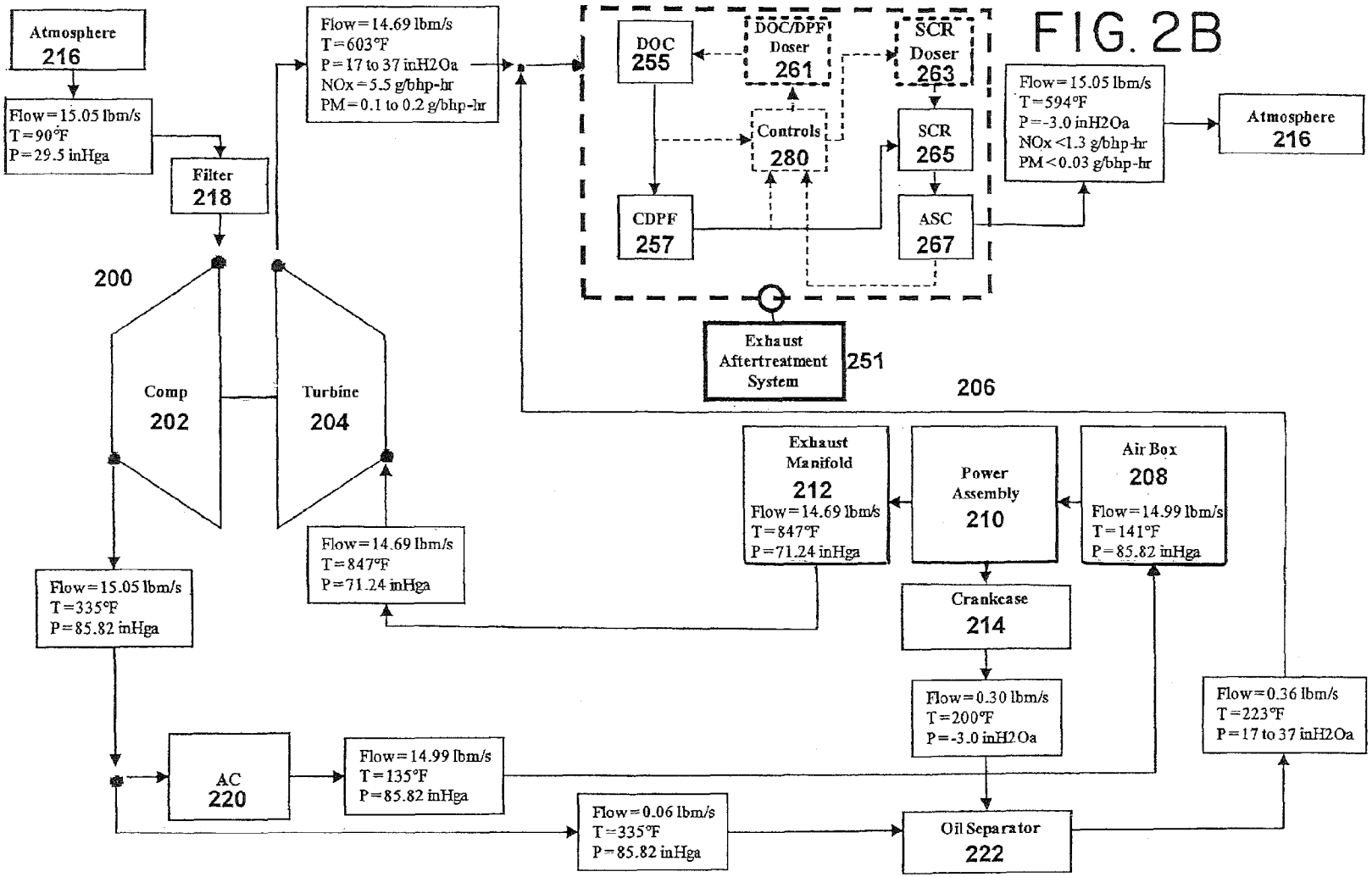
FIG. 2B is a system diagram of a two-stroke diesel engine having an exhaust aftertreatment system including a selective catalytic reduction catalyst and ammonia slip catalyst.
Figure 2C:
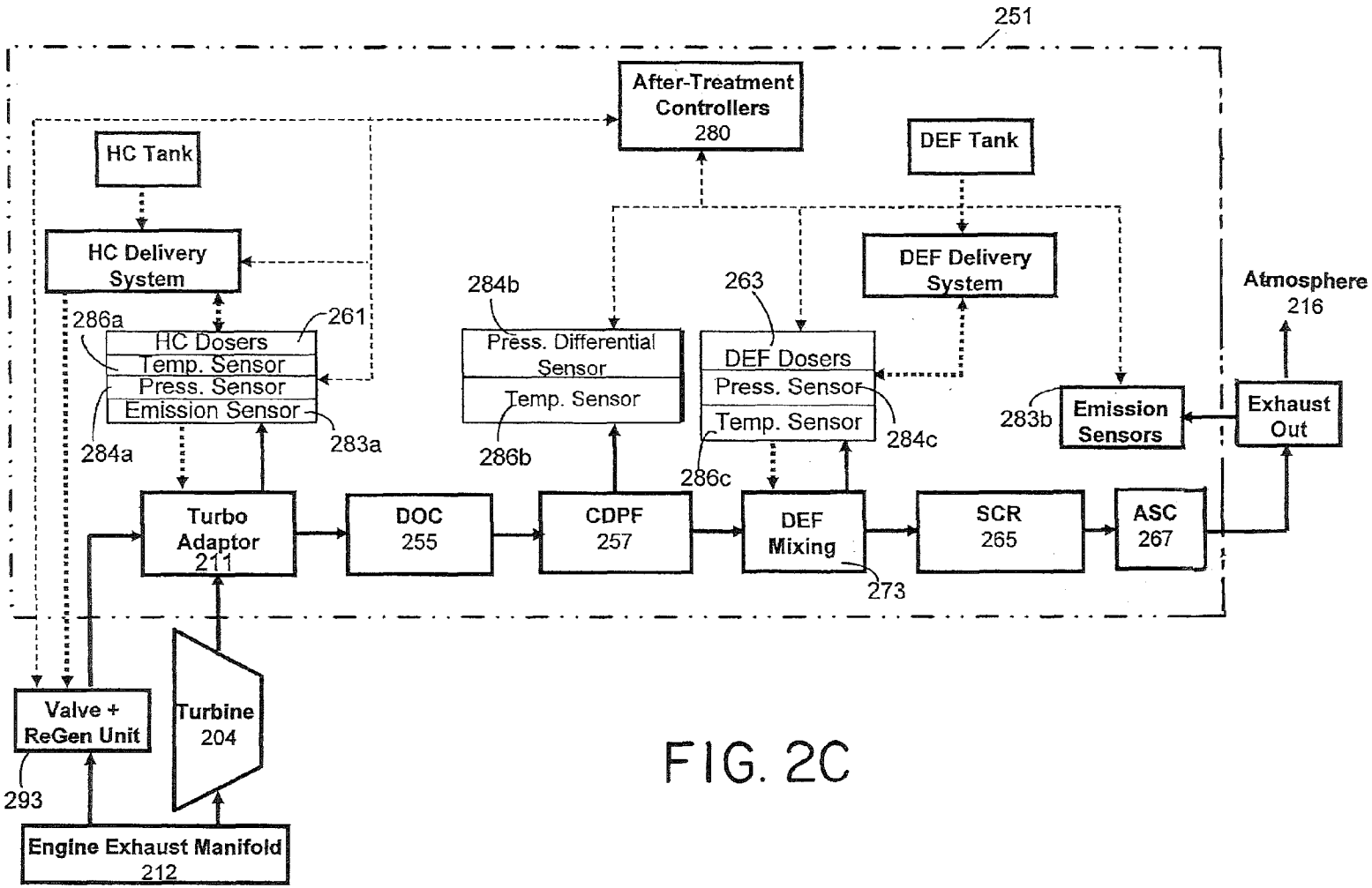
FIG. 2C is a system diagram of another embodiment of two-stroke diesel engine after treatment system according to the present disclosure.

As shown in FIG. 2B, the present disclosure may include an exhaust aftertreatment system 251 for reducing $NO_X$ emissions from the exhaust manifold 212 of the engine 206 in addition to the particulate matter (PM), hydrocarbons and/or carbon monoxide emissions. In this particular arrangement, the emissions reduction system of the exhaust aftertreatment system 251 further includes a selective catalytic reduction (SCR) catalyst 265 and ammonia slip catalyst (ASC) 267 in addition to a filtration system 255/257 similar to that shown and described with respect to FIG. 2A. More specifically, the exhaust aftertreatment system 251 includes a diesel oxidation catalyst (DOC) 255, a diesel particulate filter (DPF) 257, a control system (for filtration) 280 and DOC/DPF doser 261 similar to that shown and described with respect to FIG. 2A. Additionally, the exhaust aftertreatment system 251 of FIG. 2B further includes a selective catalytic reduction (SCR) catalyst 265 and ammonia slip catalyst (ASC) 267 adapted to lower $NO_X$ emissions of the engine 206. The SCR 265 and ASC 267 are further coupled to an SCR doser 263 for dosing an SCR reductant fluid or SCR reagent (e.g., urea-based, diesel exhaust fluid (DEF)). Upon injection of the SCR reductant fluid or SCR reagent, the $NO_X$ from the exhaust reacts with the reductant fluid over the catalyst in the SCR 265 and ASC 267 to form nitrogen and water. In another embodiment, although a urea-based SCR 265 is shown, other SCRs known in the art may also be used (e.g., hydrocarbon based SCRs, solid SCRs, De-$NO_X$ systems, etc.). In yet another embodiment, the system may be adapted to lower $NO_X$ emissions prior to lowering the particulate matter (PM), hydrocarbons and/or carbon monoxide emissions. In such an arrangement, the SCR system 265/267 is located upstream of the filtration system 255/257.

As shown in the FIG. 2B, the present disclosure may include a control system 280 for controlling the cleanliness of the DOC 255 and DPF 257 similar to that shown and described with respect to FIG. 2A. Additionally, the control system 280 of FIG. 2B may be further adapted to monitor the SCR 265 and ASC 267 arrangement, and to control $NO_X$ reduction by administering the SCR reductant fluid or SCR reagent injection based on the monitored values. More specifically, the control system 280 may be adapted to signal to the SCR doser to increase injection of SCR reductant fluid or SCR reagent if $NO_X$ levels are more than a select threshold. In contrast, the control system 280 may be adapted to signal to the SCR doser to decrease injection of SCR reductant fluid or SCR reagent when $NO_X$ levels are less than a select threshold.

The control system 280 may further be adapted to control injection of SCR reductant fluid or SCR reagent based on temperature. For example, the SCR 265 and ASC 267 may have select temperature operability ranges, wherein the SCR 265 and ASC 267 may only reduce $NO_X$ at certain temperatures. In this arrangement, the control system 265 may be adapted to signal the injector 263 to only operate over that temperature range. In yet another embodiment (not shown), the exhaust aftertreatment system 251 may further include a heating device, such as an optional burner which controls the exhaust temperature. As such, the control system 280 may be further adapted to signal the burner to maintain the temperature of the exhaust gas to a temperature within the operability ranges of the SCR 265 and ASC 267.

As illustrated in FIGS. 3-9, an EGR system may be used to reduce exhaust emissions. These EGR systems may be used in conjunction with the exhaust aftertreatment systems of FIGS. 2A and 2B to further reduce exhaust emissions. Such emissions systems for a diesel locomotive engine which include both an EGR system and an exhaust aftertreatment system are described in detail with respect to FIGS. 10-11.

As shown in FIG. 3, an EGR system 350 is illustrated which recirculates exhaust gases from the exhaust manifold 312 of the engine 306, mixes the exhaust gases with the cooled charge air of the aftercooler 320, and delivers such to the airbox 308. In this EGR system 350, only a select percentage of the exhaust gases is recirculated and mixed with the intake charge air in order to selectively reduce pollutant emissions (including $NO_X$) while achieving desired fuel efficiency. The percentage of exhaust gases to be recirculated is also dependent on the amount of exhaust gas flow needed for powering the compressor 302 of the turbocharger 300. It is desired that enough exhaust gas powers the turbine 304 of the turbocharger 300 such that an optimal amount of fresh air is transferred to the engine 306 for combustion purposes. For locomotive diesel engine applications, it is desired that less than about 35% of the total gas (including compressed fresh air from the turbocharger and recirculated exhaust gas) delivered to the airbox 308 be recirculated. This arrangement provides for pollutant emissions (including $NO_X$) to be reduced, while achieving desired fuel efficiency.

A flow regulating device may be provided for regulating the amount of exhaust gases to be recirculated. In one embodiment, the flow regulating device is a valve 352 as illustrated in FIG. 3. Alternatively, the flow regulating device may be a positive flow device 360, wherein there is no valve (not shown) or the valve 352 may function as an on/off valve as will be discussed in greater detail below.

The select percentage of exhaust gases to be recirculated may be optionally filtered. Filtration is used to reduce the particulates that will be introduced into engine 306 during recirculation. The introduction of particulates into the engine 306 causes accelerated wear especially in uniflow two-stroke diesel engine applications. If the exhaust gases are not filtered and recirculated into the engine, the unfiltered particulates from the combustion cycle would accelerate wear of the piston rings and cylinder liner. For example, uniflow two-stroke diesel engines are especially sensitive to cylinder liner wall scuffing as hard particulates are dragged along by the piston rings the cylinder liner walls after passing through the intake ports. Oxidation and filtration may also be used to prevent fouling and wear of other EUR system components (e.g., cooler 358 and positive flow device 360) or engine system components. In FIG. 3, a diesel oxidation catalyst (DOC) 354 and a diesel particulate filter (DPF) 356 are provided for filtration purposes. The DOC uses an oxidation process to reduce the particulate matter (PM), hydrocarbons and/or carbon monoxide emissions in the exhaust gases. The DPF includes a filter to reduce PM and/or soot from the exhaust gases. The DOC/DPF arrangement may be adapted to passively regenerate and oxidize soot. Although a DOC 354 and DPF 356 are shown, other comparable filters may be used.

The filtered air is optionally cooled using cooler 358. The cooler 358 serves to decrease the recirculated exhaust gas temperature, thereby providing a denser intake charge to the engine. The decrease in recirculated exhaust gas intake temperature reduces NOX emissions and improves fuel economy. It is preferable to have cooled exhaust gas as compared to hotter exhaust gas at this point in the EGR system due to ease of deliverability and compatibility with downstream EGR system and engine components.

The cooled exhaust gas flows to a positive flow device 360 which provides for the necessary pressure increase to overcome the pressure loss within the EGR system 350 itself and overcome the adverse pressure gradient between the exhaust manifold 312 and the introduction location of the recirculated exhaust gas. Specifically, the positive flow device 360 increases the static pressure of the recirculated exhaust gas sufficient to introduce the exhaust gas upstream of the power assembly. Alternatively, the positive flow device 360 decreases the static pressure upstream of the power assembly at the introduction location sufficient to force a positive static pressure gradient between the exhaust manifold 312 and the introduction location upstream of the power assembly 310. The positive flow device 360 may be in the form of a roots blower, a venturi, centrifugal compressor, propeller, turbocharger, pump or the like. The positive flow device 360 may be internally sealed such that oil does not contaminate the exhaust gas to be recirculated.

As shown in FIG. 3, there is a positive pressure gradient between the airbox 308 (e.g., about 94.39 inHga) to the exhaust manifold 312 (e.g., about 85.46 inHga) necessary to attain the necessary levels of cylinder scavenging and mixing. In order to recirculate exhaust gas, the recirculated exhaust gas pressure is increased to at least match the aftercooler discharge pressure as well as overcome additional pressure drops through the EGR system 350. Accordingly, the exhaust gas is compressed by the positive flow device 360 and mixed with fresh air from the aftercooler 320 in order to reduce $NO_X$ emissions while achieving desired fuel economy. It is preferable that the introduction of the exhaust gas is performed in a manner which promotes mixing of recirculated exhaust gas and fresh air.

As an alternative to the valve 352 regulating the amount of exhaust gas to be recirculated as discussed above, a positive flow device 360 may instead be used to regulate the amount of exhaust gas to be recirculated. For example, the positive flow device 360 may be adapted to control the recirculation flow rate of exhaust gas air from the engine 306, through the EGR system 350, and back into the engine 306. In another example, the valve 352 may function as an on/off type valve, wherein the positive flow device 360 regulates the recirculation flow rate by adapting the circulation speed of the device. In this arrangement, by varying the speed of the positive flow device 360, a varying amount of exhaust gas may be recirculated. In yet another example, the positive flow device 360 is a positive displacement pump (e.g., a roots blower) which regulates the recirculation flow rate by adjusting its speed.

A new turbocharger 300 is provided having a higher pressure ratio than that of the prior art uniflow two-stroke diesel engine turbochargers. The new turbocharger provides for a higher compressed charge of fresh air, which is mixed with the recirculated exhaust gas from the positive flow device 360. The high pressure mixture of fresh air and exhaust gas delivered to the engine 306 provides the desired trapped mass of oxygen necessary for combustion given the low oxygen concentration of the trapped mixture of fresh air and cooled exhaust gas.

Figure 4:
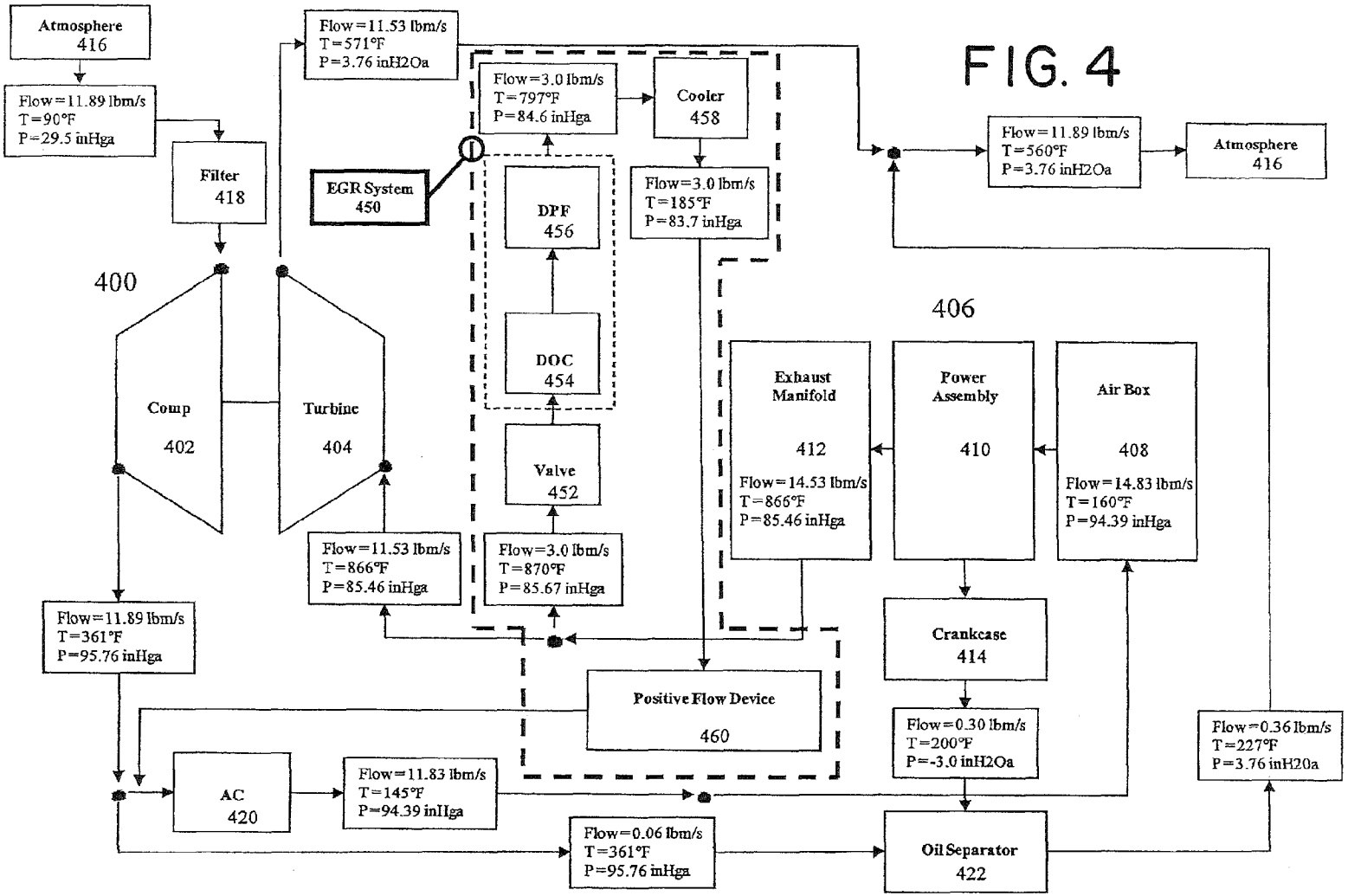
FIG. 4 is a system diagram of the two-stroke diesel engine system having an EGR system in accordance with another embodiment of the present disclosure.

As shown in an EGR system 450 embodiment of FIG. 4, recirculated exhaust gas may be alternatively introduced upstream of the aftercooler 420 and cooled thereby before being directed to the airbox 408 of the engine 406. In this embodiment, the aftercooler 420 (in addition to the cooler 458) cools the fresh charge air from the turbocharger 400 and the recirculated exhaust gas to decrease the overall charge air intake temperature of the engine 406, thereby providing a denser intake charge air to the engine 406. In another embodiment (not shown), an optional oil filter may be situated downstream of the positive flow device 460 to filter any residual oil therefrom. This arrangement prevents oil contamination in the aftercooler 420 and in the recirculated exhaust gas.

As shown in an EGR system 550 embodiment of FIG. 5, the filtered air may optionally be directed to the aftercooler 520 for the same purposes without the addition of the cooler 358, 458 in FIGS. 3 and 4, respectively. In this arrangement, the cooling of the exhaust gas to be recirculated is performed solely by the aftercooler 520. The aftercooler 520 would serve to cool the fresh charge air from the turbocharger and the recirculated exhaust gas, thereby providing a denser overall intake charge air to the engine.

Figure 6:
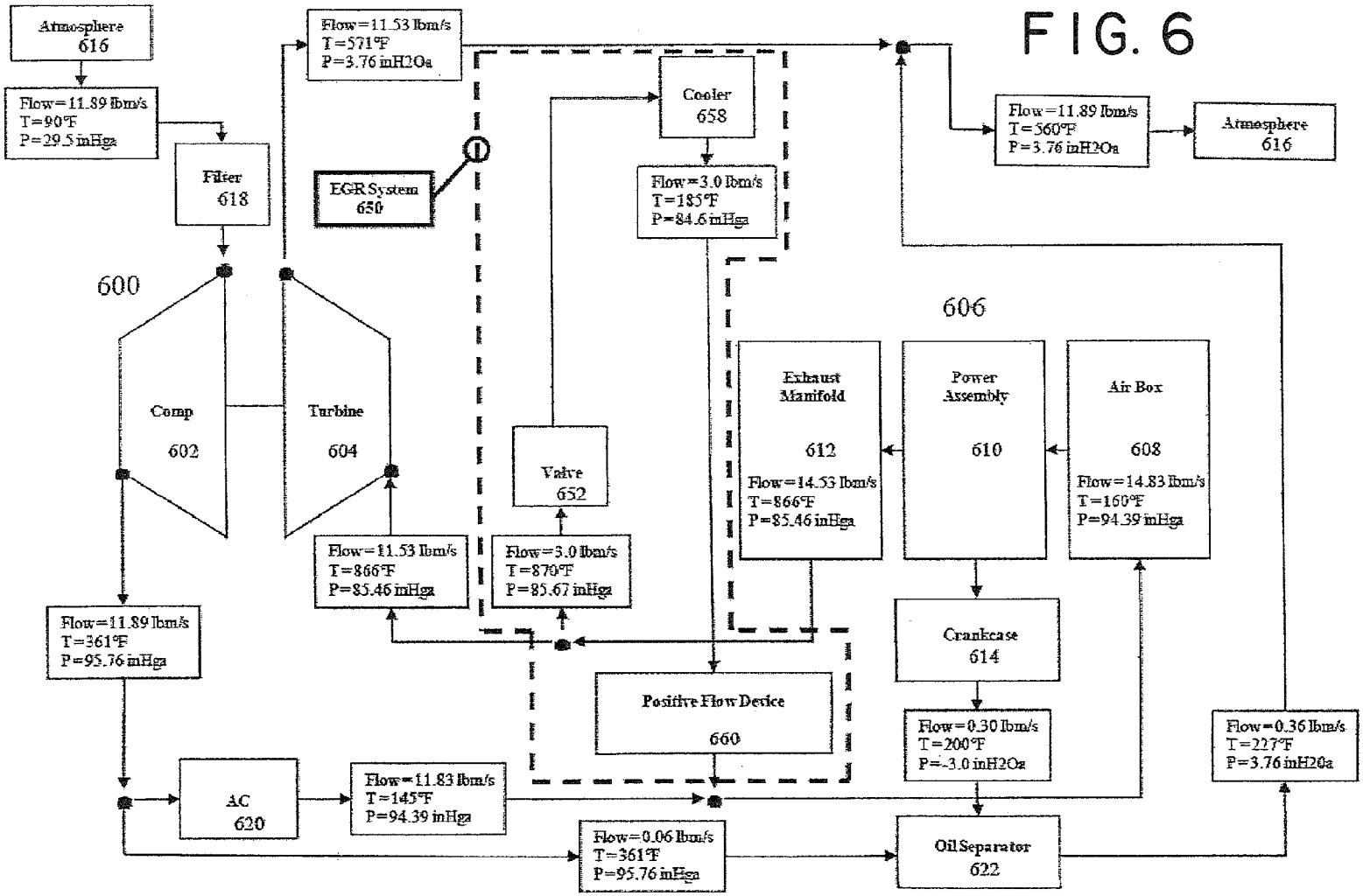
FIG. 6 is a system diagram of the two-stroke diesel engine system having an EGR system in accordance with another embodiment of the present disclosure.

As shown in FIG. 6, an EGR system 650 is illustrated which does not include the DOC/DPF filtration system of the previous embodiments.

Figure 7:
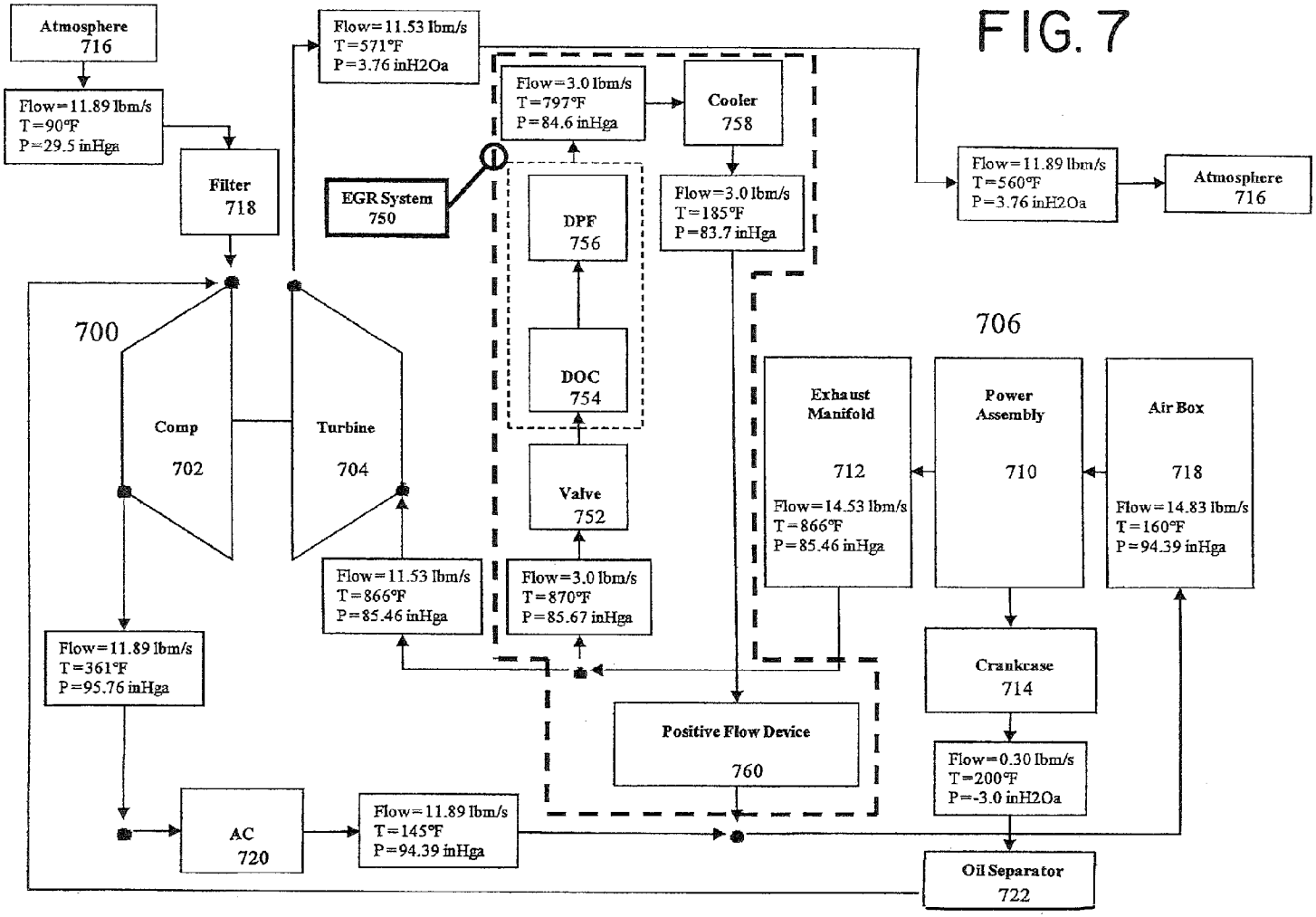
FIG. 7 is a system diagram of the two-stroke diesel engine system having an EGR system in accordance with another embodiment of the present disclosure.

As shown in FIG. 7, an EGR system 750 is illustrated, which is implemented in an engine 706 having positive or negative crankcase ventilation, whereby the oil separator outlet is directed to the low pressure region upstream of the compressor inlet. Accordingly, the compressed air from the turbocharger 700 is not directed to an oil separator as shown in the previous embodiments.

A control system may further be provided which monitors and controls select components of any of the EGR systems of the previous embodiments, or other similar EGR systems. Specifically, the control system may be adapted to control select components of an EGR system to adaptively regulate exhaust gas recirculation based on various operating conditions of the locomotive. The control system may be in the form of a locomotive control computer, another onboard control computer or other similar control device. Various embodiments of control systems are illustrated in FIG. 8.

Figure 8:
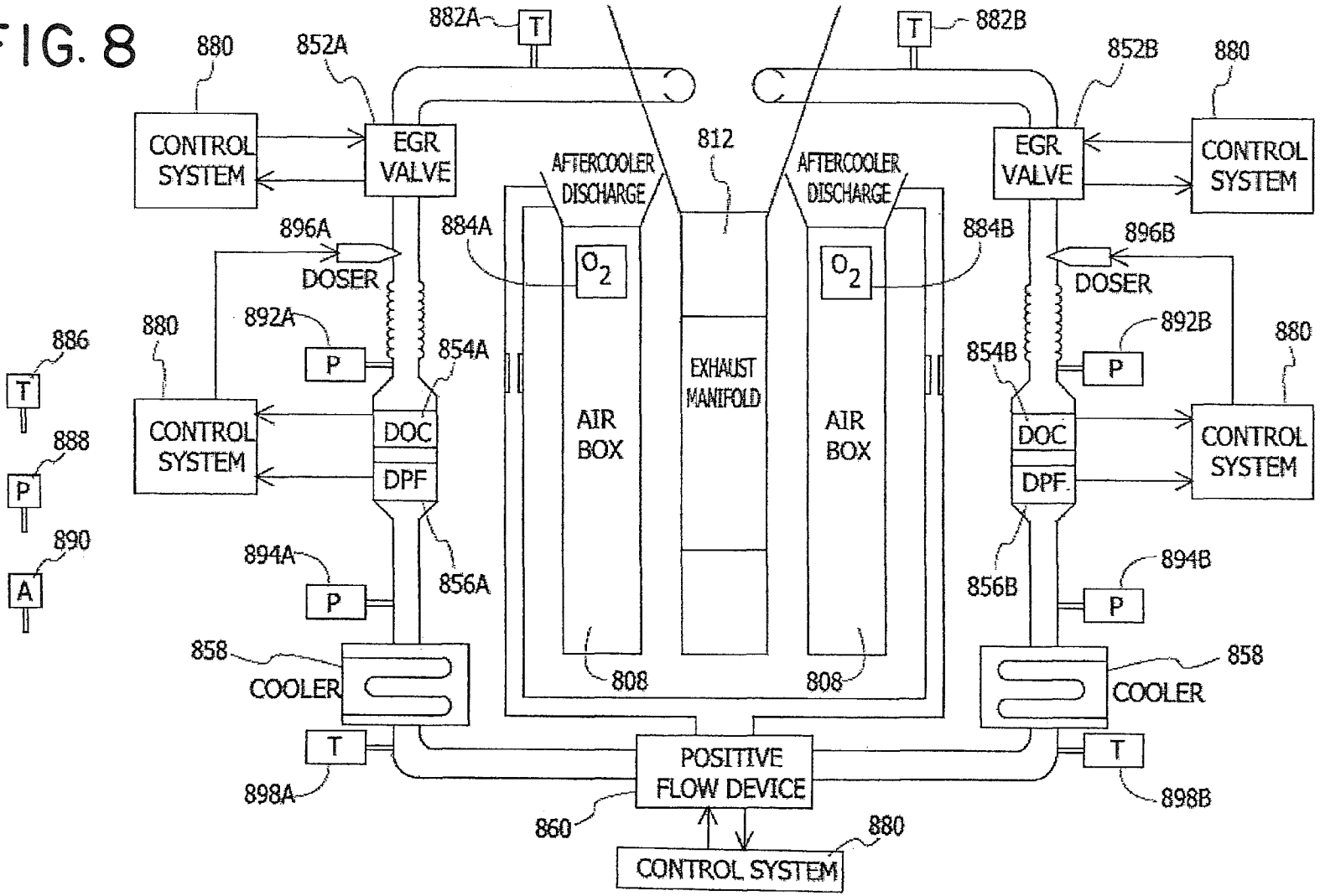
FIG. 8 is a system diagram of a control system for an EGR system for a two-stroke diesel engine in accordance with an embodiment of the present disclosure.
Figure 9A:
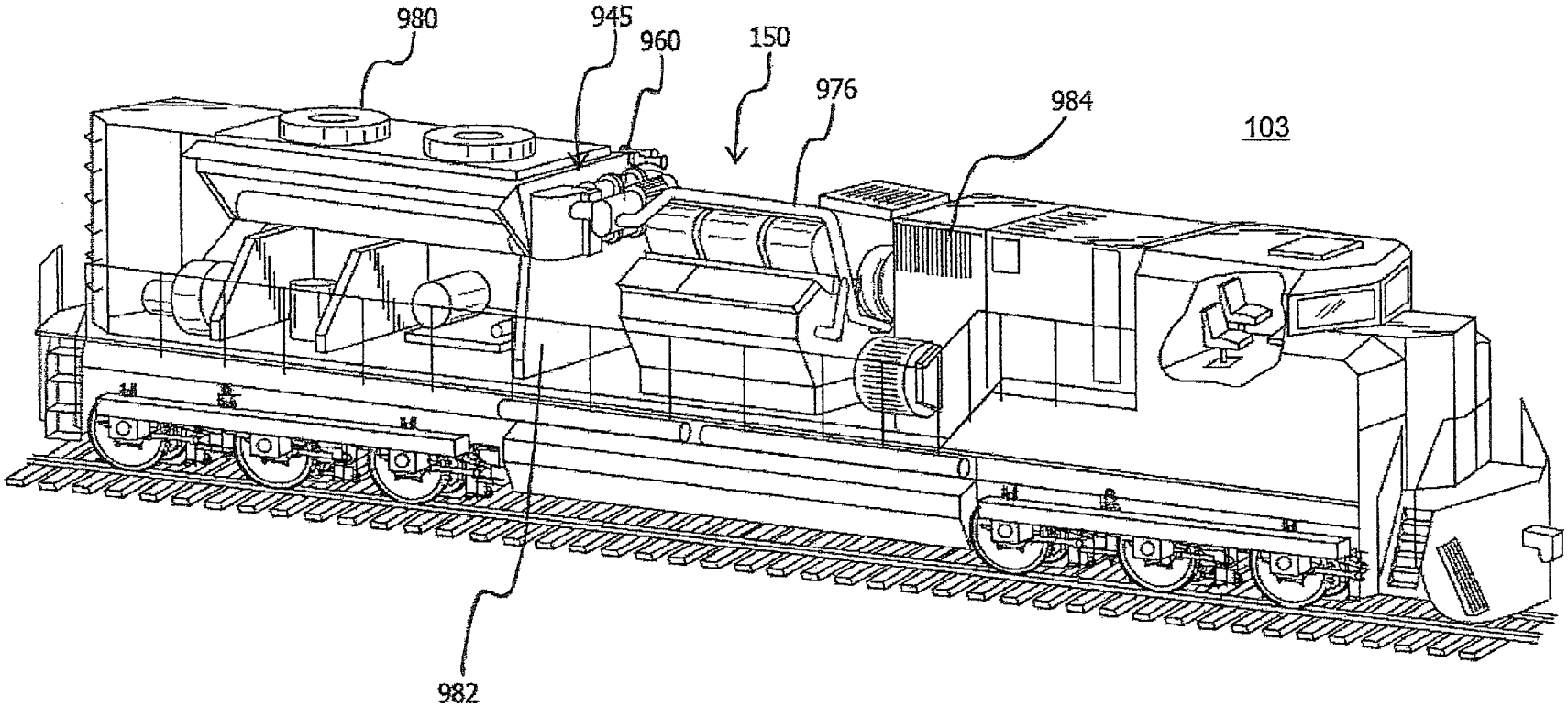
FIG. 9A is a perspective view of a locomotive including a two-stroke diesel engine system with an EGR system in accordance with an embodiment of the present disclosure.
Figure 9B:
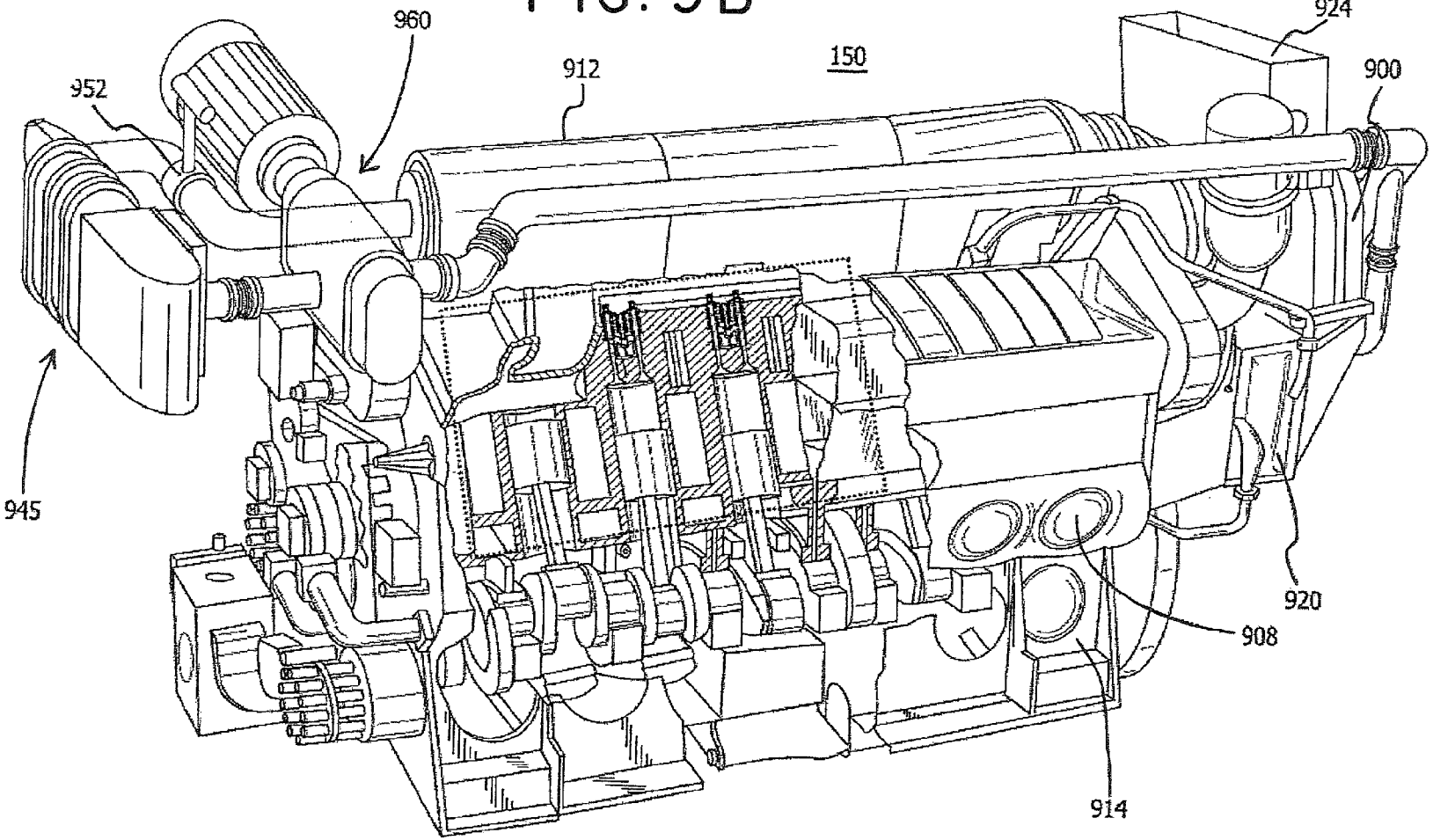
FIG. 9B is a partial cross-sectional perspective view of the two-stroke diesel engine system with an EGR system of FIG. 9A.
Figure 9C:
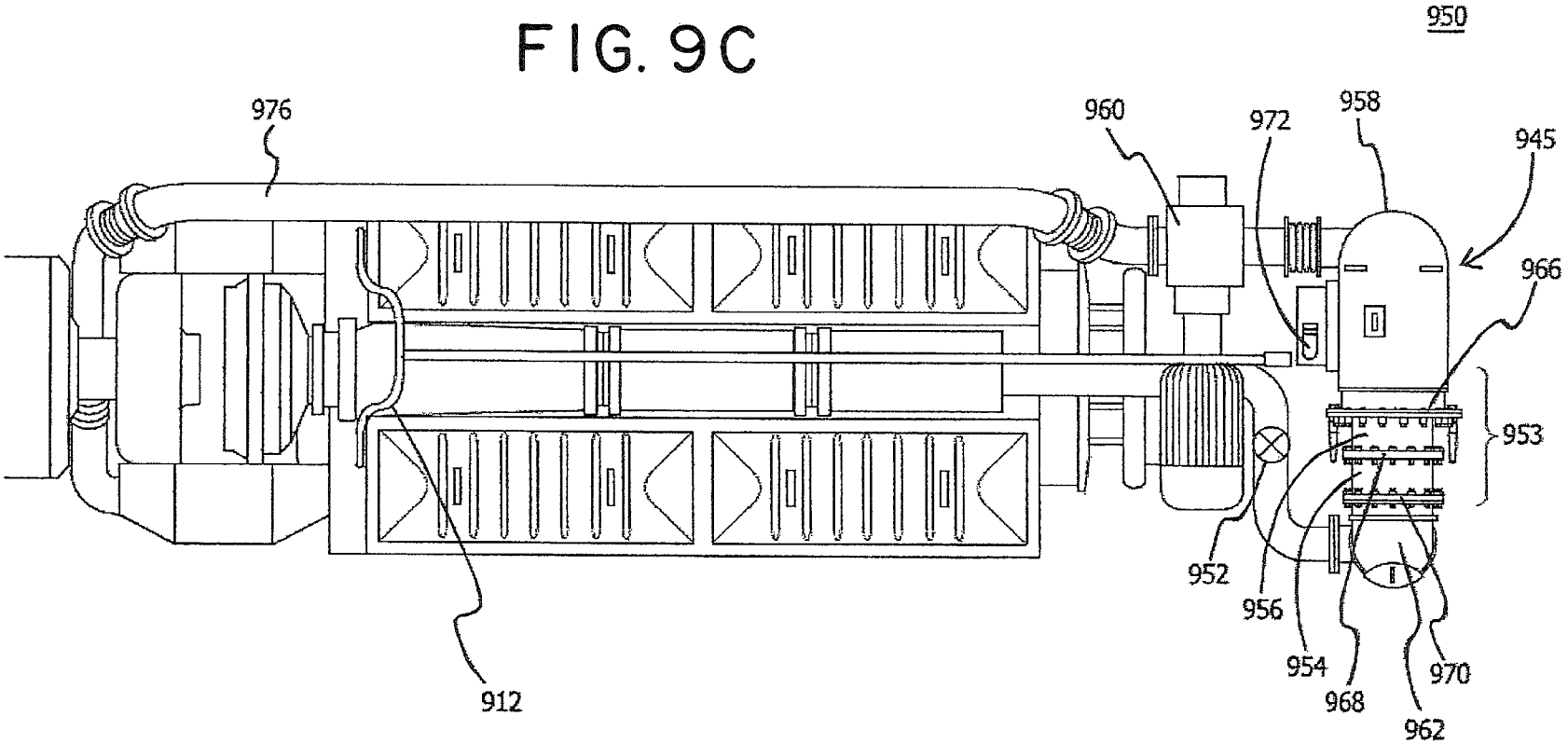
FIG. 9C is a top view of the two-stroke diesel engine system with an EGR system of FIG. 9A.
Figure 9D:
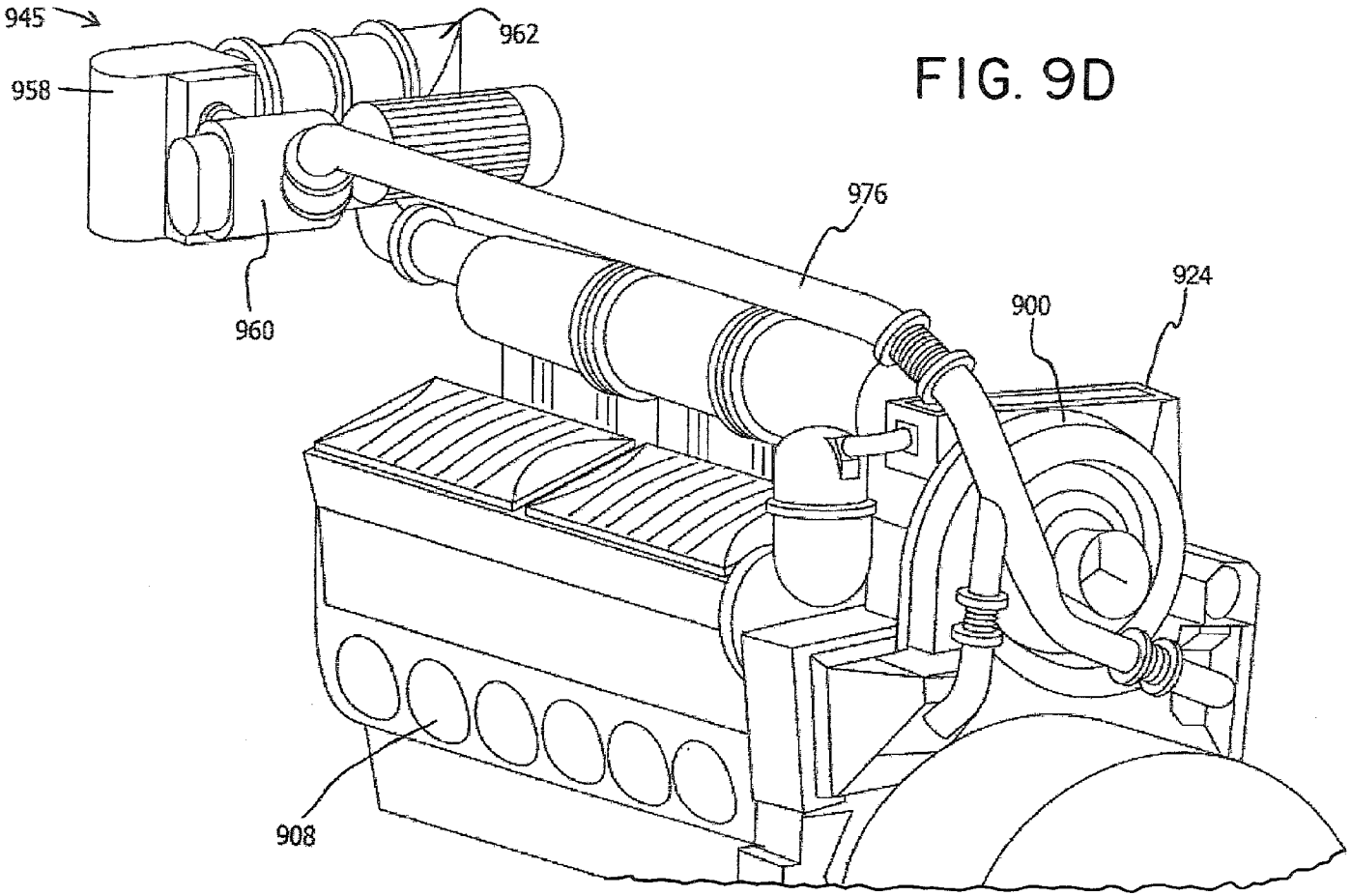
FIG. 9D is a side view of the two-stroke diesel engine system with an EGR system of FIG. 9A, showing ducts for introducing the recirculated exhaust gas into the engine.
Figure 9E:
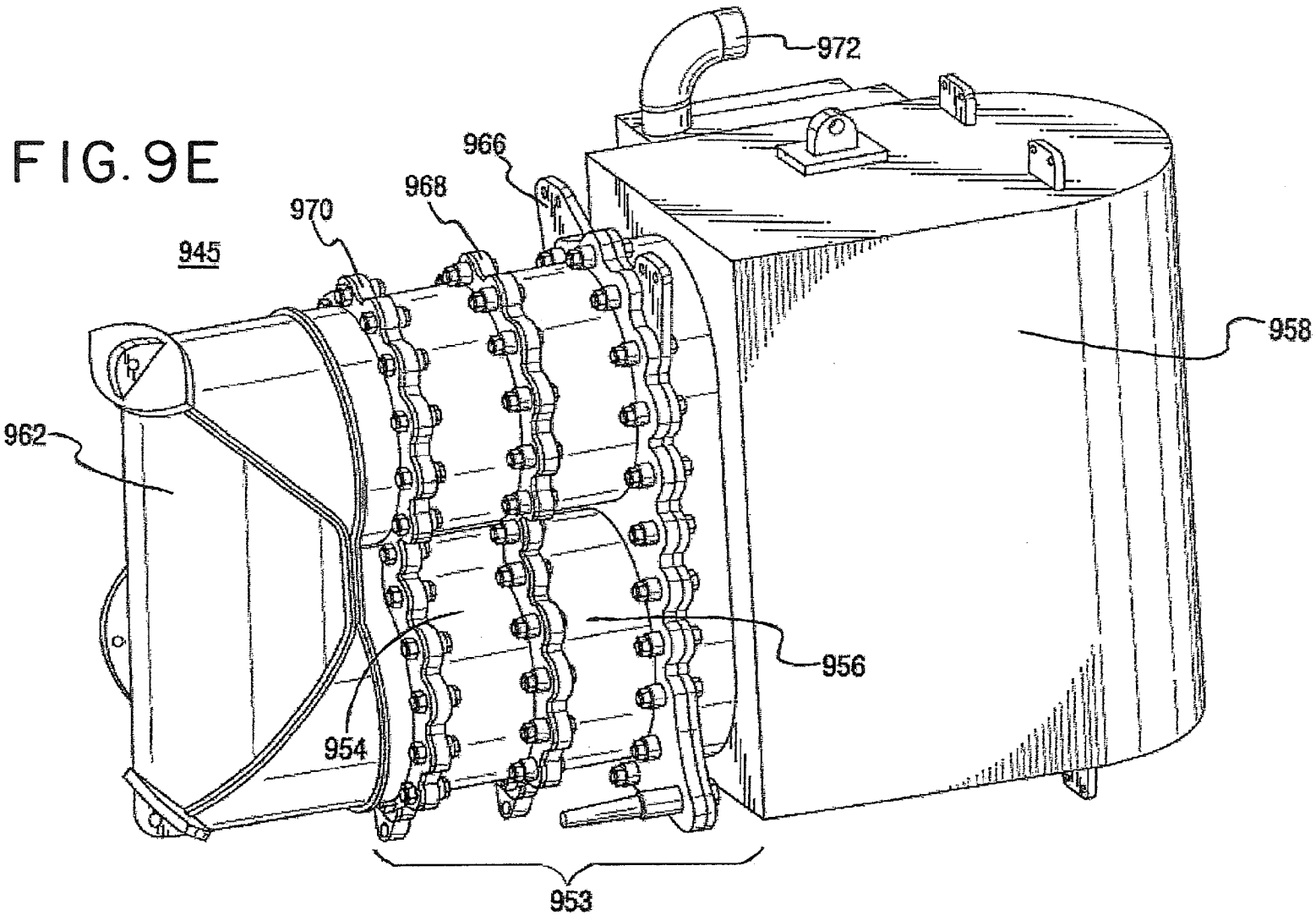
FIG. 9E is a perspective view of an embodiment of an EGR module for use with the EGR system of FIG. 9A.
Figure 9F:
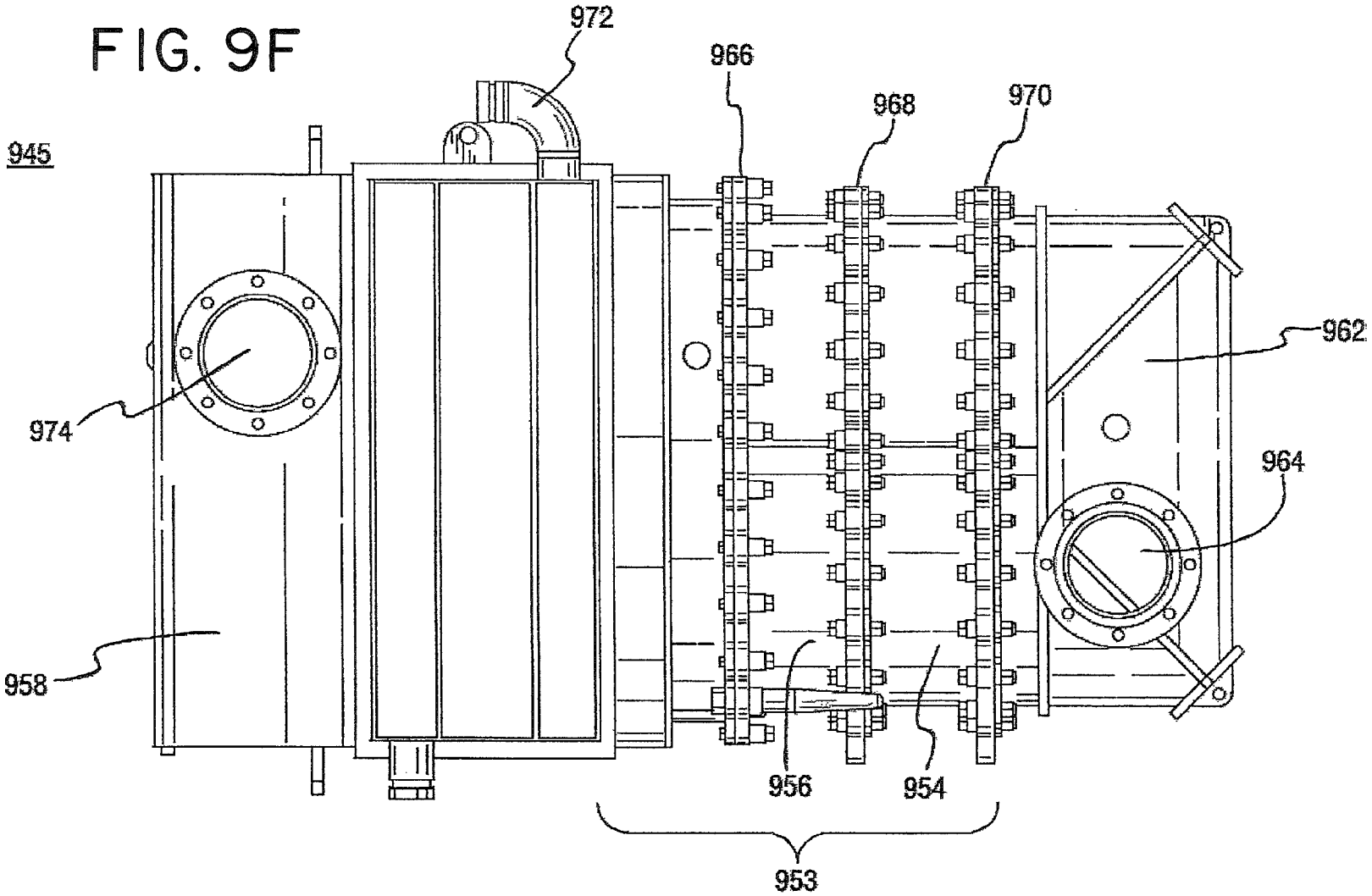
FIG. 9F is a side view of the EGR module of FIG. 9E.
Figure 9G:
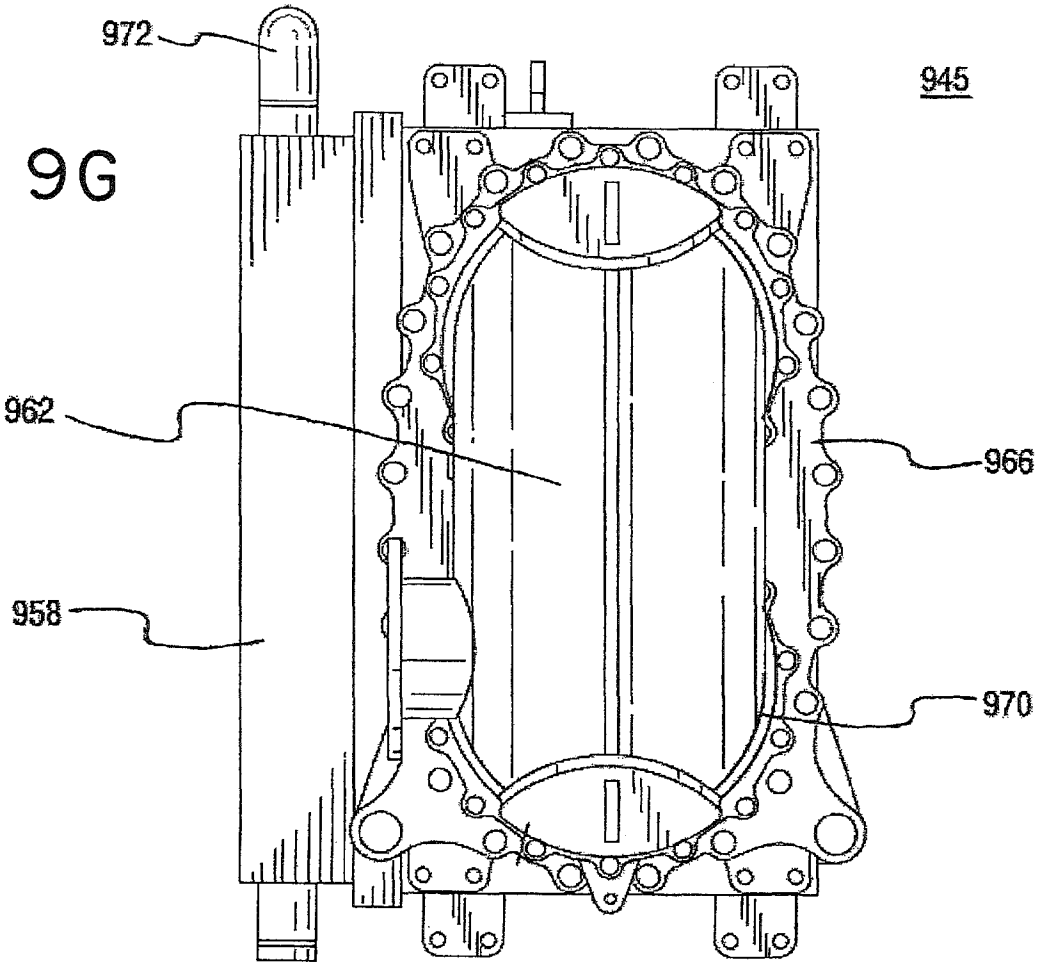
FIG. 9G is a front side view of the EGR module of FIG. 9E.
Figure 9H:
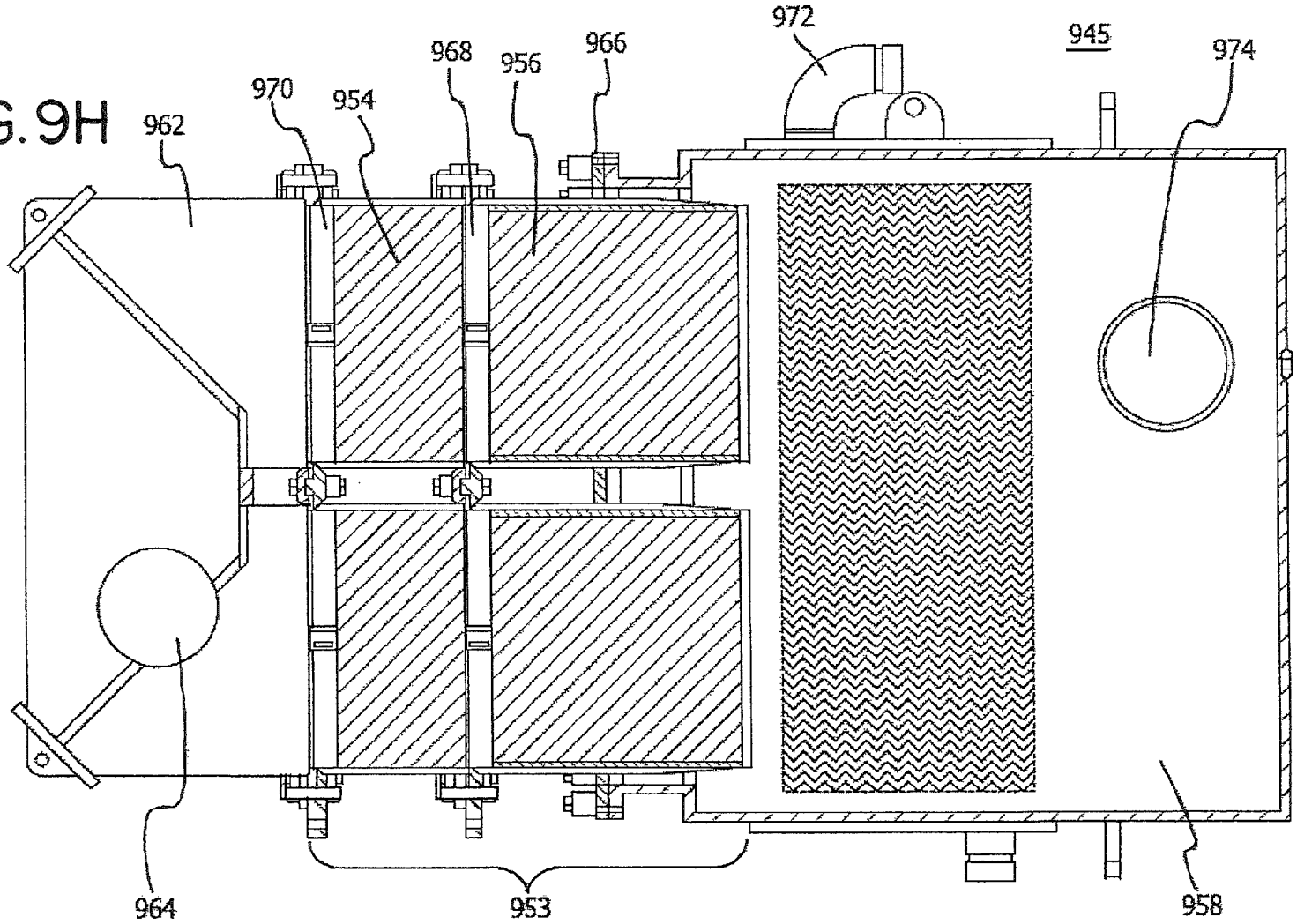
FIG. 9H is a cross sectional view of the EGR module of FIG. 9E.

In one embodiment of FIG. 8, a control system 880 monitors the temperature of the exhaust gas at the exhaust manifold using exhaust manifold temperature sensors 882*a*, 882*b*. If the exhaust gas temperature at the exhaust manifold 812 is within the normal operational temperature range of the EGR system, the control system signals the flow regulating device (e.g., valve 852*a* and 852*b* and/or positive flow device 860) to recirculate a select amount of exhaust gas through the engine. If the exhaust gas temperature falls outside of the normal operational temperature range of the EGR system, the control system 880 signals the flow regulating device (e.g., valve 852*a*, 852*b* and/or positive flow device 860) to recirculate another select amount of exhaust gas through the engine. It is preferable that if the exhaust gas temperature falls outside of the normal operational temperature range of the EGR system, the control system 880 signals the flow regulating device to lower the amount of exhaust to be recirculated through the engine. In one example, the normal operational temperature range of the EGR system is based in part on the operating temperature limits of the diesel engine. In another example, the normal operational temperature range of the EGR system is based in part on the temperatures at which the DPF 856*a*, 856*b* will passively regenerate. The control system may further be adapted to signal the flow regulating device to recirculate a select amount of exhaust gas through the engine system based in part on the operational condition of the diesel engine system within a tunnel. In one example, the normal operational temperature range of the EGR system is based in part on the operation of the locomotive in a tunnel.

In another embodiment, a control system 880 monitors the oxygen concentration in the airbox or, alternatively, the exhaust gas oxygen concentration at the exhaust manifold 812 using oxygen concentration sensors 884*a*, 884*b*. The control system 880 signals the flow regulating device (e.g., valve 852*a*, 852*b* and/or positive flow device 860) to recirculate a select amount of exhaust gas through the engine based on levels of oxygen concentration. In one example, if there is a high oxygen concentration, the control system 880 may be adapted to signal the flow regulating device to increase the amount of exhaust gas to be recirculated through the engine.

In yet another embodiment, a control system 880 monitors ambient temperature using an ambient temperature sensor 886. The control system 880 signals the flow regulating device (e.g., valve 852*a*, 852*b* and/or positive flow device 860) to recirculate a select amount of exhaust gas through the engine based on ambient temperature. In one example, if the ambient temperature is lower than a select temperature, the control system 880 may be adapted to signal the flow regulating device to increase the amount of exhaust gas to be recirculated through the engine to at least offset the higher levels of oxygen concentration in the recirculated exhaust gas at lower ambient temperatures.

In yet another embodiment, a control system 880 monitors ambient barometric pressure or altitude using an ambient barometric pressure sensor 888 or an altitude measurement device 890. The control system 880 signals the flow regulating device (e.g., valve 852*a*, 852*b* and/or positive flow device 860) to recirculate a select amount of exhaust gas through the engine based on ambient barometric pressure or altitude. In one example, if the barometric pressure is lower than a select value, the control system 880 may be adapted to signal the flow regulating device to decrease the amount of exhaust gas to be recirculated through the engine because there are lower levels of oxygen concentration in the recirculated exhaust gas at lower barometric pressures. Alternatively, if the altitude is lower than a select value, the control system 880 may be adapted to signal the flow regulating device to increase the amount of exhaust gas to be recirculated through the engine because there are higher levels of oxygen concentration in the recirculated exhaust gas at lower altitudes.

In another embodiment, a control system 880 determines and monitors the pressure differential across the DOC/DPF arrangement 854*a*, 856*a*, 854*b*, 856*b* using pressure sensors 892*a*, 892*b*, 894*a*, 894*b*. As discussed above, the DOC/DPF arrangement 854*a*, 856*a*, 854*b*, 856*b* may be adapted to passively regenerate and oxidize soot within the DPF 856*a*, 856*b*. However, the DPF 856*a*, 856*b* will accumulate ash and some soot, which must be removed in order to maintain the DPF efficiency. As ash and soot accumulates the pressure differential across the DOC/DPF arrangement 854*a*, 856*a*, 854*b*, 856*b* increases. Accordingly, the control system 880 monitors and determines whether the DOC/DPF arrangement 854*a*, 856*a*, 854*b*, 856*b* has reached a select pressure differential at which the DPF 856*a*, 856*b* requires cleaning or replacement. In response thereto, the control system 880 may signal an indication that the DPF 856*a*, 856*b* requires cleaning or replacement. Alternatively, the control system 880 may signal the flow regulating device to lower recirculation of exhaust gas through the engine. In another embodiment, a control system 880 is shown to be coupled to a DOC/DPF doser 896*a*, 896*b*, which adds fuel onto the catalyst for the DOC/DPF arrangement 854*a*, 856*a*, 854*b*, 856*b* for active regeneration of the filter. The fuel reacts with oxygen in the presence of the catalyst which increases the temperature of the recirculated exhaust gas to promote oxidation of soot on the filter. In another embodiment (not shown), the control system may be coupled to a heating device in the form of a burner, or other heating element for controlling the temperature of the recirculated exhaust gas to control oxidation of soot on the filter.

In yet another embodiment, a control system 880 measures the temperature of the exhaust gas downstream of the cooler 858 or the temperature of the coolant in the cooler 858. As shown in FIG. 8, temperature sensors 898*a*, 898*b* are provided for measuring exhaust gas temperature downstream of the cooler 858. If the exhaust gas temperature downstream of the cooler 858 or the coolant temperature is within a select temperature range, the control system 880 signals the flow regulating device (e.g., valve 852*a*, 852*b* and/or positive flow device 860) to recirculate a select amount of exhaust gas through the engine. If the exhaust gas temperature downstream of the cooler 858 or the coolant temperature falls outside of a select temperature range, the control system 880 signals the flow regulating device to recirculate another select amount of exhaust gas through the engine. In one example, the control system 880 may be adapted to monitor the coolant temperature to determine whether the conditions for condensation of the recirculated exhaust gas are present. If condensation forms, acid condensate may be introduced into the engine system. Accordingly, the control system 880 may be adapted to signal the flow regulating device to lower recirculation of exhaust gas through the engine until the conditions for condensation are no longer present.

In another embodiment, a control system 880 may be adapted to adaptively regulate flow based on the various discrete throttle positions of the locomotive in order to maximize fuel economy, reduce NOX emissions even further and maintain durability of the EGR system and engine components. For example, the control system 880 may signal the flow regulating device (e.g., valve 852*a*, 852*b* and/or positive flow device 860) to lower recirculation of exhaust gas through the engine at low idle, high idle, throttle position 1, throttle position 2 or upon application of dynamic brake. The control system 880 may be adapted to signal the flow regulating device to recirculate exhaust gas through the engine at or above throttle position 3. In one example, the control system 880 may be adapted to increase the amount of exhaust gas to be recirculated through the engine with an increase of throttle position. In yet another embodiment, the control system 880 may be adapted to increase the amount of exhaust gas to be recirculated with additional engine load. Likewise, the control system 880 may be adapted to decrease the amount of exhaust gas to be recirculated with a decreased engine load.

FIGS. 9A-H illustrate an embodiment of an EGR system 950 in accordance with the system outlined in FIG. 4 for use with a two-stroke, 12-cylinder diesel engine system 101 in a locomotive 103. The EGR system 950 is sized and shaped to fit within limited length, width, and height constraints of a locomotive 103. As shown herein, the EGR system 950 is installed within the same general framework of traditional modern diesel engine locomotives. Specifically, the EGR system 950 is generally located in the limited space available between the exhaust manifold 912 of a locomotive engine and the locomotive radiators 980. In this embodiment, the EGR system 950 is shown located generally above the general location of the equipment rack 982. Also, a 12-cylinder locomotive diesel engine may be used instead of a 16-cylinder locomotive diesel engine in order to provide for more space. In an alternative embodiment (not shown), the EGR system 950 may be housed in the locomotive body near the inertial filter.

Generally, the EGR system 950 includes a DOC, DPF and cooler, which are packaged in an integrated EGR module 945. The EGR system 950 further includes a positive flow device 960 interconnected with the EGR module 945. The EGR system 950 receives exhaust gases from the exhaust manifold 912 of the engine 906. A valve 952 is provided between the exhaust manifold 912 and the integrated EGR module 945. The EGR module 945 processes the exhaust gases therein. The positive flow device 960 compresses the processed exhaust gas to be recirculated and introduces such upstream of the aftercooler 920 by mixing the recirculated exhaust gases with the fresh charge air from the turbocharger 900, and delivers the mixture of fresh charge air and recirculated exhaust gas to the airbox 908, as fully discussed with respect to the embodiment of FIG. 4. In this system, only a select percentage of the exhaust gases is recirculated and mixed with the intake charge air in order to selectively reduce pollutant emissions (including $NO_X$) while achieving desired fuel efficiency. Although the EGR system 950 is an implementation of the system embodiment of FIG. 4, it may be adapted to be an implementation of any of the other previous EGR system embodiments discussed herein. For example, instead of introducing the recirculated exhaust gas upstream of the aftercooler, as described with respect to the embodiments of FIGS. 4 and 9, the recirculated exhaust gas may be introduced downstream of the aftercooler as discussed with respect to FIG. 3.

The integrated EGR module 945 includes a section 962 having an inlet 964 for receiving exhaust gases from the exhaust manifold 912. Specifically, the inlet section 962 of the EGR module 945 is interconnected with the exhaust manifold 912 of the engine 906. A valve 952 is provided between the exhaust manifold 912 and the inlet section 962 of the EGR module 945. In one example, the valve 952 is adaptable for determining the amount of exhaust gases to be recirculated through the engine 906. In another example, the valve 953 may act as an on/off valve for determining whether gases are to be recirculated through the engine 906.

Having received exhaust gas, the inlet section 962 of the EGR module 945 directs exhaust gases into a section which houses at least one diesel oxidation catalyst/diesel particulate filter (DOC/DPF) arrangement 953. Each DOC 954 uses an oxidation process to reduce the particulate matter, hydrocarbons and carbon monoxide emissions in the exhaust gases. Each DPF 956 includes a filter to reduce diesel particulate matter (PM) or soot from the exhaust gases. Oxidation and filtration is specifically used in this embodiment to reduce the particulate matter that will be introduced into engine 906 during recirculation. The introduction of particulates into the engine 906 causes accelerated wear especially in uniflow two-stroke diesel engine applications. Oxidation and filtration may also be used to prevent fouling and wear of other EGR system components (e.g., cooler 958 and positive flow device 960) or engine system components.

The DOC/DPF arrangement 953 is designed, sized and shaped such that they effectively reduce particulate matter under the operating parameters of the EGR system 950, fit within the limited size constraints of the locomotive 103, have a reasonable pressure drop across their substrates, and have a manageable service interval.

It is desirable that the DOC/DPF arrangement 953 reduces the PM in the exhaust gas by over 90% under the operating parameters of the EGR system 950. Specifically, the composition of the substrates and coatings thereon are chosen of the DOC/DPF arrangement 953 to efficiently reduce particulate matter. In one example of a 12-cylinder uniflow scavenged two-stroke diesel engine at about 3200 bhp with less than 20% exhaust gas being recirculated at full load, the DOC/DPF arrangement 953 is selected to manage and operate a mass flow of exhaust gas of from about 1.5 to about 2.5 lbm/s, having an intake temperature ranging from about 600° F. to about 1050° F., and an intake pressure of about 80 in Hga to about 110 in Hga. It is further preferable that the DOC/DPF arrangement 953 can handle a volumetric flow rate across both the DOC/DPF from about 1000 CFM to about 1300 CFM. Furthermore, the DOC/DPF arrangement 953 is further designed to endure an ambient temperature range of about −40° C. to about 125° C.

The DOC/DPF arrangement 953 is generally packaged such that it fits within the size constraints of the locomotive 103. As shown in this embodiment, each DOC 954 and DPF 956 is packaged in a cylindrical housing similar to those commonly used in the trucking industry. Each DOC 954 and DPF 956 has a diameter of about 12 inches. The length of each DOC 954 is about 6 inches, whereas the length of each DPF 956 is about 13 inches. The DOC 954 and DPF 946 are integrated within the EGR module 945 such that they are able to fit within the size constraints of the locomotive.

It is further desirable that the DOC/DPF arrangement 953 is selected to have a reasonable pressure drop across their substrates. As discussed above, it is preferable that the exhaust gas is introduced into a region of higher pressure. Accordingly, it is desirable to minimize the pressure drop across the DOC/DPF arrangement 953. In one embodiment, it is desirable for the pressure drop across both substrates to be less than about 20 in$H_2O$.

Finally, it is desirable that the DOC/DPF arrangement 953 has a manageable service life. The DOC/DPF arrangement 953 accumulates ash and some soot, which is preferably discarded in order to maintain the efficiency of the DOC 954 and the DPF 956. In one example, the service interval for cleaning of the DOC/DPF arrangement 953 may be selected at about 6 months. As shown in the embodiments, each DOC 954 and DPF 956 is housed in separate but adjoining sections of the EGR module 945 such that they are removable for cleaning and replacement. For maintenance, the DOC/DPF arrangement 953 includes a flange 966 for mounting the DOC/DPF arrangement 953 together with the inlet section 962 of the EGR module 945 to the cooler 958. The fasteners associated with the mounting flange 966 of the DOC/DPF arrangement 953 may be removed such that the DOC/DPF arrangement 953 together with the inlet section 962 of the EGR module 945 may be removed from the cooler 958 and the locomotive. Thereafter, the inlet section 962, the DOC 954, and the DPF 956 may be selectively disassembled for service via flanges 968, 970. In order to facilitate serviceability, the fasteners for flanges 968, 970 are offset from the DOC/DPF arrangement 953 mounting flange 966. Accordingly, the DOC/DPF arrangement 953 together with the inlet section 962 may be removed via its mounting flange 966 without first disassembling each individual section.

In order to meet the operational and maintainability requirements of the EGR system 950, a plurality of DOCs and DPFs are paired in parallel paths. For example, as shown, two DOC/DPC arrangement pairs are shown in parallel in this embodiment in order to accommodate the flow and pressure drop requirements of the EGR system 950. Moreover, the DOC/DPF arrangement pairs in parallel provide for reasonable room for accumulation of ash and soot therein. Nevertheless, more or less DOC/DPF arrangement pairs may be placed in a similar parallel arrangement in order to meet the operational and maintainability requirements of the EGR system 950.

The integrated EGR module 945 further includes a cooler 958 interconnected to the DOC/DPF arrangement 953. The cooler 958 decreases the filtered exhaust gas temperature, thereby providing a denser intake charge to the engine 906. In one example of a cooler 958 for a 12-cylinder uniflow scavenged two-stroke diesel engine at about 3200 bhp with less than 20% exhaust gas being recirculated at full load, each DPF 956 extends into the cooler 958 and provides filtered exhaust gas at a mass flow of about 1.5 lbm/s to about 2.5 lbm/s; a pressure of about 82 inHga to about 110 inHga; and a density of about 0.075 $lbm/ft^3$ to about 0.15 $lbm/ft^3$. It is desirable that the cooler 958 reduces the temperature of the filtered exhaust gas from a range of about 600° F.-1250° F. to a range of about 200° F.-250° F. at an inlet volumetric flow rate of about 1050 CFM to about 1300 CFM. The source of the coolant for the cooler 958 may be the water jacket loop of the engine, having a coolant flow rate of about 160 gpm to about 190 gpm via coolant inlet 972. It is further desirable that the cooler 958 maintains a reasonable pressure drop therein. As discussed above, the exhaust gas is introduced into a region of higher pressure. Accordingly, it is desirable to minimize the pressure drop within the cooler 958. In one embodiment, it is desirable for the pressure drop across the cooler to be from about 3 $inH_2O$ to about 6 $inH_2O$.

The cooler 958 is generally packaged such that it fits within the size constraints of the locomotive 103. As shown in this embodiment, the cooler 958 is integrated with the DOC/DPF arrangement 953. The cooler 958 has a frontal area of about 25 inches by 16 inches, and a depth of about 16 inches.

The EGR module 945 is connected to a positive flow device 960 via the outlet 974 from the cooler 958. The positive flow device 960 regulates the amount of cooled, filtered exhaust gas to be recirculated and introduced into the engine 906 at the aftercooler 920 upstream of its core via ducts 976. Specifically, the positive flow device 960 is illustrated as a variable speed roots style blower, which regulates the recirculation flow rate by adapting the circulation speed of the device through its inverter drive system. Specifically, by varying the speed of the positive flow device 960, a varying amount of exhaust gas may be recirculated. Other suitable positive flow devices may be implemented in order to similarly regulate the amount of exhaust gases to be recirculated.

Figure 10:
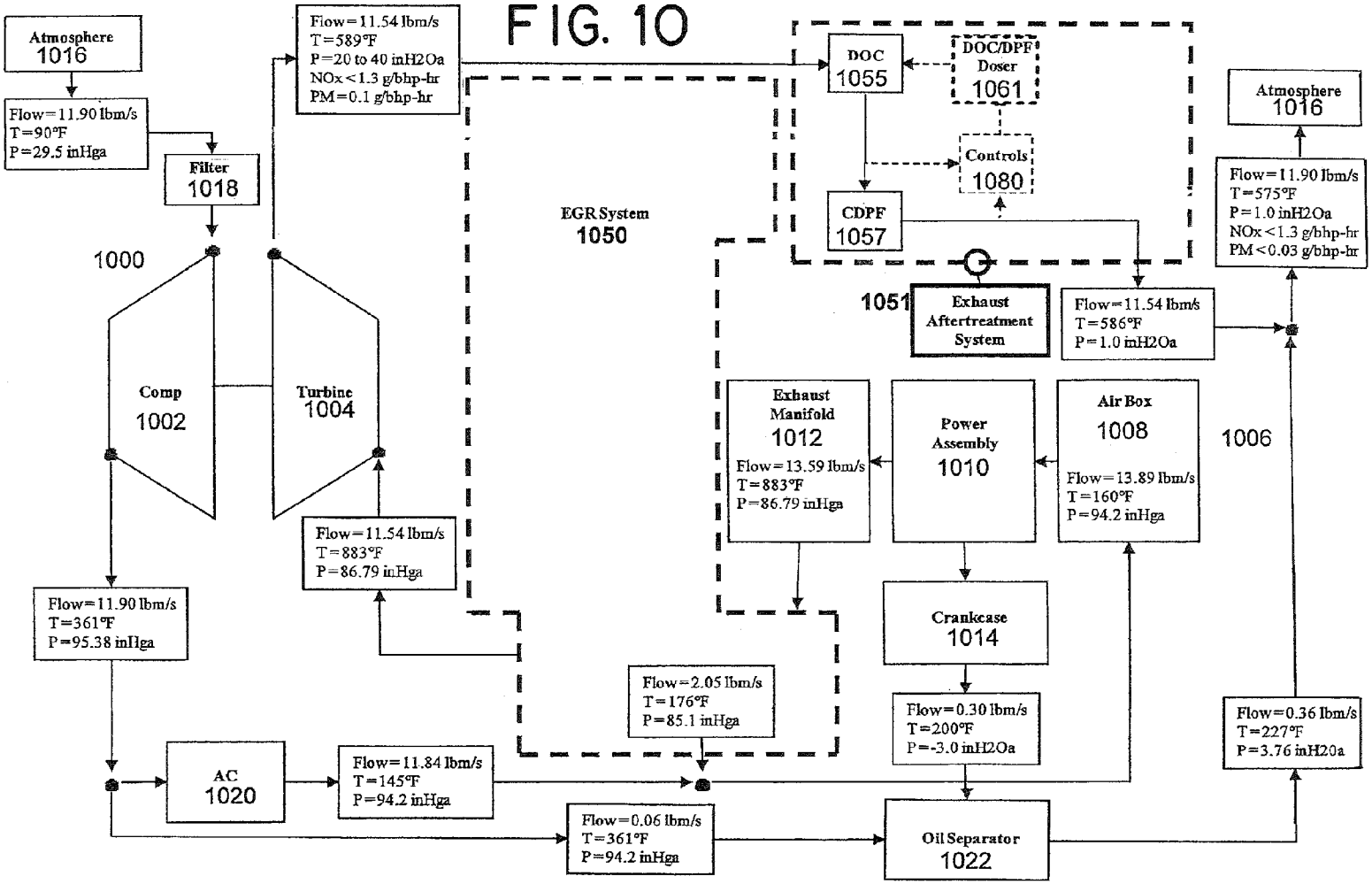
FIG. 10 is a system diagram of a two-stroke diesel engine having an exhaust aftertreatment system and an EGR system.

As shown in FIG. 10, an exhaust aftertreatment system 1051 similar to that shown and described with respect to FIG. 2*a* may be used in conjunction with an EGR system to reduce exhaust emissions. The EGR system 1050 may be similar to those shown and described with respect to any of FIGS. 3-9. Specifically, the exhaust aftertreatment system 1051 may be adapted to reduce particulate matter (PM), hydrocarbons and/or carbon monoxide emissions. In this particular arrangement, the exhaust aftertreatment system 1051 further includes a generally includes a filtration system 1055/1057 similar to that shown and described with respect to FIG. 2*a*. More specifically, the exhaust aftertreatment system 1051 includes a diesel oxidation catalyst (DOC) 1055, a diesel particulate filter (DPF) 1057, a control system (for filtration monitoring and/or control) 1080 and DOC/DPF doser 1061 similar to that shown and described with respect to FIG. 2*a*.

Figure 11:
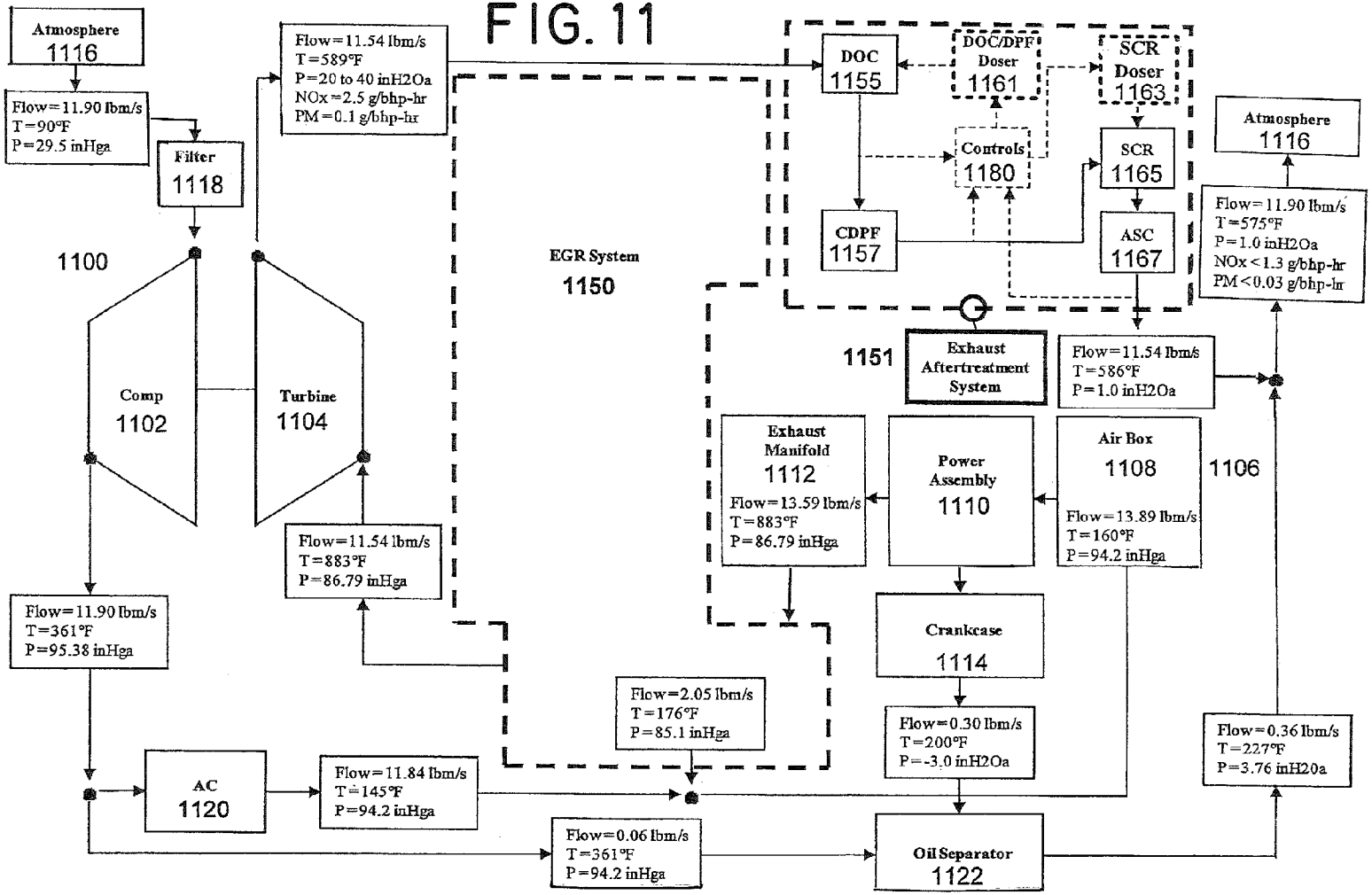
FIG. 11 is a system diagram of a two-stroke diesel engine having an EGR system and an exhaust aftertreatment system including a selective catalytic reduction catalyst and ammonia slip catalyst.

As shown in FIG. 11, an exhaust aftertreatment system 1151 similar to that shown and described with respect to FIG. 2B may be used in conjunction with an EGR system to reduce exhaust emissions. The EGR system 1150 may be similar to those shown and described with respect to any of FIGS. 3-9. Specifically, the exhaust aftertreatment system 1151 may be adapted to reduce $NO_X$ in addition to particulate matter (PM), hydrocarbons and/or carbon monoxide emissions. In this particular arrangement, the exhaust aftertreatment system 1151 generally includes a filtration system and SCR system similar to that shown and described with respect to FIG. 2B. More specifically, the exhaust aftertreatment system 1151 includes a diesel oxidation catalyst (DOC) 1155, a diesel particulate filter (DPF) 1157, a control system (for filtration and SCR monitoring and/or control) 1180 and DOC/DPF doser 1161 similar to that shown and described with respect to FIG. 2A. Additionally, the exhaust aftertreatment system 1151 of FIG. 11 further includes a selective catalytic reduction (SCR) catalyst 1165, ammonia slip catalyst (ASC) 1167, and an SCR doser 1163 adapted to lower $NO_X$ emissions of the engine 1106.

Figure 12A:
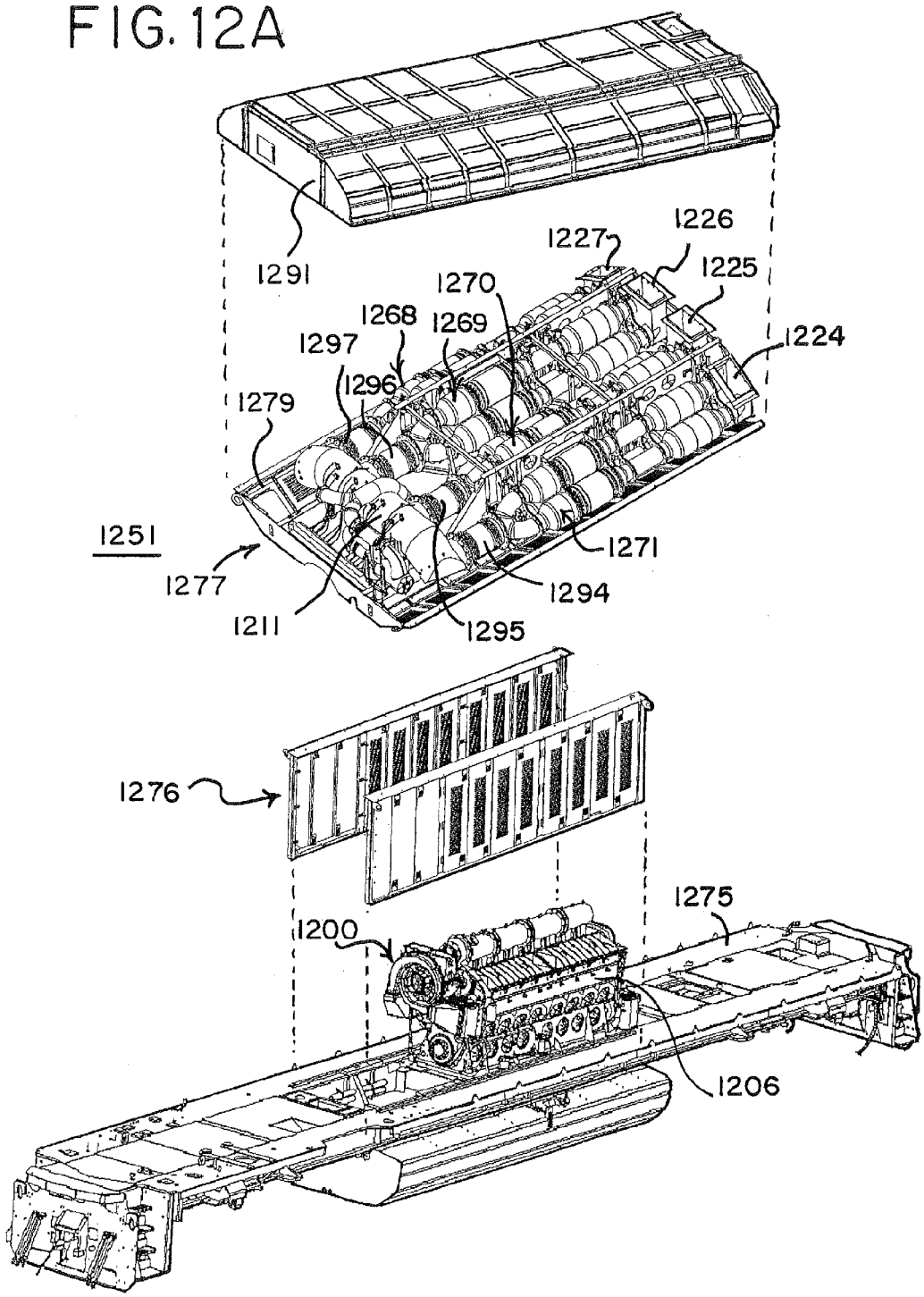
FIG. 12A is an exploded perspective view of an embodiment of an exhaust aftertreatment system in accordance with the present system.
Figure 12B:
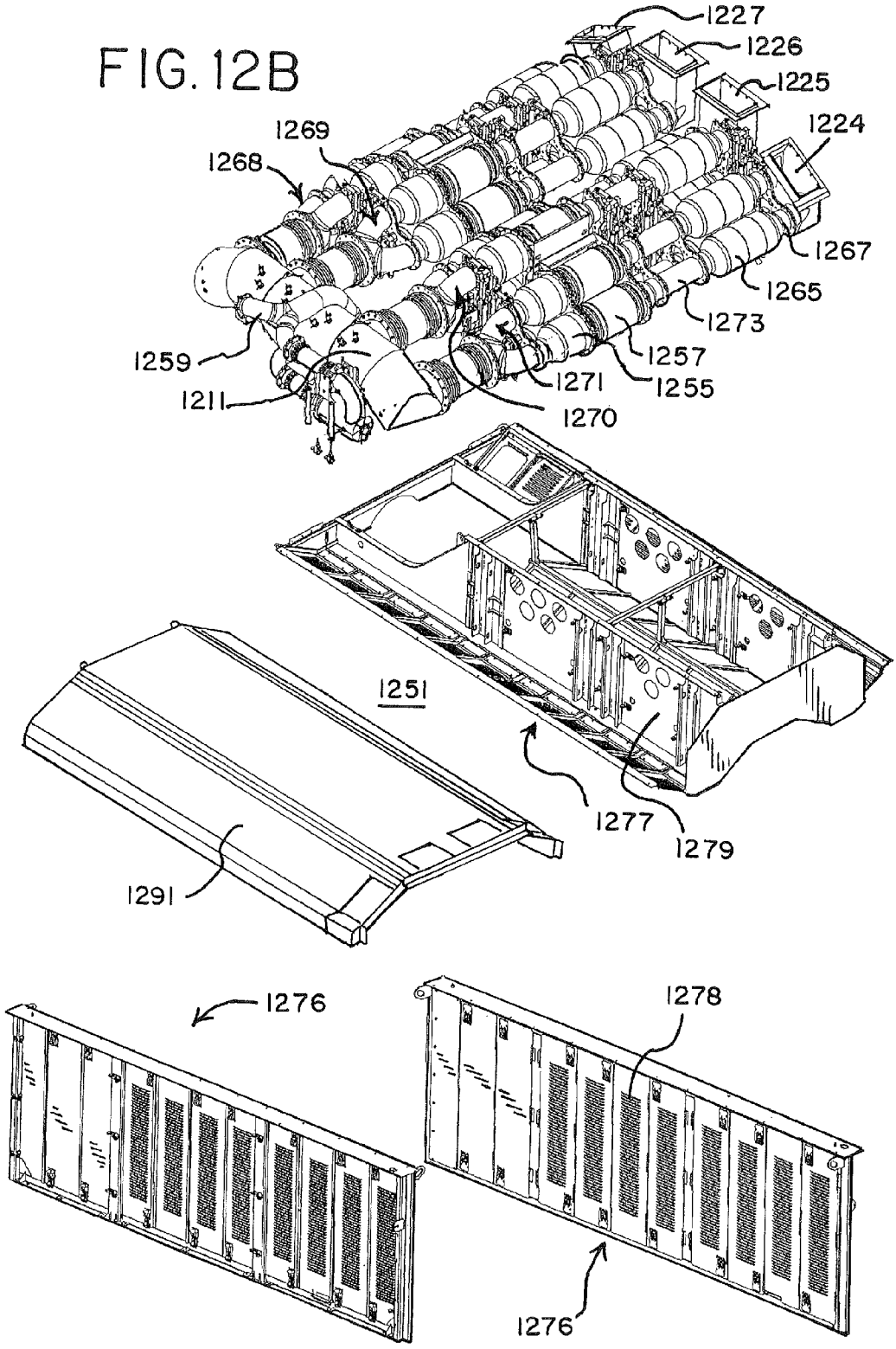
FIG. 12B is another perspective view of the embodiment of the exhaust aftertreatment system of FIG. 12A.
Figure 12C:
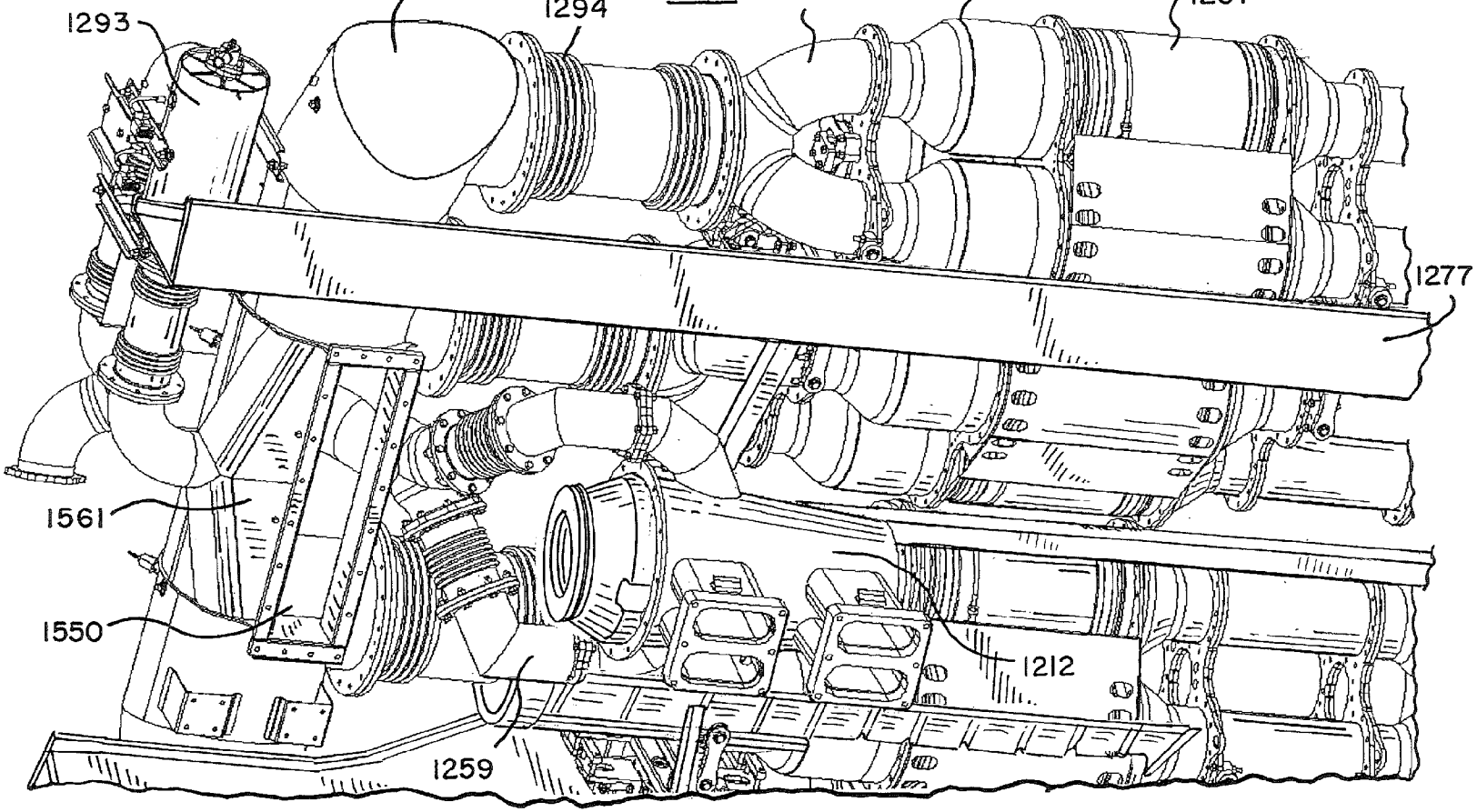
FIG. 12C is a partial bottom perspective view of the embodiment of the exhaust aftertreatment system of FIG. 12A.
Figure 12D:
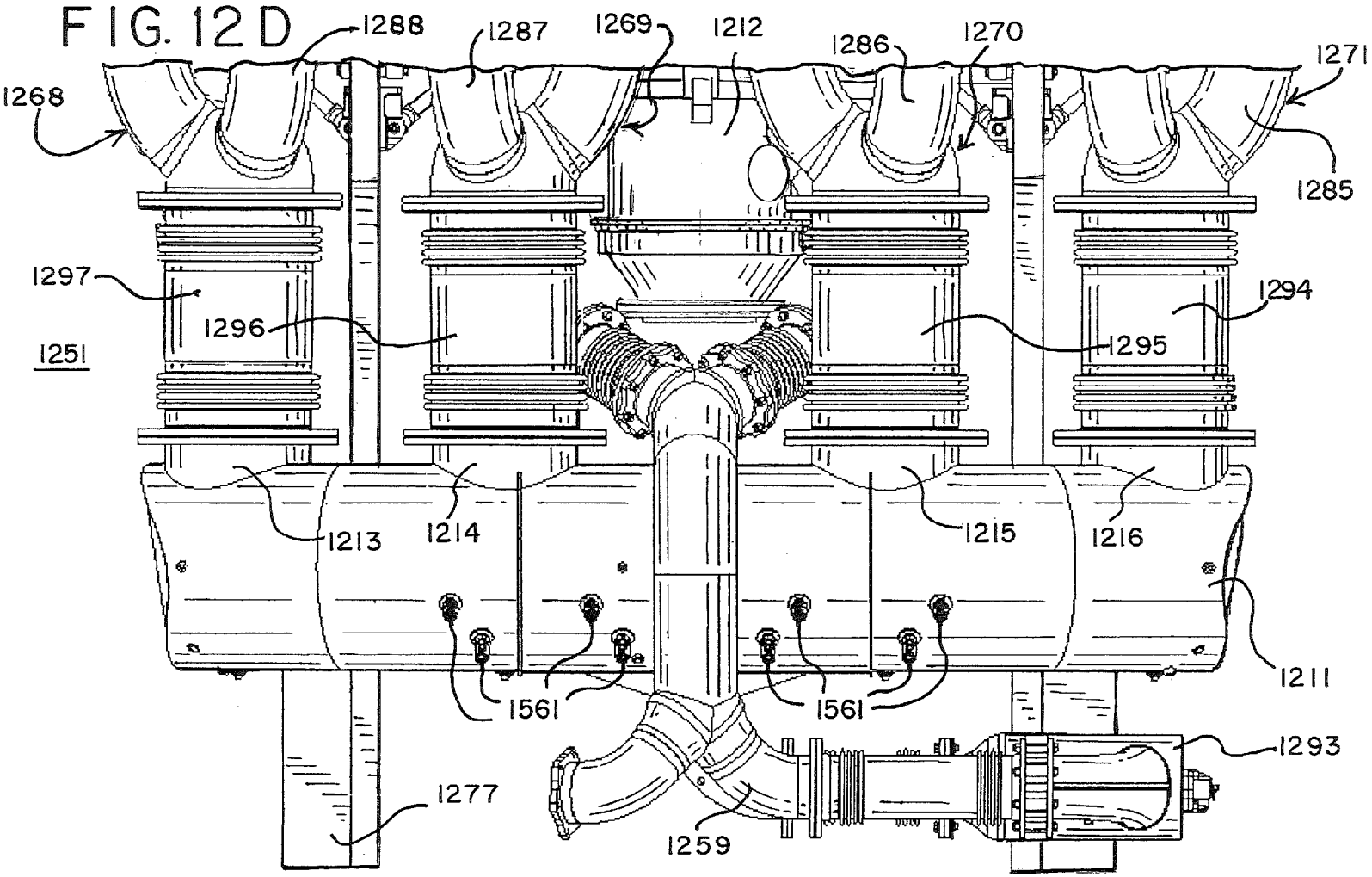
FIG. 12D is a partial top view of the embodiment of the exhaust aftertreatment system of FIG. 12A.
Figure 12E:
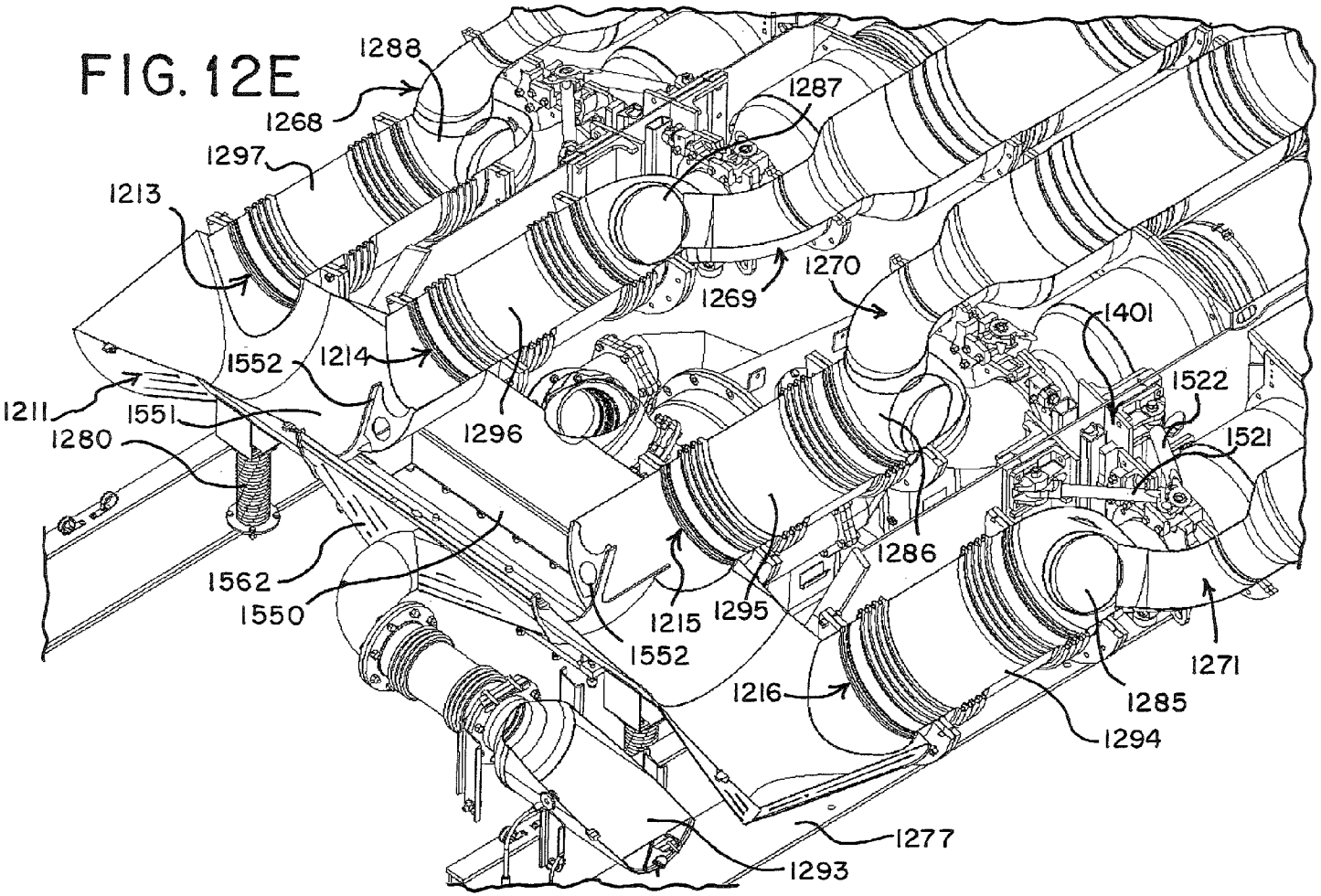
FIG. 12E is a partial top perspective view of the embodiment of the exhaust aftertreatment system of FIG. 12A.
Figure 12F:
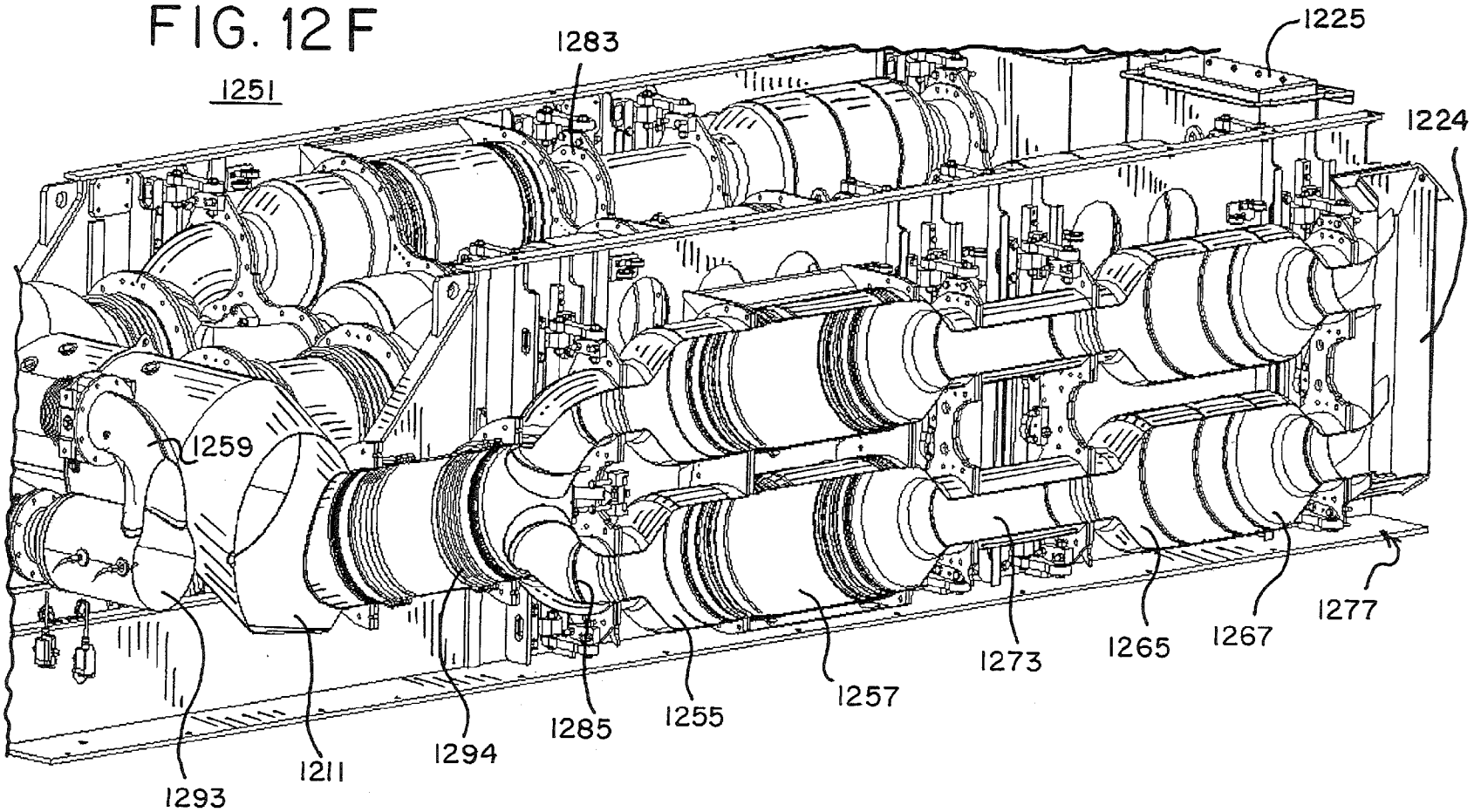
FIG. 12F is a partial side perspective view of the embodiment of the exhaust aftertreatment system of FIG. 12A, showing a partial cross-section view of the components of the aftertreatment system.
Figure 12G:
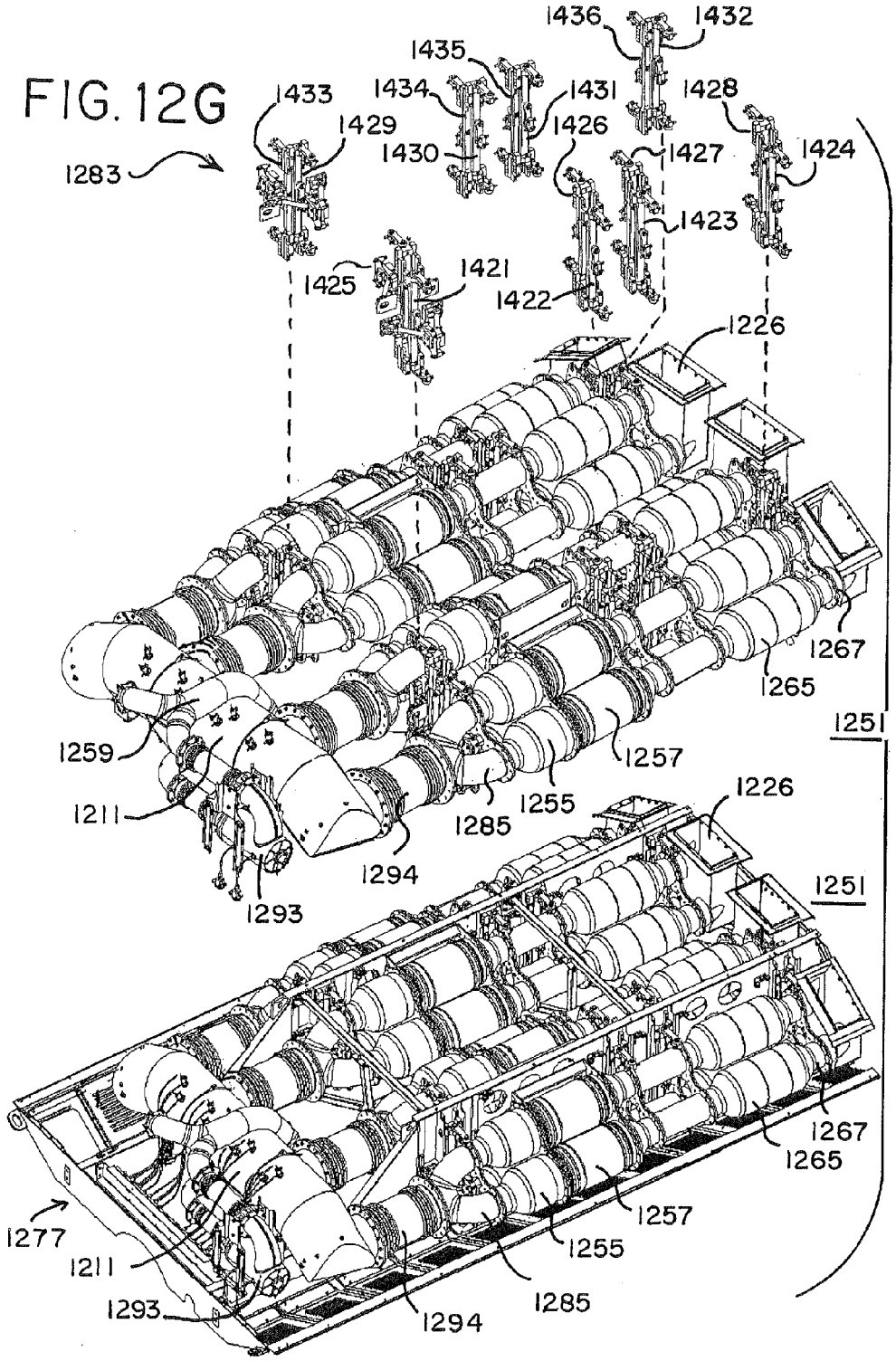
FIG. 12G is an exploded perspective view of an embodiment of the exhaust aftertreatment system of FIG. 12A including the primary and secondary support structure for the aftertreatment system.
Figure 12H:
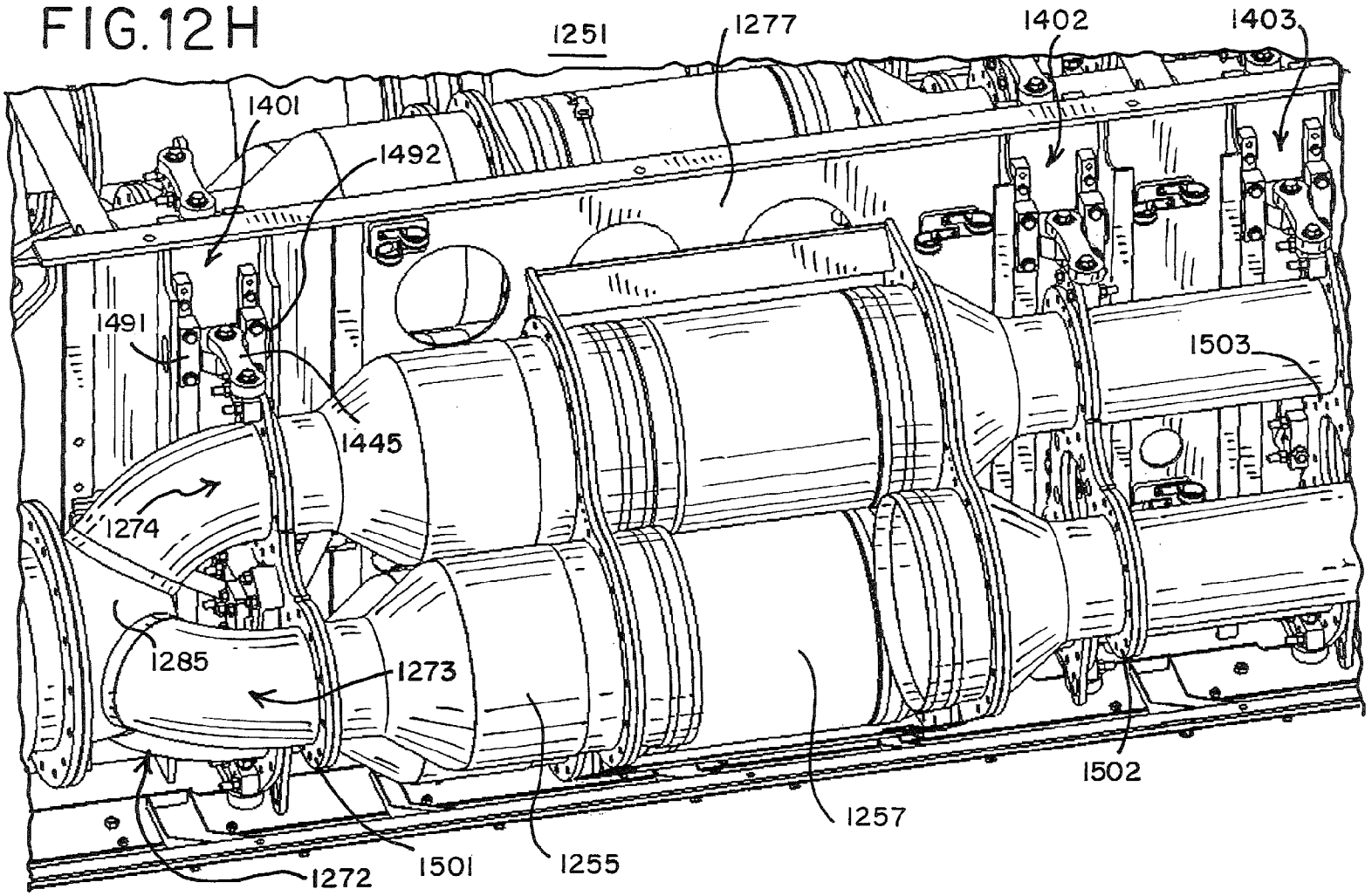
FIG. 12H is a detailed side view of the embodiment of the exhaust aftertreatment system of FIG. 12A including the primary and secondary support structure for the aftertreatment system.
Figure 121:
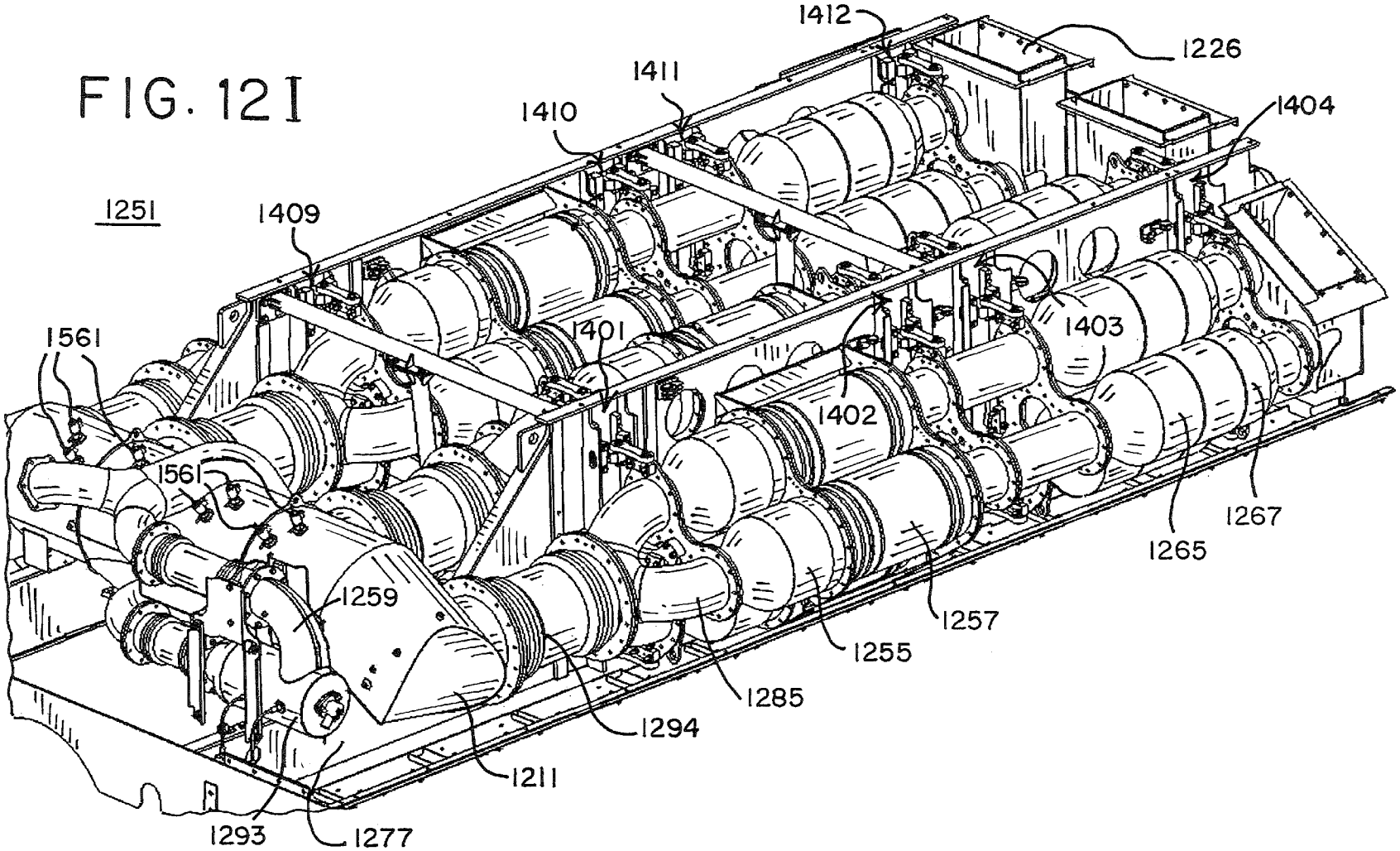
Figure 12J:
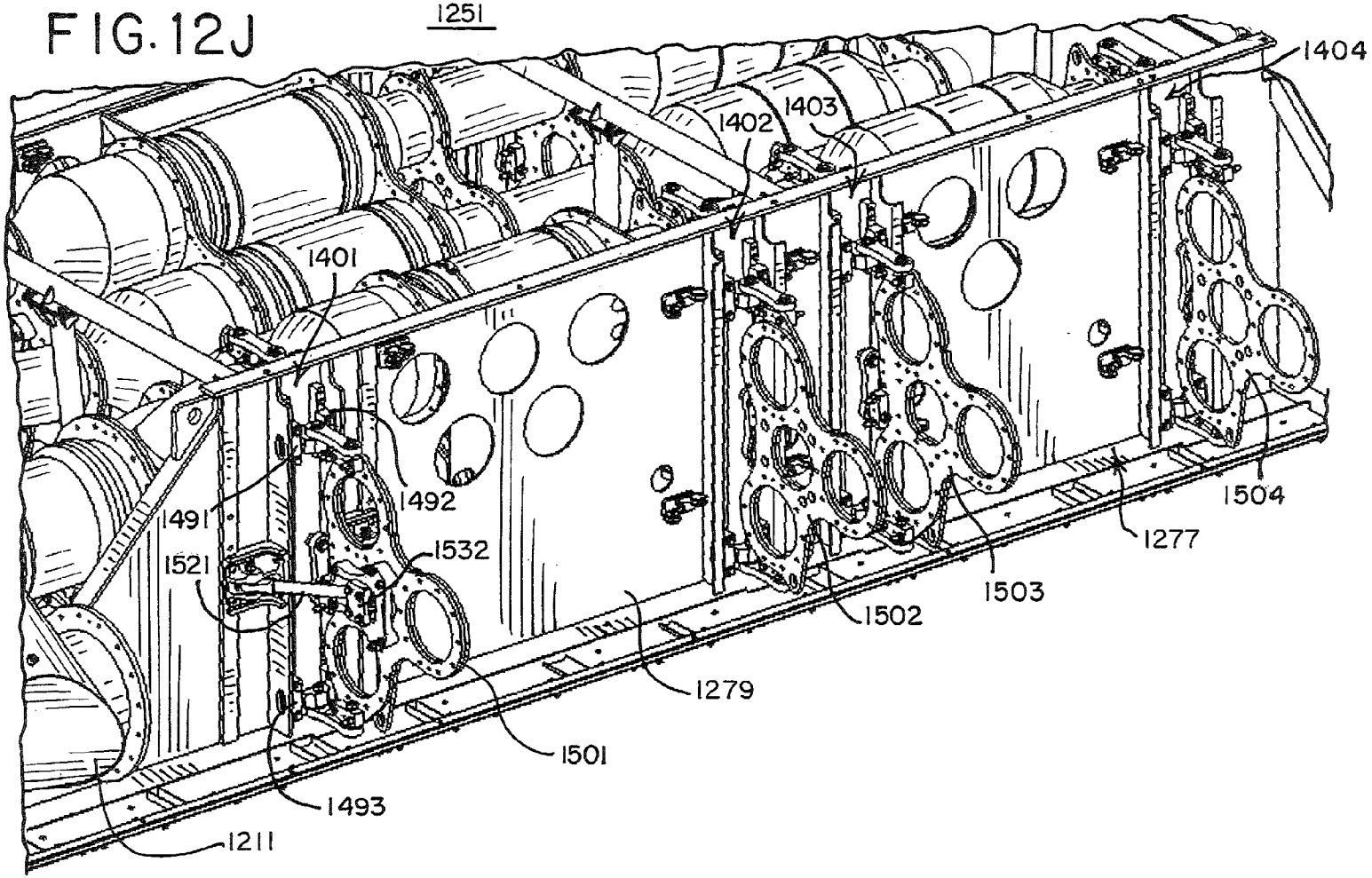
FIG. 12J is a side perspective view of the embodiment of the exhaust aftertreatment system of FIG. 12A including the primary and secondary support structure for the aftertreatment system.
Figure 12K:
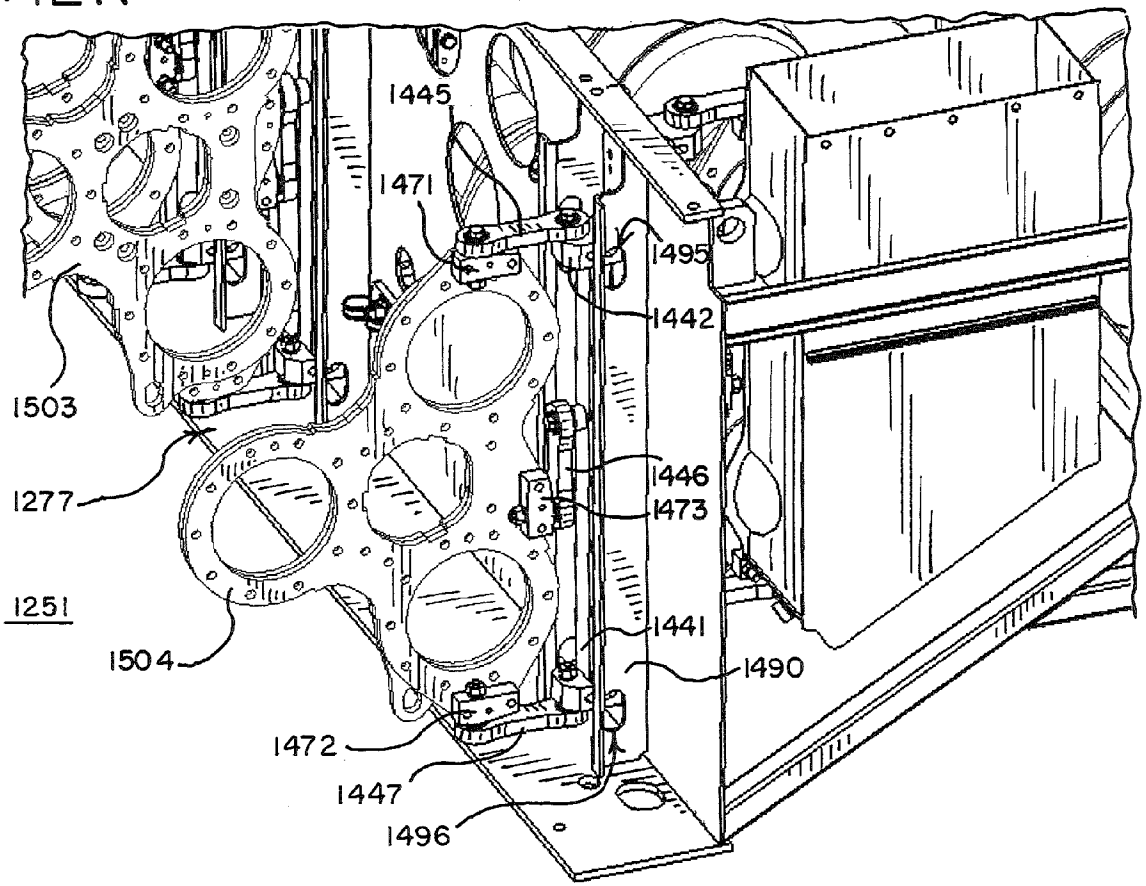
FIG. 12K is a detailed perspective view of parts of the primary and secondary support structure for the aftertreatment system of FIG. 12J.
Figure 12L:
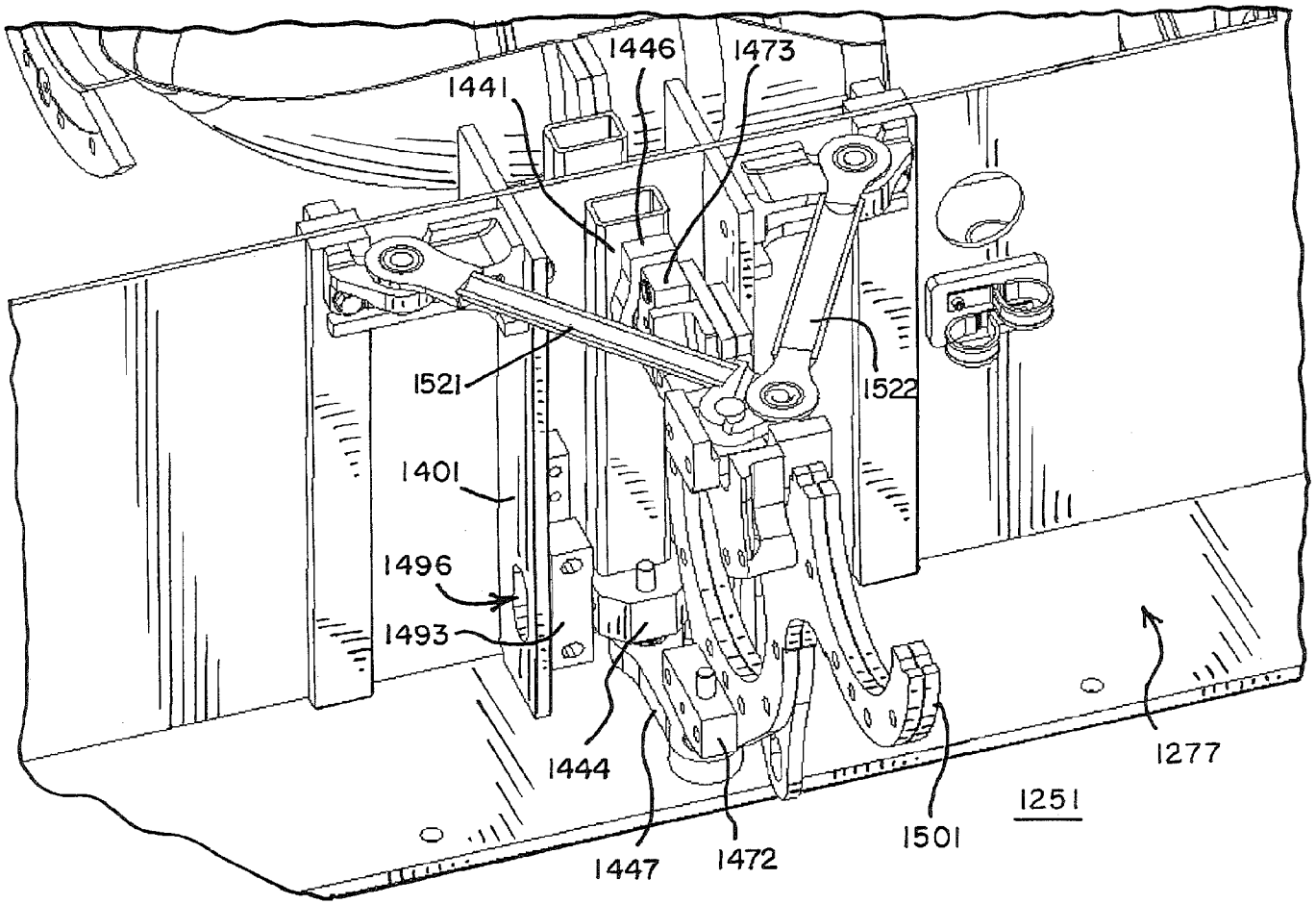
FIG. 12L is another detailed perspective view of parts of the primary and secondary support structure for the aftertreatment system of FIG. 12J.
Figure 12M:
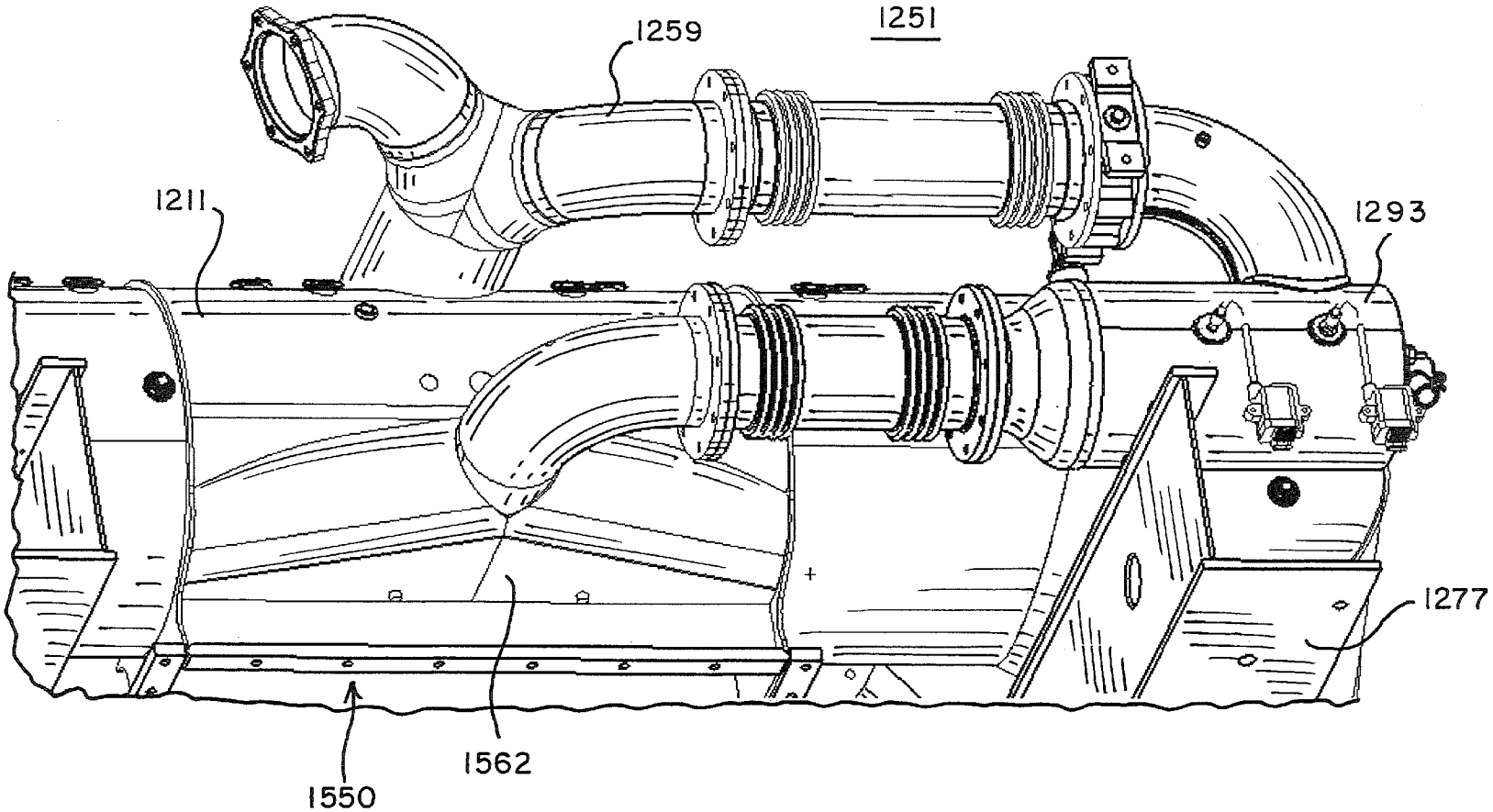
FIG. 12M is a detailed partial perspective view of the embodiment of the exhaust aftertreatment system of FIG. 12A showing a heating device.
Figure 12N:
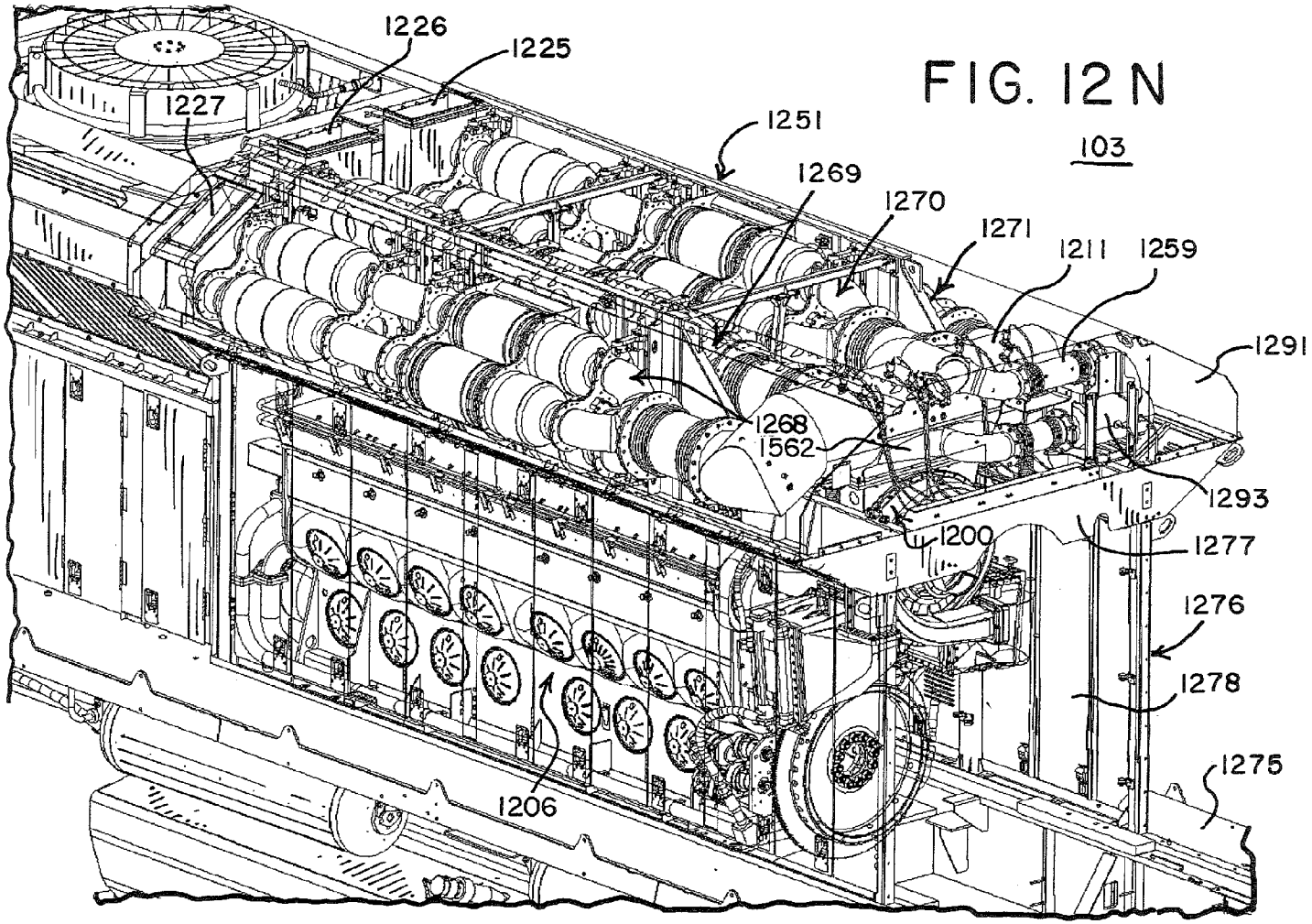
FIG. 12N is a partial cross-sectional perspective view of a locomotive including the exhaust aftertreatment system of FIG. 12A.
Figure 120:
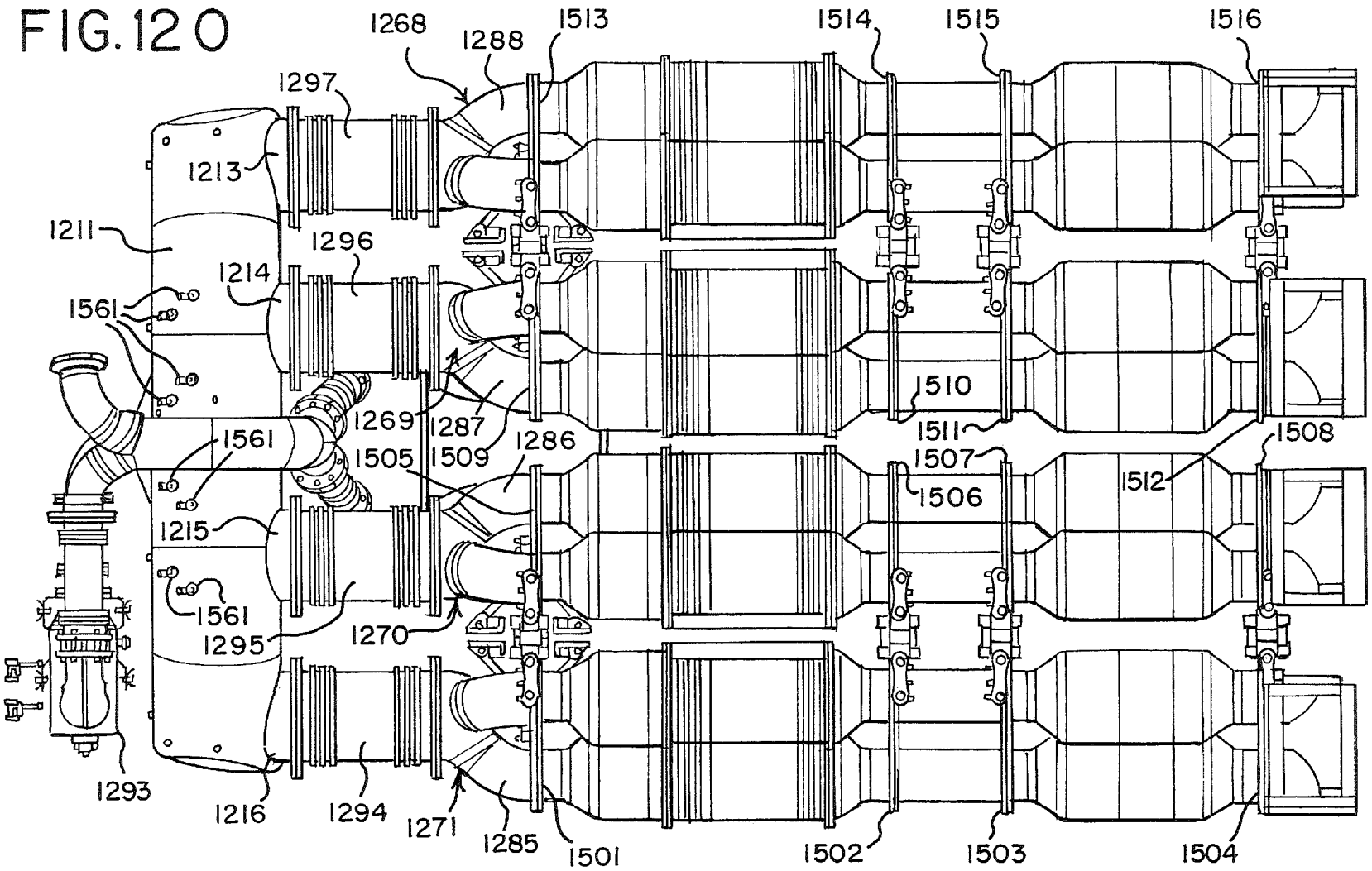

FIGS. 12A-12N illustrate an embodiment of an exhaust aftertreatment system 1251 in accordance with the system outlined in FIG. 2B and FIG. 11 for use with a locomotive 103. The exhaust aftertreatment system 1251 is adapted to reduce $NO_X$ in addition to particulate matter (PM), hydrocarbons and/or carbon monoxide emissions. In this particular arrangement, the exhaust aftertreatment system 1251 generally includes a plurality of inline filtration systems 1255/1257, each being situated inline with a $NO_X$ reduction system 1265/1267.

The exhaust aftertreatment system 1251 includes a turbocharger mixing manifold 1211 for receiving exhaust gas expelled from the engine 1206 and, specifically, the turbocharger 1200.

Multiple discrete aftertreatment line assemblies 1268-1271 are provided in order to accommodate and treat the exhaust gas from the engine 1206. Specifically, the exhaust gas from the engine 1206 is separated based on specific operating parameters of each of the inline filtration systems 1255/1257 and $NO_X$ reduction systems 1265/1267. As shown herein, and further explained below, the turbocharger mixing manifold 1211 separates and guides the exhaust gas into a plurality of discrete exhaust aftertreatment line assemblies 1268-1271 to promote uniform distribution of exhaust gas into the subsequent inline filtration system 1255/1257 and $NO_X$ reduction system 1265/1267 of the exhaust aftertreatment system 1251. The arrangement of discrete aftertreatment line assemblies 1268-1271 further promotes thermal isolation and distribution of mass loading of the exhaust aftertreatment system 1251.

The exhaust gas in each of the exhaust aftertreatment line assemblies 1271 is then further distributed into a plurality of discrete exhaust gas lines 1272-1274 via line assembly distribution manifolds 1285-1288. Each of the discrete exhaust gas lines 1272-1274 comprises an inline filtration system 1255/1257 and a $NO_X$ reduction system 1265/1267.

Each inline filtration system 1255/1257 includes a DOC/DPF arrangement to reduce particulate matter (PM), hydrocarbons and/or carbon monoxide emissions exhaust gas. As shown herein, and specifically illustrated in FIG. 12*i*, the housing section associated with the DPF 1257 facilitates the removal of the DPF 1257 filters for cleaning and maintainability. Thereafter, the filtered exhaust gas is then mixed with an SCR reductant fluid or SCR reagent (e.g., urea-based, diesel exhaust fluid, ammonia or hydrocarbon) in a line leading to a $NO_X$ reduction system 1265/1267. For example, the SCR reductant fluid or SCR reagent may be introduced by an SCR doser upstream of the SCR 1265. The SCR reductant fluid or SCR reagent is preferably introduced to each of the exhaust aftertreatment line assemblies 1268-1271 using a common rail or single line system. The operation of the SCR doser may be controlled by a control system as described with respect to the embodiment described in FIG. 2*b*. Upon injection of the SCR reductant fluid or SCR reagent, the $NO_X$ from the filtered exhaust reacts with the SCR reductant fluid or SCR reagent over the catalyst in the SCR 1265 and ASC 1267 to form nitrogen and water. Although a urea-based SCR 1265 is shown, other SCR's known in the art may also be used (e.g., hydrocarbon based SCR's, De-$NO_X$ systems, etc.). The exhaust is then released into the atmosphere via a plurality of exhaust stacks 1224-1227.

The exhaust aftertreatment system 1251 is sized and shaped to fit within limited length, width, and height constraints of a locomotive 103. As shown herein, the exhaust aftertreatment system 1251 is installed within the same general framework of traditional modern diesel engine locomotives. In the embodiment shown (see e.g., FIGS. 12A, 12B and 12O), the exhaust aftertreatment system 1251 is generally located in the limited space available above the locomotive engine 1206 and within the width of the locomotive body frame 1275. In addition, a hood 1291 is provided having a ventilation system for releasing heat created by the exhaust aftertreatment system 1251.

The Aftertreatment Support System ("ATSS")

Referring now to FIG. 12A, the exhaust aftertreatment system 1251 is constructed to withstand the various operational mass load forces and temperature environments of the locomotive 103. Specifically, the exhaust aftertreatment system 1251 is connected to the engine 1206, and specifically the turbocharger 1200, to receive exhaust gas therefrom. However, the engine 1206 cannot support the mass load of the exhaust aftertreatment system 1251. Therefore, it is an object of the present disclosure to provide a support system, (i.e., the aftertreatment support system ("ATSS")) that is capable of supporting the mass load of the exhaust aftertreatment system 1251. The support system generally achieves such by directing the mass load to the locomotive frame 1275, rather than the engine 1206. At the same time, as illustrated in FIGS. 12I-12L and 12V, it is preferable that the ATSS isolate the operational loads associated with the engine 1206 from the operational loads associated with the locomotive frame 1275 (e.g. loads associated with the coupling of adjacent rail cars). Moreover, it is preferable that the ATSS allows for thermal expansion of certain components of the exhaust aftertreatment system 1251.

In one embodiment of the ATSS, the ATSS is adapted to mount the exhaust aftertreatment system 1251 to the locomotive body frame 1275. The disclosed ATSS comprises a primary support structure and a secondary support structure. The primary support structure carries the physical mass load of the components of the exhaust aftertreatment system 1251, including and beginning with the turbocharger mixing manifold 1211 and ending at the exhaust stacks 1224-1227. The secondary support structure supports the discrete exhaust aftertreatment line assemblies 1268-1271 and their individual components and connects them to the primary support structure.

With particular reference to the primary support structure, the primary support structure comprises an aftertreatment tray module 1277, locomotive body frame panels 1276, and mixing manifold support springs 1280. Specifically, the aftertreatment tray module 1277 carries the exhaust aftertreatment system 1251. The aftertreatment tray module 1277 is mounted to the locomotive body frame panels 1276, which are in turn carried by the locomotive body frame 1275. As best shown in FIG. 12N, when the primary support structure is mounted to the locomotive body frame 1275, the aftertreatment tray module 1277 is located above the engine 1206 and each of the body locomotive body frame panels 1276 are located adjacent to the engine 1206. In order to allow service and maintenance of the engine 1206, each of the locomotive body frame panels 1276 preferably includes access doors 1278 integrated therein. In addition, to facilitate the maintenance and repair of any of the components of the exhaust aftertreatment system 1251 away from the locomotive, the aftertreatment tray module 1277 (and therefore the exhaust aftertreatment system 1251) may be disconnected from the locomotive body frame panels 1276. The aftertreatment tray module 1277 also provides the structural basis for the secondary support structure.

The primary support structure further provides a means for carrying the physical mass load of the turbocharger mixing manifold 1211, while maintaining the flow of exhaust gas with the engine and isolating the operational loads between the engine 1206 and the locomotive body frame 1275. Specifically, as best shown in FIGS. 12A and 12D, in order to isolate the operational loads between the engine 1206 and the locomotive body frame 1275, the turbocharger mixing manifold 1211 is generally flexibly connected to the discrete exhaust aftertreatment line assemblies 1268-1271 of the exhaust aftertreatment system 1251. In the preferred embodiment of the present ATSS such flexible connection is accomplished via a plurality of flexible double gimbal metal expansion joint couplings 1294-1297. The double gimbal couplings 1294-1297 connect each of the mixing manifold outlets 1213-1216 with a corresponding line assembly distribution manifold 1285 of each of the exhaust aftertreatment line assemblies 1271. This arrangement allows for extensive relative motion between the turbocharger mixing manifold 1211 and the exhaust aftertreatment line assemblies 1271 while maintaining the flow of exhaust gas between the two. This flexible coupling may also serve as a separation point for disassembly during repair or maintenance of the exhaust aftertreatment system 1251.

The mixing manifold intake 1550 coupled to the turbocharger 1200 cannot alone support the physical mass of the turbocharger mixing manifold 1211. Accordingly, as best shown in FIGS. 12E and 12V, the mixing manifold support springs 1280, carry the physical mass load of the turbocharger mixing manifold 1211 into the aftertreatment tray module 1277. Furthermore, a manifold thrust reaction linkage assembly 1281 comprising a plurality of rigid link members connects the mixing manifold intake 1550 to the engine 1206 to stabilize the mixing manifold intake 1550 and the turbocharger mixing manifold 1211 from operational loads along the longitudinal axis of the locomotive body frame 1275 that occur during rail car coupling activity. This arrangement directs these external operational loads into the structure of the engine 1206 to minimize the effect of the physical mass load of the turbocharger mixing manifold 1211 on top of the turbocharger 1200 and still allow for thermal growth and expansion of both the turbocharger mixing manifold 1211 and the mixing manifold intake 1550. The primary support structure carries the mass load of the turbocharger mixing manifold 1211 through the mixing manifold support springs 1280 whereas the engine 1206 guides the turbocharger mixing manifold 1211 through the manifold thrust reaction linkage assembly 1281. This configuration provides for decoupling/isolation of any motion and vibration originating from the engine 1206 and any movement of the primary and secondary support structures.

The secondary support structure of the preferred embodiment of the disclosed ATSS includes a support linkage system comprising a plurality of identical individual support link assemblies 1421-1436 located at discrete support linkage stations 1401-1416 along the length of each of the exhaust aftertreatment line assemblies 1268-1271 (see FIGS. 12G and 12I-12J). The support linkage system carries the individual exhaust aftertreatment line assemblies 1268-1271 of the exhaust aftertreatment system 1251 and connects each of the exhaust aftertreatment line assemblies 1268-1271 to the primary support structure, in particular the aftertreatment tray module 1277.

Figures 12P, 12Q:
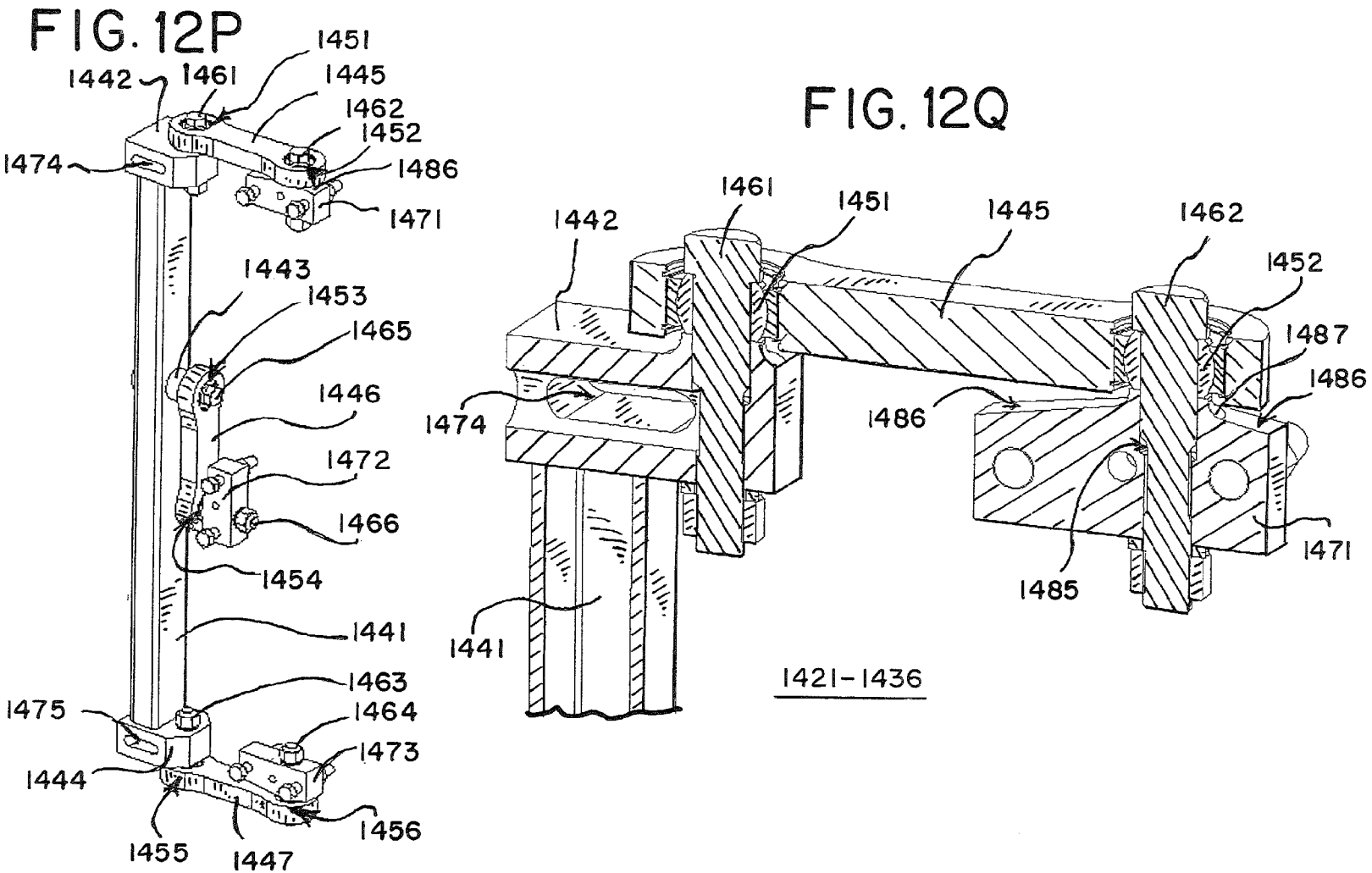
FIG. 12P is a detailed perspective view of an exemplary support link assembly that is part of the secondary support structure of the aftertreatment system of FIG. 12A.
FIG. 12Q is a detailed perspective partial cross-sectional view of an exemplary support link assembly that is part of the secondary support structure of the aftertreatment system of FIG. 12A.

With particular reference to FIGS. 12J-12K and 12P, each one of the support link assemblies 1421-1436 of the preferred embodiment is designed as a functional constraint known as a four-bar mechanism. Each of the support link assemblies 1421-1436 comprises a link support beam 1441 adapted to be mounted to one of the support linkage stations 1401-1416. Each link support beam 1441 comprises an upper link adaptor 1442, a center link adaptor 1443 and a lower link adaptor 1444.

The upper link adaptor 1442 connects to a rigid upper link member 1445, the upper link member 1445 having two opposite end sections, each of which adapted to receive and hold in place a first 1451 and a second spherical bearing 1452. One end section of the upper link member 1445 is movably secured to the upper link adaptor 1442 by a first pin 1461, which secures the inner bearing race of a first spherical bearing 1451 to the upper link adaptor 1442. The opposite end of the upper link member 1445 is movably secured to a first flange adaptor 1471 by a second pin 1462, which secures the inner bearing race of a second spherical bearing 1452 to the first flange adaptor 1471. When properly installed, as shown in FIGS. 12K and 12P-12Q, the rigid upper link member 1445, allows for translational movement of the first flange adaptor 1471 substantially along the vertical and longitudinal axis (but not the lateral axis) of the exhaust aftertreatment system 1251. The upper link adaptor 1442 further includes an upper link adaptor slot 1474 adapted to receive a first bolt 1481 for mounting of the link support beam 1441 to the linkage assembly mounting track 1490 utilizing a first set of mounting pads 1491-1492 comprising mounting slots 1497 (see FIGS. 12Q-12R).

The lower link adaptor 1444 connects to a rigid lower link member 1447, the lower link member 1447 having two opposite end sections, each of which adapted to receive and hold in place a third 1453 and fourth spherical bearing 1454. One end section of the lower link member 1447 is movably secured to the lower link adaptor 1444 by a third pin 1463, which secures the inner bearing race of a third spherical bearing 1453 to the lower link adaptor 1444. The opposite end of the lower link member 1447 is movably secured to a second flange adaptor 1472 by a fourth pin 1464, which secures the inner bearing race of a fourth spherical bearing 1454 to the second flange adaptor 1472. When properly installed, as shown in FIGS. 12K and 12P, the rigid lower link member 1447, allows for translational movement of the second flange adaptor 1472 substantially along the vertical and longitudinal axis (but not the lateral axis) of the exhaust aftertreatment system 1251. The lower link adaptor 1444 also further includes a lower link adaptor slot 1475 adapted to receive a second bolt 1482 for mounting of the link support beam 1441 to the linkage assembly mounting track 1490 utilizing a second set of mounting pads 1493-1494 comprising mounting slots (see mounting slots 1493 in FIG. 12R).

The center link adaptor 1443 connects to a rigid center link member 1446, the center link member 1446 having two opposite end sections, each of which adapted to receive and hold in place a fifth 1455 and sixth spherical bearing 1456. One end section of the center link member 1446 is movably secured to the center link adaptor 1443 by a fifth pin 1465, which secures the inner bearing race of a fifth spherical bearing 1455 to the center link adaptor 1443. The opposite end of the center link member 1446 is movably secured to a third flange adaptor 1473 by a sixth pin 1466, which secures the inner bearing race of a sixth spherical bearing 1456 to the a third flange adaptor 1473. When properly installed, as shown in FIGS. 12K and 12P, the rigid center link member 1446, unlike the upper link member 1445 and lower link member 1447 discussed above, allows for translational movement of the third flange adaptor 1473 only substantially along the longitudinal axis and very limited movement along the lateral axis (to account for radial expansion of the line assembly flange 1495 at or near the third flange adaptor 1473) of the exhaust aftertreatment system 1251. Translation along the vertical axis is not possible. This configuration allows for accommodation of the radial thermal expansion of the line assembly flange 1501 connected to the third flange adaptor 1473.

All of the flange adaptors 1471, 1472 and 1473 connect to the same line assembly flange 1501, which is adapted to receive each one of the discrete exhaust gas lines 1272, 1273 and 1274 of one of the exhaust aftertreatment line assemblies, e.g., exhaust aftertreatment line assembly 1271 as best shown in FIGS. 12G, 12I and 12O. As best shown in FIG. 12O, the preferred embodiment of the disclosed ATSS, includes sixteen (16) line assembly flanges 1501-1516 used to receive the exhaust gas lines of each of the exhaust aftertreatment line assemblies 1268-1271, whereby, a set of two line assembly flanges, e.g. 1501 and 1502, holds the inline filtration system 1255/1257 and another set of two line assembly flanges, e.g. 1503 and 1504, holds the $NO_X$ reduction system 1265/1267.

Figure 12R:
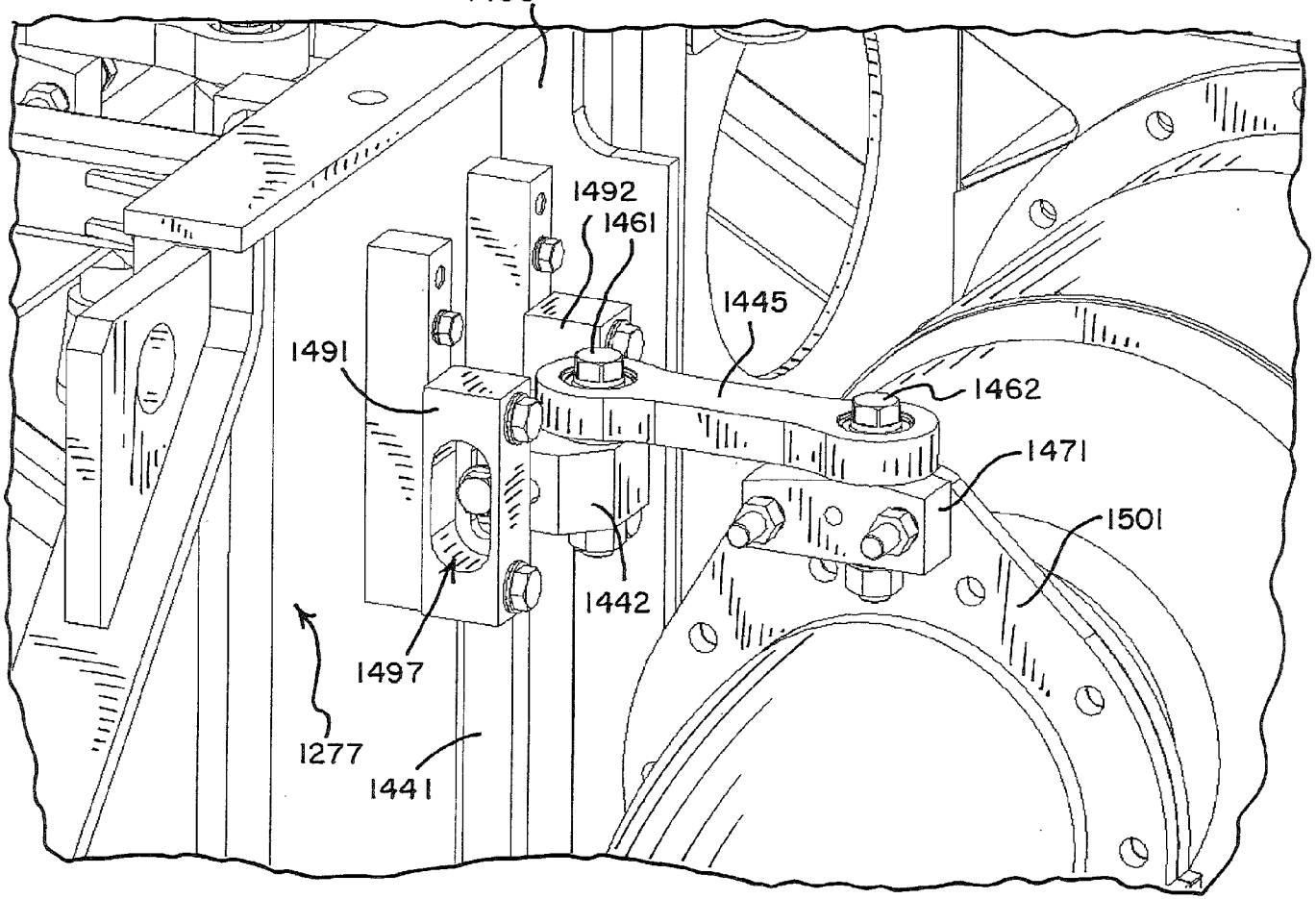
FIG. 12R is a detailed perspective view of an exemplary support link assembly that is part of the secondary support structure of the aftertreatment system of FIG. 12A.
Figure 12S:
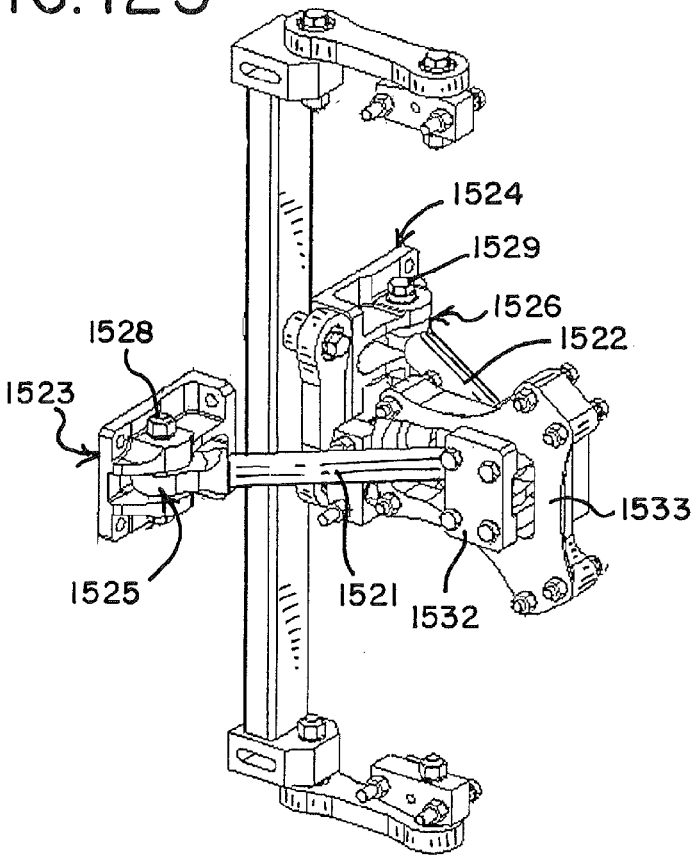
FIG. 12S is a detailed perspective view of an exemplary support link assembly further including an embodiment of support link thrust-reaction assembly as part of the secondary support structure of the aftertreatment system of FIG. 12A.
Figure 12T:
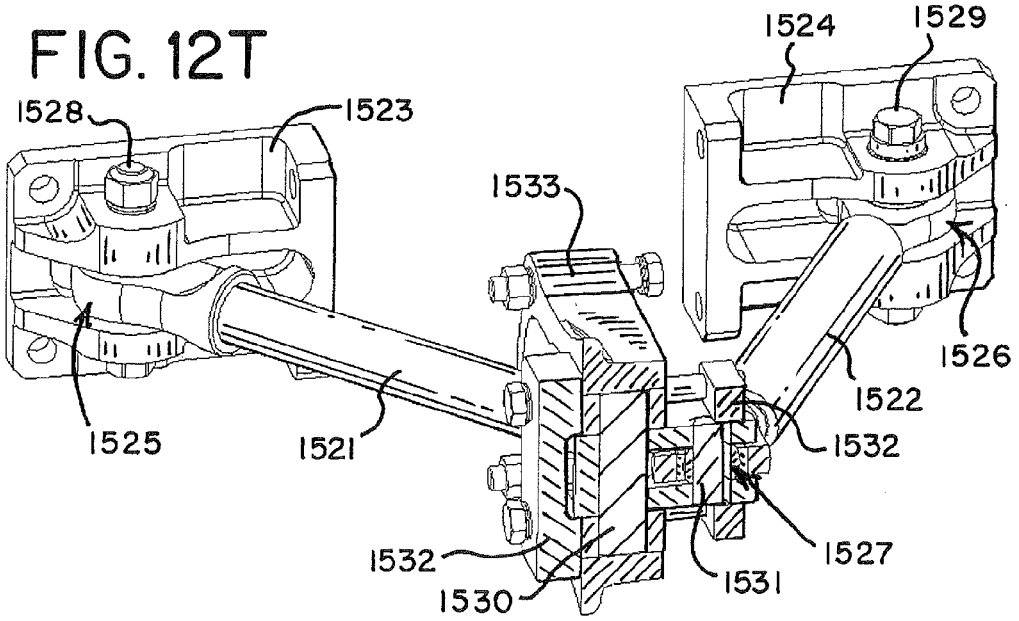
FIG. 12T is a detailed perspective partial cross-sectional view of an exemplary support link assembly further including an embodiment of support link thrust-reaction assembly as part of the secondary support structure of the aftertreatment system of FIG. 12A.
Figure 12U:
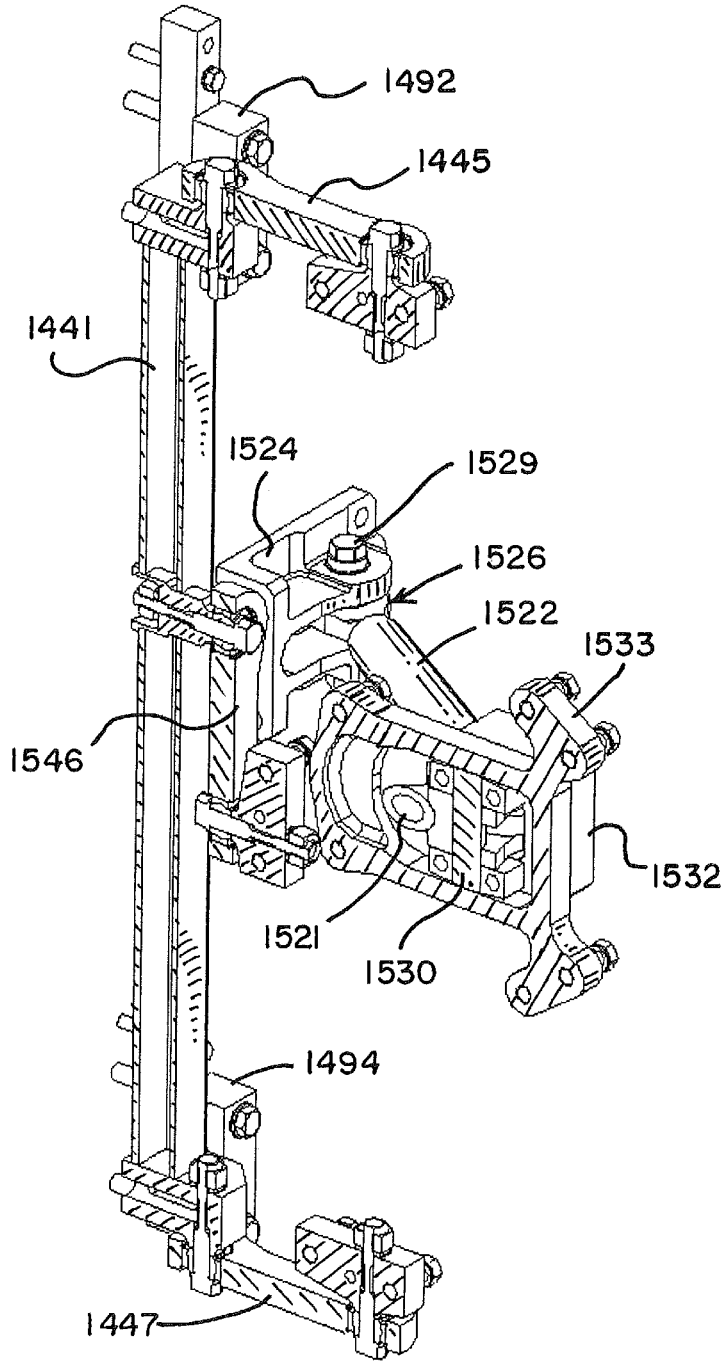
FIG. 12U is a detailed perspective cross-sectional view of an exemplary support link assembly further including an embodiment of support link thrust-reaction assembly as part of the secondary support structure of the aftertreatment system of FIG. 12A.
Figure 12V:
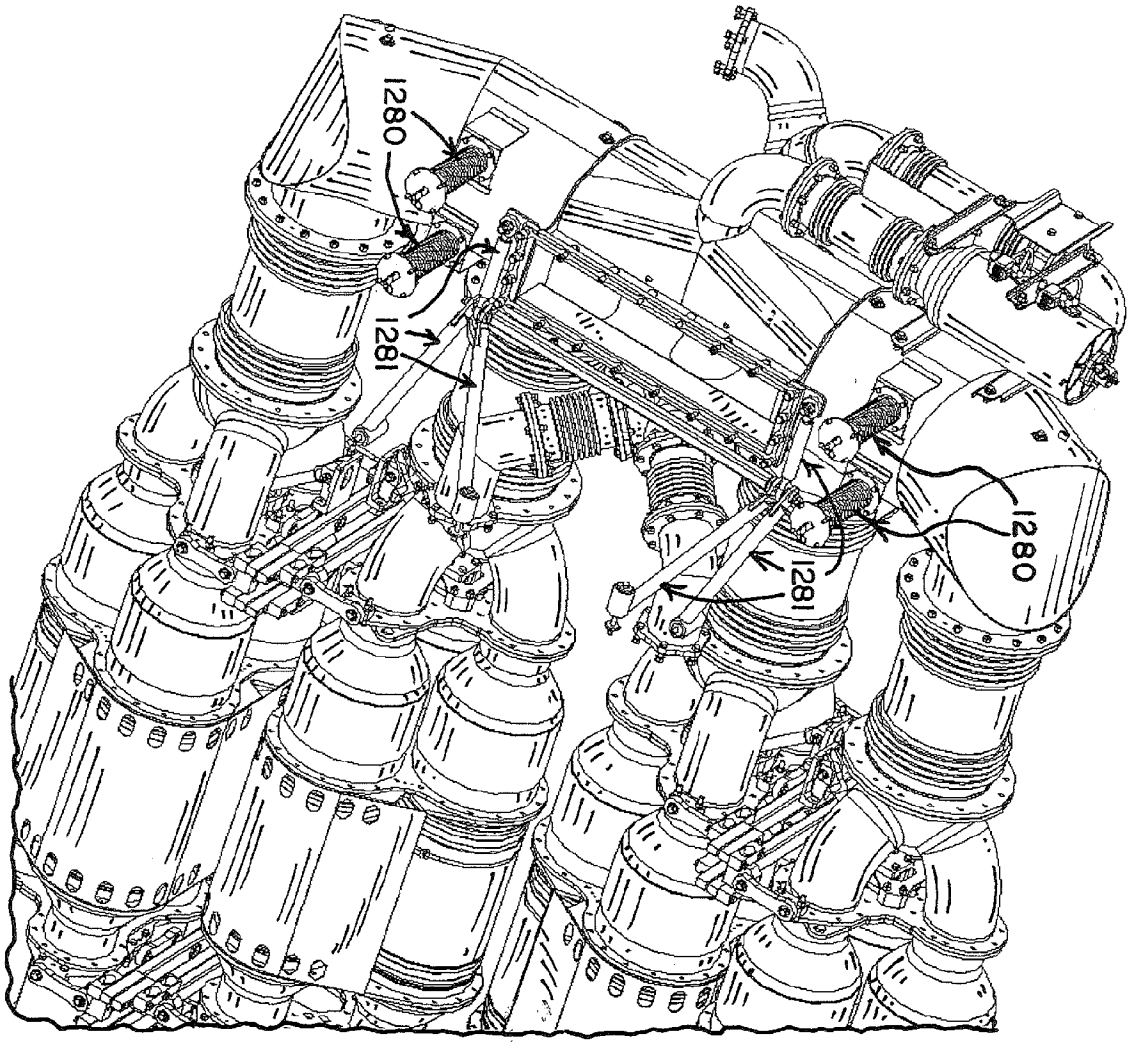
FIG. 12V is a partial perspective bottom view of the exhaust aftertreatment system of FIG. 12A including an embodiment of the primary support structure and a manifold thrust reaction linkage assembly.

Further detail regarding the flange adaptors 1471, 1472 and 1473 is described with reference to the representative first flange adaptor 1471, as shown in FIGS. 12P-12R. First flange adaptor 1471 has a hollow channel 1485 adapted to receive a second pin 1462 and a substantially oblique or slanted flange adaptor surface 1486 descending away from the channel rim 1487 of located, when properly mounted, adjacent to the second spherical bearing 1452. With regard to the first 1471 and second flange adaptor 1472 (connected to the upper 1445 and lower link member 1447, respectively) the oblique or slanted flange adaptor surface 1486 further facilitates a translation of the first 1471 and second flange adaptor 1472 substantially along the vertical axis of the aftertreatment system 1251. With regard to the third flange adaptor 1473 (connected to the center link member 1446) the oblique or slanted flange adaptor surface 1486 further facilitates a translation of the third flange adaptor 1473 substantially along the lateral axis of the aftertreatment system 1251. This configuration primarily accommodates the radial thermal expansion of the line assembly flanges 1501-1516.

In the preferred embodiment, it is desired that materials used for the components of the support link assemblies 1421-1436 resist high temperatures and oxidation to allow smooth rotation with minimal play and sufficient structural strength. Therefore, the link support beam 1441, the link adaptors 1442-1444, the pins 1461-1466, and the link members 1445-1447, are preferably made out of corrosion-resistant, galling-resistant iron or nickel-based alloys. Furthermore, in order to facilitate the serviceability of the load bearing spherical bearings 1451-1456 each of the spherical bearings 1451-1456 and in particular each of the link members 1445-1447 is especially configured adapted to allow for removal of the spherical bearings 1451-1456 with appropriate tools should they require replacement due to wear. Due to the herein disclosed unique configuration of the support linkage system and in particular the support link assemblies 1421-1436, the replacement of individual spherical bearings 1451-1456 and individual link members 1445-1447 can take place one at a time without removing any of the components of the exhaust aftertreatment system 1251, and in particular without disassembling the exhaust aftertreatment line assemblies 1268-1271, including the inline filtration system 1255/1257 and the $NO_X$ reduction system 1265/1267 of each of the exhaust aftertreatment line assemblies 1268-1271.

The primary support structure is not generally designed to accept the thermal expansion of the exhaust aftertreatment line assemblies 1268-1271 caused by the significant temperature gradients during operation of the locomotive 103, due to the conveyance of extremely hot exhaust gases through said assemblies 1268-1271. However, the support linkage system described herein, provides a means for connecting each of the exhaust aftertreatment line assemblies 1268-1271 to the primary support structure (i.e., the aftertreatment tray module 1277), thereby thermally isolating the heat load from the exhaust aftertreatment line assemblies 1268-1271 from the primary support structure. In addition to providing a solid connection of the exhaust aftertreatment line assemblies 1268-1271 to the aftertreatment tray module 1277 of the primary support structure, the support linkage system, and in particular each of the support link assemblies 1421-1436, is also designed to accommodate the thermal expansion of the components of the exhaust aftertreatment line assemblies 1268-1271, by allowing each one of the exhaust aftertreatment line assemblies 1268-1271 complete translational freedom substantially along the longitudinal axis of the exhaust aftertreatment system 1251 (see e.g., FIG. 12I).

Furthermore, (as described above) the disclosed configuration utilizes three (3) links at each support link assembly 1421-1436, i.e., a upper link member 1445, a center link member 1446 and a lower link member 1447 and associated spherical bearings 1451-1456. This arrangement also allows for freedom for radial expansion of the line assembly flanges 1501-1516 during their thermal excursions caused by the hot exhaust gases passing through the exhaust gas lines 1272-1274 of each of the exhaust aftertreatment line assemblies 1268-1271.

The unique configuration of the disclosed support linkage system is also beneficial during the installation of the exhaust aftertreatment system 1251 and in particular for the mounting of each of the individual exhaust aftertreatment line assemblies 1268-1271 to the aftertreatment tray module 1277 at each of the support linkage stations 1401-1416. Specifically, the translational freedom provided by each of the support link assemblies 1421-1436 (as described above) allows for the accommodation of dimensional variations of the components of the primary support structure and the components of the exhaust aftertreatment system 1251 during installation. In other words, the disclosed flexible support linkage system allows for some "play" when fitting and installing the various components of the exhaust aftertreatment system 1251 to the aftertreatment tray module 1277.

Each one of the support linkage stations 1401-1416 of the preferred embodiment comprises a linkage assembly mounting track 1490 adapted to receive the link support beam 1441 of each of the support link assemblies 1421-1436. Each support link assembly 1421-1436 is mounted to the assembly mounting track 1490 by utilizing a plurality of mounting pads 1491-1494. In the preferred embodiment, the installation of each one of the support link assemblies 1421-1436 requires four (4) mounting pads 1491-1494. As best shown in FIGS. 12I, 12L, and 12R, a first 1491 and second mounting pad 1492 is positioned on either side of the upper link adaptor 1442, and a third 1493 and fourth mounting pad 1494 (not shown) is positioned on either side of the lower link adaptor 1444. With additional particular reference to FIGS. 12K and 12R, the upper link adaptor 1442 and the adjacent mounting pads 1491 and 1492 are mounted and secured to the linkage assembly mounting track 1490 by aligning the upper link adaptor slot 1474 of the upper link adaptor 1442, the mounting slots 1497 of the adjacent mounting pads 1491 and 1492 and the upper mounting track slots 1495 of the linkage assembly mounting track 1490, and inserting a first bolt 1481 extending from and through a first one of the upper mounting track slots 1495 to a second one of the upper mounting track slots 1495. The installation of the lower link adaptor 1444 is identical but involving a third 1493 and a fourth mounting pad 1494, lower link adaptor slot 1475 and a second bolt 1482 (not shown).

As described above, each one of the support linkage stations 1401-1416 comprises one of the support link assemblies 1421-1436 with each only having enough links (i.e., rigid link members 1445, 1446 and 1447). This arrangement ensures that the immediately adjacent component of each one of the exhaust aftertreatment line assemblies 1268-1271 (i.e., the inline filtration system 1255/1257 and the $NO_X$ reduction system 1265/1267) remains fixed along the vertical and lateral axis of the aftertreatment system 1251. This arrangement also allows for freedom of translation substantially along the longitudinal axis of the aftertreatment system 1251. However, if only a single support link assembly, e.g., 1421, is used to mount one of the exhaust aftertreatment line assemblies, e.g., 1271 to the aftertreatment tray module 1277, the disclosed three-link configuration only prevents a rotation of the line assembly flange, e.g., 1501, around the lateral axis but not the rotation around the vertical axis of the exhaust aftertreatment system 1251. Therefore, in order to prevent rotation of any part of the exhaust aftertreatment line assemblies 1268-1271 around the vertical axis, at least one additional support linkage station, utilizing the same or substantially similar support link assembly (e.g., 1422) is used to connect the exhaust aftertreatment line assembly (e.g., 1271) to the aftertreatment tray module 1277. This arrangement ensures that the components of the exhaust aftertreatment line assembly 1271 only translate substantially along the longitudinal axis and to prevent any rotation of the exhaust aftertreatment assembly 1271 around any axis.

Each one of the exhaust aftertreatment line assemblies 1268-1271 generally expands due to increased exhaust gas temperature during operation of the locomotive 103. Accordingly, if more than two support linkage stations (e.g. 1401, 1402, 1403 and 1404) support one of the exhaust aftertreatment line assemblies (e.g. 1271), a slight lateral displacement discrepancy results between each intermediate support linkage station due to the differential rotational movement of each of the upper and lower rigid link members (e.g., 1445 and 1447) utilized in each of the support link assemblies 1421-1436 (see above). The support linkage system is therefore adapted to accommodate this minimal lateral differential with the inherent (limited) flexibility of each of the long exhaust aftertreatment line assemblies 1268-1271.

Another aspect of the preferred embodiment of the secondary support system is a support link thrust-reaction assembly applied to support link assemblies 1421, 1425, 1429 and 1433

(i.e., the "first-in-line" support link assemblies in each of the exhaust aftertreatment line assemblies 1268, 1269, 1270 and 1271). This support link thrust-reaction assembly is located downstream from the turbocharger mixing manifold 1211 (see, e.g., FIG. 12E). The following description of the support link thrust-reaction assembly is made with particular reference to FIGS. 12E, 12I, 12L, 12S-12U.

The support link thrust-reaction assembly may comprise a single rigid link member (not shown) or a plurality of rigid link members. Irrespective of the number of link members utilized for the support link thrust-reaction assembly, the purpose of each of the support link thrust-reaction assemblies is to limit the translational movement of the respective associated exhaust aftertreatment line assembly along the longitudinal axis of the exhaust aftertreatment system 1251 (i.e., the axis along which the exhaust aftertreatment line assemblies 1268-1271 extend due to their differential thermal growth/expansion). In addition, the support link thrust-reaction assemblies rigidly constrain each of the exhaust aftertreatment line assemblies 1268-1271 along the longitudinal axis of the exhaust aftertreatment system 1251 for the purpose of locating each one of the individual exhaust aftertreatment line assemblies 1268-1271 at one fixed position relative to the primary support structure (i.e., the aftertreatment tray module 1277). As a result, the support link thrust-reaction assemblies are capable of transferring significant longitudinal loads imparted by the locomotive 103 (e.g., loads caused by coupling of rail cars adjacent to either end of the locomotive) into the primary support structure without allowing for longitudinal translational movement of the exhaust aftertreatment line assemblies 1268-1271.

A preferred embodiment of the support link thrust-reaction assembly, as best shown in FIGS. 12L and 12S-U, comprises a first 1521 and a second rigid truss link member 1522, a first 1523 and second truss link adaptor 1524, a plurality of spherical bearings 1525-1527, a plurality of bolts 1528-1529, a plurality of pins 1530-1531, a truss link coupling node 1532 and a thrust-reaction flange adaptor 1533.

Specifically, the first rigid truss link member 1521 has two opposite end sections. The first end section is adapted to receive and hold a first spherical bearing 1525, whereby the first spherical bearing 1525 is adapted to receive a first bolt 1528. The opposite end section is adapted to receive a first pin 1530 and a second pin 1531, whereby the second pin 1531 connects the second truss link member 1522 to the first truss link member 1521. The first rigid truss link member 1521 is anchored to the aftertreatment tray module 1277 by connecting the first spherical bearing 1525 and the first truss link adaptor 1523 (which is mounted to the tray module 1277) via a first bolt 1528. The first truss link member 1521 is further coupled to the truss link coupling node 1532 via a first pin 1530. Pin 1530 is designed to transfer all the longitudinal thrust load of the respective exhaust aftertreatment line assembly connected to the line assembly flange 1501 via thrust reaction flange adaptor 1533 into the tray module 1277 of the primary support structure without allowing for longitudinal translational movement of the exhaust aftertreatment line assemblies 1268-1271 past the fixed center point at the intersection of the first 1521 and second truss link member 1522 at the truss link coupling node 1532.

The second truss link member 1522 also has two opposite end sections. The first end section is adapted to receive and hold a second spherical bearing 1526, whereby the second spherical bearing 1526 is adapted to receive a second bolt 1529. The opposite end section is adapted to receive a third spherical bearing 1527, whereby the third spherical bearing 1527 is adapted to receive the second pin 1531. The second truss link member 1522 is anchored to the tray module 1277 by connecting the second spherical bearing 1526 and the second truss link adaptor 1524 (which is also mounted to the tray module 1277) via a second bolt 1529. The second truss link member 1522 is further coupled to the first truss link member 1522 via the second pin 1531. Accordingly, while the first truss link member 1521 is directly coupled to the truss link coupling node 1532 via the first pin 1530, the second truss link member 1522 is only indirectly coupled to the truss link coupling node 1532 via the second pin 1531 coupling the first 1521 and the second truss link member 1522. Accordingly, the first 1521 and the second truss link member 1522 are both functionally coupled to the truss link coupling node 1532, and together with their respective anchor points (i.e., at first 1523 and second truss link adaptor 1524) to the tray module 1277, the first 1521 and second truss link member 1522 form a rigid A-frame configuration (see e.g., FIG. 12T).

In particular, the vertical orientation of the second pin 1531 prevents rotation of the truss link coupling node 1532 around the longitudinal axis of the exhaust aftertreatment line assembly (e.g., 1271), connected to the truss link coupling node via thrust reaction flange adaptor 1533 and the line assembly flange 1501. However, the truss link coupling node 1532 still allows the thrust-reaction flange adaptor 1533 (and the line assembly flange 1501 connected thereto) a limited rotation around the longitudinal axis and a limited translation along the lateral axis. This limited rotation and translation ability is desired to primarily allow for fit-up tolerances during installation of the components of the exhaust aftertreatment line assemblies 1268-1271 and certain manufacturing (dimensional) variations. Some limited rotation around the longitudinal axis may also occur due to longitudinal thermal growth of the components of the exhaust aftertreatment line assemblies 1268-1271.

The various embodiments of the present disclosure may be applied to both low and high pressure loop EGR systems. The various embodiments of the present disclosure may be applied to locomotive two-stroke diesel engines may be applied to engines having various numbers of cylinders (e.g., 8 cylinders, 12 cylinders, 16 cylinders, 18 cylinders, 20 cylinders, etc.). The various embodiments may further be applied to other two-stroke uniflow scavenged diesel engine applications other than for locomotive applications (e.g., marine applications).

As discussed above, $NO_X$ reduction is accomplished through the exhaust aftertreatment system while the new engine components maintain the desired levels of cylinder scavenging and mixing in a uniflow scavenged two-stroke diesel engine.

Embodiments of the present disclosure relate to a locomotive diesel engine and, more particularly, to a support system for an exhaust aftertreatment system situated in relation to a two-stroke locomotive diesel engine. The above description is presented to enable one of ordinary skill in the art to make and use the disclosure and is provided in the context of a patent application and its requirements. While this disclosure contains descriptions with reference to certain illustrative aspects, it will be understood that these descriptions shall not be construed in a limiting sense. Rather, various changes and modifications can be made to the illustrative embodiments without departing from the true spirit, central characteristics and scope of the disclosure, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law. For example, the various operating parameters or values described herein exemplify representative values for the present system operating under certain conditions. Accordingly, it is expected that these values will change according to different locomotive operating parameters or conditions. In another example, although a urea-based SCR is shown, other SCR's known in the art may also be used (e.g., hydrocarbon based SCR's, De-$NO_X$ systems, etc.).

What is claimed:

1. A support system for mounting the components of an exhaust aftertreatment system for reducing pollutants in exhaust gas expelled from a locomotive diesel engine to the locomotive structure, said components include a turbocharger mixing manifold and a plurality of discrete exhaust aftertreatment line assemblies, the support system comprising:

a primary support structure, including an aftertreatment tray module and a plurality of locomotive body frame panels, wherein said aftertreatment tray module is mounted to said plurality of locomotive body frame panels, whereby each of said locomotive body frame panels is mounted to the frame of said locomotive on either side of said locomotive engine, and whereby said aftertreatment tray module carries a mass load of said exhaust aftertreatment system and directs said mass load to said locomotive frame via said body frame panels to said locomotive frame rather than to said locomotive engine; and a secondary support structure, including a plurality of support link assemblies mounted to said aftertreatment tray module of said primary support structure, and adapted to carry said exhaust aftertreatment line assemblies, wherein said primary and secondary support structures (a) carry the physical mass load of said exhaust aftertreatment system, (b) isolate said exhaust aftertreatment system from external loads and forces, and (c) allow for the physical translation resulting from thermal expansion of certain components of said exhaust aftertreatment system.

2. The support system of claim 1, wherein said aftertreatment tray module is configured to be removed from said locomotive structure with all of said components of said exhaust aftertreatment system to facilitate service and installation of said components.

3. The support system of claim 1, wherein said aftertreatment tray module comprises a plurality of support beams as part of its integral structure.

4. The support system of claim 1, wherein said body frame panels include access doors to facilitate the service and maintenance of said locomotive engine.

5. The support system of claim 1, wherein said primary support structure further includes a plurality of mixing manifold support springs adapted to support the mass load of said turbocharger mixing manifold and to decouple the turbocharger mixing manifold from external loads and forces originating at said locomotive frame and/or said locomotive engine.

6. The support system of claim 5, wherein said mixing manifold support springs are mounted between said turbocharger mixing manifold and said aftertreatment tray module.

7. The support system of claim 1, wherein said primary support structure further includes a manifold thrust reaction linkage assembly comprising a plurality of rigid link members that fixedly connect said turbocharger mixing manifold to said locomotive engine for stabilizing said turbocharger mixing manifold from external loads and forces originating at said locomotive frame.

8. The support system of claim 1, wherein said mixing manifold is coupled to said plurality of discrete exhaust aftertreatment line assemblies via a plurality of flexible double gimbal expansion joint couplings adapted to allow for extensive relative motion between said turbocharger mixing manifold and the individual exhaust aftertreatment line assemblies while maintaining the flow of exhaust gas.

9. The support system of claim 8, wherein each of said plurality of said flexible double gimbal expansion joint couplings is further adapted to serve as a separation point for disassembly during repair or maintenance of the exhaust aftertreatment system.

10. A support system for mounting the components of an exhaust aftertreatment system for reducing pollutants in exhaust gas expelled from a locomotive diesel engine to the locomotive structure, said components include a turbocharger mixing manifold and a plurality of discrete exhaust aftertreatment line assemblies, the support system comprising:

a primary support structure, including an aftertreatment tray module and a plurality of locomotive body frame panels; and a secondary support structure, including a plurality of support link assemblies mounted to said aftertreatment tray module of said primary support structure, and adapted to carry said exhaust aftertreatment line assemblies, wherein said primary and secondary support structures (a) carry a physical mass load of said exhaust aftertreatment system, (b) isolate said exhaust aftertreatment system from external loads and forces, and (c) allow for the physical translation resulting from thermal expansion of certain components of said exhaust aftertreatment system;

wherein each one of said plurality of support link assemblies comprises:

a rigid upper link member having two opposite end sections, whereby one end section is movably secured to said aftertreatment tray module via a first spherical bearing and the opposite end section is movably secured to a first flange adaptor via a second spherical bearing so as to allow translational movement of said first flange adaptor only substantially along the vertical and longitudinal axis of said exhaust aftertreatment system;

a rigid lower link member having two opposite end sections, whereby one end section is movably secured to said aftertreatment tray module via a third spherical bearing and the opposite end section is movably secured to a second flange adaptor via a fourth spherical bearing so as to allow translational movement of said second flange adaptor only substantially along the vertical and longitudinal axis of said exhaust aftertreatment system to allow for thermal expansion of said exhaust aftertreatment line assembly;

a rigid center link member having two opposite end sections, whereby one end section is movably secured to said aftertreatment tray module via a fifth spherical bearing and the opposite end section is movably secured to a third flange adaptor via a sixth spherical bearing so as to allow translational movement of said third flange adaptor only substantially along the longitudinal axis and very limited translation substantially along the lateral axis of said exhaust aftertreatment system in order to allow for limited radial thermal expansion of a line assembly flange connected to said third flange adaptor; and whereby all of said line flange adaptors connect to the same line assembly flange which is adapted to receive and secure one of said plurality of exhaust aftertreatment line assemblies; and wherein said plurality of support link assemblies are mounted at a plurality of discrete support linkage stations located on said aftertreatment tray module along the length of each one of said plurality of exhaust aftertreatment line assemblies.

11. The support system of claim 10, wherein said plurality of support link assemblies are configured to secure said plurality of exhaust aftertreatment line assemblies and to allow each one of said exhaust aftertreatment line assemblies complete translational freedom substantially along the longitudinal axis of said exhaust aftertreatment system to accommodate thermal expansion of said exhaust aftertreatment line assemblies during different operational states of said locomotive and to accommodate dimensional variations of said components of said primary support structure and said components of said exhaust aftertreatment system during installation.

12. The support system of claim 10, wherein said upper, lower and center link members are secured to said aftertreatment tray module via a link support beam adapted to mount to one of said plurality of discrete support linkage stations.

13. The support system of claim 10, wherein said spherical bearings are load bearing and wherein said upper, lower and center link members and each if said spherical bearings are especially configured to allow for removal and replacement of said spherical bearings with appropriate tools.

14. The support system of claim 11, wherein said upper, lower and center link members are made out of corrosion-resistant, galling-resistant or nickel-based alloys.

15. The support system of claim 11, wherein said plurality of support link assemblies provide the only physical connection to said aftertreatment tray module, providing for thermal isolation of the heat load from said exhaust aftertreatment line assemblies from said aftertreatment tray module.

16. The support system of claim 10, wherein at least one of said plurality of support link assemblies comp(rises a support link thrust reaction assembly configured to allow only translational movement of one of said plurality of exhaust aftertreatment line assemblies secured to said support link assembly substantially along the longitudinal axis of said exhaust aftertreatment system to allow for thermal expansion of said exhaust aftertreatment line assembly.

17. The support system of claim 16, wherein said support link thrust reaction assembly is further configured to rigidly constrain said exhaust aftertreatment line assembly along the longitudinal axis of the exhaust aftertreatment system for locating said one of said plurality of aftertreatment line assemblies at one fixed position relative to said aftertreatment tray module, allowing for the transfer of longitudinal loads originating at said locomotive frame into said aftertreatment tray module without allowing for any longitudinal translational movement of said exhaust aftertreatment line assembly.

18. The support system of claim 17, wherein said support link thrust reaction assembly comprises a single rigid truss link member.

19. The support system of claim 17, wherein said support link thrust reaction assembly comprises:

a first rigid truss link member having two opposite end sections, whereby one end section is anchored to said aftertreatment tray module via a first spherical bearing and a first bolt and the opposite end section is adapted to receive a first and a second pin, whereby said truss link member is coupled to a truss link coupling node via said first pin;

a second rigid truss link member having two opposite end sections, whereby one end section is anchored to said aftertreatment tray module via a second spherical bearing and a second pin, whereby said second pin connects said opposite end section of said first truss link member and said opposite end section of said second truss link member via said second spherical bearing; and said truss link coupling node further coupled to a thrust-reaction flange adaptor which is connected to one of said line assembly flanges.

20. The support system of claim 19, wherein said first pin is especially adapted to transfer all the longitudinal thrust load of said respective exhaust aftertreatment line assembly connected to said line assembly flange via said thrust-reaction flange adaptor into the aftertreatment tray module without allowing for any longitudinal translational movement of said respective exhaust aftertreatment line assembly past the fixed center point at the intersection of said first truss link member and said second truss link member at said truss link coupling node.

21. The support system of claim 20, wherein said first pin is further especially adapted to prevent rotation of said truss link coupling node around the longitudinal axis of said exhaust aftertreatment line assembly, while still allowing said thrust-reaction flange adaptor a limited rotation around the longitudinal axis and a limited translation along the lateral axis of said exhaust aftertreatment line assembly, in order to allow for fitting tolerances during installation of said exhaust aftertreatment line assembly and/or dimensional manufacturing variations.

22. The support system of claim 21, wherein said first pin has a vertical orientation with respect to the longitudinal axis of said aftertreatment line assembly.

23. The support system of claim 17, wherein said support link thrust reaction assembly is configured with each one of every one of said plurality of support link assemblies that is located closest to said turbocharger mixing manifold.

* * * * *

UNITED STATES PATENT AND TRADEMARK OFFICE

CERTIFICATE OF CORRECTION

PATENT NO. : 8,769,941 B2
APPLICATION NO. : 13/173790
DATED : July 8, 2014
INVENTOR(S) : Svihla et al.

It is certified that error appears in the above-identified patent and that said Letters Patent is hereby corrected as shown below:

Title Page, item (73) Assignee: delete "LeGrange," and insert -- LaGrange, --.

In the Specification

Column 2, line 43, delete "Tier Mb" and insert -- Tier IIIb --.

Column 3, line 57, delete "after treatment" and insert -- aftertreatment --.

Column 14, line 15, delete "80 in Hga" and insert -- 80 inHga --.

Column 14, line 16, delete "110 in Hga." and insert -- 110 inHga. --.

In the Claims

Column 26, line 8, in Claim 9, delete "wherein each of said" and insert -- wherein each one of said --.

Column 27, line 40, in Claim 16, delete "comp(rises" and insert -- comprises --.

Column 27, line 13, in Claim 19, delete "whereby said truss link" and insert -- whereby said first truss link --.

Signed and Sealed this
Fifteenth Day of September, 2015

Michelle K. Lee

Michelle K. Lee
*Director of the United States Patent and Trademark Office*